US011187488B2

(12) United States Patent
Warren

(10) Patent No.: US 11,187,488 B2
(45) **Date of Patent: *Nov. 30, 2021**

(54) PROJECTILE ACCELERATOR WITH HEATABLE BARREL

(71) Applicant: Science Applications International Corporation, Reston, VA (US)

(72) Inventor: Gary David Warren, Fairfax, VA (US)

(73) Assignee: Science Applications International Corporation, Reston, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/901,286

(22) Filed: Jun. 15, 2020

(65) Prior Publication Data

US 2021/0055075 A1 Feb. 25, 2021

Related U.S. Application Data

(63) Continuation of application No. 16/509,052, filed on Jul. 11, 2019, now Pat. No. 10,724,823, which is a continuation of application No. 16/168,184, filed on Oct. 23, 2018, now Pat. No. 10,415,925.

(60) Provisional application No. 62/576,316, filed on Oct. 24, 2017.

(51) Int. Cl.
*F41B 11/68* (2013.01)
*F41B 11/723* (2013.01)

(52) U.S. Cl.
CPC ..... *F41B 11/68* (2013.01); *F41B 11/723* (2013.01)

(58) Field of Classification Search
CPC ..... F41B 11/00; F41B 11/68; F41B 11/682; F41B 11/72; F41B 11/723; F41A 13/02; F41A 13/00; F41A 1/02
USPC ..... 89/14.1, 8, 7; 124/71, 73
See application file for complete search history.

(56) References Cited

U.S. PATENT DOCUMENTS

| | | | |
|---|---|---|---|
| 3,052,088 | A | 9/1962 | Davis et al. |
| 3,126,789 | A | 3/1964 | Meyer |
| 3,465,638 | A | 9/1969 | Canning |
| 4,669,212 | A | 6/1987 | Jackson et al. |
| 4,907,487 | A | 3/1990 | Tidman et al. |
| 4,913,029 | A | 4/1990 | Tidman |
| 4,938,112 | A | 7/1990 | Hertzberg et al. |
| 4,974,487 | A | 12/1990 | Goldstein et al. |
| 5,012,719 | A | 5/1991 | Goldstein et al. |
| 5,429,030 | A | 7/1995 | Tidman |

(Continued)

FOREIGN PATENT DOCUMENTS

| | | | |
|---|---|---|---|
| EP | 0242501 | A1 | 2/1989 |
| WO | 2009/128804 | A1 | 10/2009 |

OTHER PUBLICATIONS

Arc-Jet Thruster for Space Propulsion, NASA TN D-2868 (Jun. 1965).

(Continued)

*Primary Examiner* — Jonathan C Weber
(74) *Attorney, Agent, or Firm* — Banner & Witcoff, Ltd.

(57) ABSTRACT

Systems, methods, and apparatuses are described for accelerating projectiles at high velocity. A barrel may include one or more heaters configured to heat a bore of the barrel prior to launch of a projectile. The barrel bore may be formed in a tungsten sleeve and may be heated to high temperatures. Heat from the barrel bore may be transferred to expanding propellant behind a projectile as it travels through the barrel bore.

22 Claims, 49 Drawing Sheets

(56) References Cited

U.S. PATENT DOCUMENTS

| | | | | |
|---|---|---|---|---|
| 6,074,135 | A * | 6/2000 | Tapphorn | B05B 14/10 406/46 |
| 6,849,247 | B1 | 2/2005 | Wagaman et al. | |
| 7,773,362 | B1 | 8/2010 | Wirz | |
| 7,926,403 | B1 | 4/2011 | Vigil et al. | |
| 7,954,413 | B2 | 6/2011 | Koth | |
| 8,826,792 | B1 | 9/2014 | Granger | |
| 9,915,496 | B2 | 3/2018 | Bergeron | |
| 10,119,780 | B1 | 11/2018 | Bergeron | |
| 2015/0175278 | A1 | 6/2015 | Hunter et al. | |
| 2016/0161212 | A1 | 6/2016 | Bergeron | |

OTHER PUBLICATIONS

Combustion Light Gas Gun Technology Demonstration; Final Report for Contract No. N00014-02-C-0419 (downloaded Oct. 8, 2018).
Design of a Two-Stage Light Gas Gun for Muzzle Velocities of 10-11 km/s (downloaded Oct. 8, 2018).
Swayam Prakash, S., et al., Design and Simulation of a Light Gas Gun, International Journal of Innovaive Research in Science, Engineering and Technology (vol. 4, Issue 6, Jun. 2015).
Combs, S.K., et al., Development of a Two-Stage Light Gas Gun to Accelerate Hydrogen Pellets to High Speeds for Plasma Fueling Applications (downloaded Oct. 8, 2018).
The Engineering Properties of Tungsten and Tungsten Alloys, DMIC Report 191 (Sep. 27, 1963).
Skoro, G.P., et al., Experimental results and constitutive modelling for tungsten and tantalum at high strain rates and very high temperatures (downloaded Oct. 21, 2018).
Templeton, G., NASA test 'impossible' no-fuel quantum space engine—and it actually works (downloaded Jul. 20, 2018).
Gas Viscosity Calculator (downloaded Oct. 21, 2018).
Hydrogen-Specific Heat (downloaded Oct. 21, 2018).
Rover Nuclear Rocket Engine Program; Overview of Rover Engine Tests; Final Report (Feb. 1991).
Slaby, J., et al., Heat-Transfer Coefficients for Hydrogen Flowing Through Parallel Hexagonal Passages at Surface Temperatures to 2275 K, NASA TN D-4959 (Dec. 1968).
Bogdanoff, D.W., Optimization Study of the Ames 0.5" Two-Stage Light Gas Gun, NASA Technical Memorandum 110386, Amrch 1996.
Wikipedia page titled "Prandtl number" (downloaded Oct. 21, 2018).
Wikipedia page titled "Reynolds number" (downloaded Oct. 21, 2018).
The Design of Flat-Scored High-Pressure Diaphragms for Use in Shock Tunnels and Gas Guns (U), NAVORD report 6865 (Sep. 6, 1960).
Guildner, L.A., Thermal Conductivity of Gases. III. Some Values of the Thermal Conductivities of Argon, Helium and Nitrogen from 0° C. to 75° C. at Pressures of 1 X [105] to 2.5 X [107] Pascals*, Journal of Research of the National Bureau of Standards—A. Physics and Chemistry (vol. 79A, No. 2, Mar.-Apr. 1975).
Thermal Conductivity of Metals (downloaded Oct. 21, 2018).
Webpage titled "Tungsten" (downloaded Oct. 21, 2018).
Jeelani, S., et al., Two-Stage Light-Gas Gun Installation for Hypervelocity Impact Studies, Technical Report 73-3 (Sep. 1973).
Wikipedia page titled "Ultimate tensile strength" (downloaded Oct. 21, 2018).
Landau, L.D. and Lifshitz, E.M., Fluid Mechanics: Course of Theoretical Physics, vol. 6 (Third Revised English Edition 1966), e g., pp. 344-359.
Nov. 29, 2019—(WO) Invitation to Pay Fees and Partial Search Report—App. No. PCT/US2018/057020.
Frattolillo, et al., "Acceleration of Large Size Deuterium Pellets to High Speeds Using a Small Two-Stage Pneumatic Gun", Review of Scientific Instruments, AIP, vol. 70, No. 5, May 1, 1999, pp. 2355-2364.
Budin, et al., "Factors Affecting the Velocity of Launching Bodies by Means of an Electric-Discharge Light-Gas Accelerator", High Temperature, Kluwer Academic Publishers-Plenum Publishers, vol. 46, No. 2, Apr. 20, 2008, pp. 143-147.
Frattolillo, et al., "High-Speed Multishot Pellet Injector Prototype for the Frascati Tokamak Upgrade", Review of Scientific Instruments, AIP, vol. 69, No. 7, Jul. 1, 1998, pp. 2675-2680.
Milora, et al., "Design of a Tritium Pellet Injector for TFTR", Proceedings of the IEEE/NPSS Symposium on Fusion Engineering, San Diego, Sep. 30-Oct. 3, 1991, vol. SYMP 14, Sep. 30, 1991, pp. 716-720.
Jan. 24, 2020—(WO) Notification of Transmittal of ISR and WO—App. No. PCT/US2018/057020.

* cited by examiner

PROJECTILE ACCELERATOR WITH HEATABLE BARREL

CROSS REFERENCE TO RELATED APPLICATION

This application is a continuation of U.S. patent application Ser. No. 16/509,052, titled "Projectile Accelerator With Heatable Barrel," filed Jul. 11, 2019, which is a continuation of U.S. patent application Ser. No. 16/168,184, titled "Projectile Accelerator With Heatable Barrel," and filed Oct. 23, 2018, which claims priority to U.S. provisional patent application No. 62/576,316, titled "Thermal Gun for Hypervelocity Guided Projectile Launch and/or Use With In Situ Dust for Spacecraft Propulsion," and filed Oct. 24, 2017. Application Ser. Nos. 62/576,316, 16/168,184, and 16/509,052, in their entireties, are incorporated by reference herein.

BACKGROUND

A gun may accelerate a projectile through a barrel by creating high pressure behind that projectile. Conventional guns employ some type of propellant to create that high pressure. The propellant may be gases resulting from burning gun powder, smokeless powder, rocket fuel, other chemical(s). Steam and other gasses have also been used. As a propellant pushes a projectile through a gun barrel, the propellant expands and the pressure in the propellant drops, thereby reducing the force accelerating the projectile. This pressure loss may be increased as heat energy in the propellant is transferred to the gun barrel.

SUMMARY

This Summary is provided to introduce a selection of some concepts in a simplified form as a prelude to the Detailed Description. This Summary is not intended to identify key or essential features.

A projectile accelerator, such as a gun or a propulsion system, may include a barrel with one or more heaters configured to heat a bore of the barrel. An inner barrel may comprise a tungsten sleeve that may be heated to high temperatures. A pressurized propellant may be released into a breach chamber to move a projectile through the barrel. Heat from the barrel may be transferred to the expanding propellant behind the projectile, thereby reducing pressure loss and increasing acceleration of the projectile. The propellant may comprise hydrogen, helium, and/or other gases. Propellant may be recovered from near the barrel exit and recycled. A shutter may cover the barrel exit to prevent incursion of air into the heated barrel bore.

These and other features are described in more detail below.

BRIEF DESCRIPTION OF THE DRAWINGS

Some features are shown by way of example, and not by way of limitation, in the figures of the accompanying drawings and in which like reference numerals refer to similar elements.

DETAILED DESCRIPTION

A gun barrel may be deliberately heated so as to reheat propellant in the barrel. This reheating may increase pressure in the propellant and thereby increase acceleration imparted to a projectile which the expanding propellant is driving through the barrel bore. Because a heated barrel may add energy into the propellant, the initial propellant energy at the gun's breach may be reduced. This may reduce the peak pressure in the barrel and peak acceleration of the projectile. This may allow a much smoother pressure profile in the barrel, and a smoother acceleration profile for the projectile, than may be available using a traditional gun.

A gun barrel may be heated to very high temperatures. The gun barrel may include an inner barrel that is a sleeve formed from a tungsten alloy and/or from other materials able to retain ductility at high temperatures. The sleeve may be sized so that it has a heat capacity and a thermal conductivity that allow the sleeve to maintain a high temperature as heat is drawn from the inner sleeve by propellant. A light gas may be used as a propellant. Examples of light gases include, without limitation, hydrogen ($H_2$), helium (He), mixtures of $H_2$ and He, and $H_2$ and/or He combined small amounts of other gases and/or other materials. In general, a light gas may be any gas or gas mixture that, at a given pressure and temperature, has a higher speed of sound than air (He/H2 mixtures have a speed of sound that is approximately 3× that of air, or more) and/or has a higher heat absorption rate from a heated barrel than air. A light gas may also or alternatively be a gas or gas mixture chosen so as to be non-reactive with a barrel material (e.g., a gas or gas mixture containing no oxygen or only containing trace amounts of oxygen).

Figure 1:
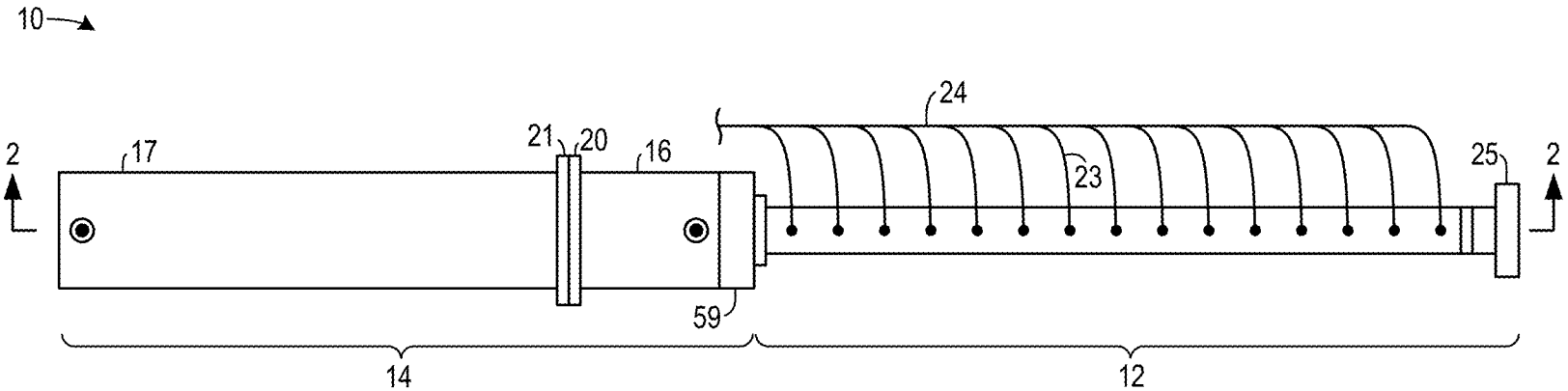
FIG. 1 is a top view of an example gun comprising a heatable barrel.

FIG. 1 is a partially schematic top view of an example gun 10 that may comprise a heatable barrel. For convenience, structures similar to those found in conventional guns have been omitted from FIG. 1 and from other drawing figures. For example, and like conventional guns, the gun 10 may include a support structure that maintains the gun 10 in a desired orientation and that may be used to move the gun 10 to a desired firing orientation. That support structure may include components that are hydraulically or otherwise actuated to traverse the gun 10 by rotating the gun 10 in a horizontal plane to align with a target. That support structure may also or alternatively include components that are hydraulically or otherwise actuated to elevate the gun 10 by rotating the gun 10 in a vertical plane to obtain a desired launch trajectory for a projectile.

The gun 10 may include a barrel 12 and a launcher 14. The launcher 14 may include a forward section 16 that includes a breach and a portion of a compression chamber and a rear section 17 that includes another portion of the compression chamber. The breach and the compression chamber, as well as other elements of the launcher 14, are described below. The forward section 16 and the rear section 17 may include flanges 20 and 21 that may be pushed together to seal the compression chamber and separated to permit access to the breach. Hydraulic rams, not shown, may be positioned around the circumferences of the flanges 20 and 21 to open and close the launcher 14.

The barrel 12 may include one or more heating elements along its length. Those elements may be ohmic, inductive, and/or other type heating elements that are electrically powered via cables 23. The cables 23 from the individual heating elements may join a wiring harness 24 that connects the heaters to an electrical power source (not shown). A rear shutter assembly 59 may separate the barrel 12 from the launcher 14. A front shutter assembly 25 may be positioned at the muzzle of the barrel 12.

Figure 2:
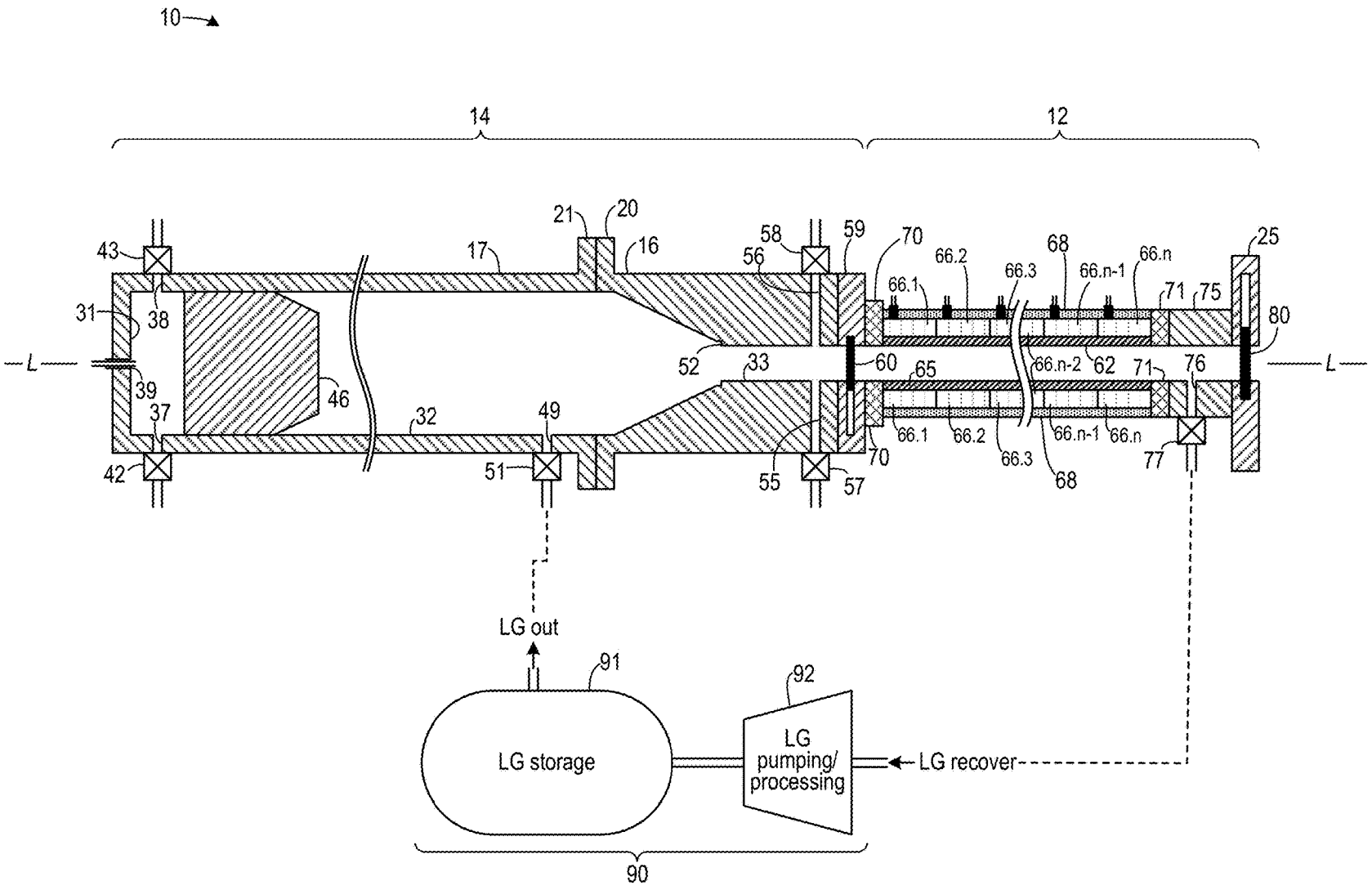
FIG. 2 is a partially schematic area cross-sectional view of the gun of FIG. 1.

FIG. 2 is a partially schematic area cross-sectional view of the gun 10 from the sectioning plane indicated in FIG. 1. Although none of the drawings are to scale, double compound curves are used in FIG. 2 and in other figures to indicate elements that may be substantially longer than is suggested in a drawing figure. Single compound curves may be used to indicate that an element extends further than may be shown. Cross-hatching is also used in the figures to distinguish between various elements. The types of cross-hatching used are not intended to indicate specific materials, and drawing elements shown with the same type of cross-hatching are not necessarily formed from the same material.

Shown in FIG. 2 are a combustion chamber 31, a compression chamber 32, and a breach 33 of the launcher 14. The combustion chamber 31 may include a fuel/air inlet port 37, an exhaust port 38, and an ignition port 39. A valve 42 may be openable to allow flow of a fuel/air mixture into the chamber 31 through the port 37 and closable to prevent flow in or out of the chamber 31 through the port 37. In FIG. 2 and subsequent drawing figures, an "X" is used to indicate a closed valve and an arrow (pointing in a flow direction) is used to indicate an open valve. A valve 43 may be openable to allow flow of exhaust out of the chamber 31 through the port 38 and closable to prevent flow in or out of the chamber 31 through the port 38. A spark plug or other type of igniter may seal the port 39 and may be connected to an electrical power source, external to the gun 10, by cables (not shown).

A piston 46 may separate the combustion chamber 31 from the compression chamber 32. The piston 46 may be moveable along the interior surface of the rear section 17. A gas-tight seal may be formed between the piston 46 and the inner wall of the rear section 17 so that an increase in gas pressure in the combustion chamber 31 pushes the piston forward into the compression chamber 32. An outer surface of the piston 46 may include compression rings and/or other types sliding seals between the piston 46 and the inner wall of the rear section 16.

As indicated above, the rear section 17 and the front section 16 may be joined together at the flanges 21 and 20 to close and seal the compression chamber 32. High temperature gaskets, metal-to-metal seals, and/or other components may be included between the flanges 21 and 20 to form a gas-tight seal.

The compression chamber 32 may include a port 49. A valve 51 may be openable to allow flow of a light gas (LG) into the chamber 32 through the port 49 and closable to prevent flow in or out of the chamber 32 through the port 49. A forward portion of the compression chamber 32 may taper to form an entrance to the breach 33. The interface between the chamber 32 and the breach 33 may include a lip 52 configured to hold a shear plate, as described below. The breach 33 may include ports 55 and 56. A valve 57 may be openable to allow flow of a purge gas into the breach 33 through the port 55 and closable to prevent flow in or out of the breach 33 through the port 55. A valve 58 may be openable to allow flow of a purge gas out of the breach 33 through the port 56 and closable to prevent flow in or out of the breach 33 through the port 56.

The launcher may include a rear shutter assembly 59 that includes a rear shutter 60. The rear shutter 60 may have a closed position, shown in FIG. 2, that prevents flow of gas between the breach 33 and a bore 62 of the barrel 12. As shown in subsequent figures, the rear shutter 60 may further have an open position that allows a projectile and gases to freely travel from the breach 33 into the bore 62. A hydraulic actuator, not shown, or other type of actuator may be used to open and close the rear shutter 60.

The barrel 12 may include an inner barrel that comprises a sleeve 65 in which the bore 62 is formed. The sleeve 65, including the surface of the bore 62, may be formed from one or more tungsten alloys. An inner barrel sleeve may also or alternatively formed from one or more other materials. As but one example, an inner barrel may be formed from steel. The barrel 12 may further include multiple heaters 66.1 through **66.*n* positioned along the length of the barrel 12. For convenience, heaters 66.1 through 66.*n* may be referred to collectively or generically as the heaters 66. Each of the heaters 66 may be an annular heating element that may be individually controllable. By varying the heat output of individual heaters 66, a desired temperature gradient may be generated along the barrel 12. For example, and as described in more detail below, one or more heaters at the rear end of the barrel 12 may be set (e.g., by adjusting power input) to output less heat than one or more heaters at the front end of the barrel 12**.

Insulation 68 may surround the heaters 66 to retain heat. As explained in more detail below, the heaters 66 may be used to heat some or all of the barrel 12 to extremely high temperatures (e.g., 2200° K or higher). To prevent damage to other elements in the gun from the high temperatures of the barrel 12, a rear insulator 70 may separate the heated portions of the barrel 12 from the launcher 14. A front insulator 71 may separate the heated portions of barrel 12 from elements in the muzzle of the barrel 12. Examples of materials that may be used for the insulators 70 and 71 and for the insulation 68 include, without limitation, thorium dioxide and other ultra-high temperature ceramics (e.g., hafnium diboride, zirconium diboride, hafnium nitride, zirconium nitride, titanium carbide, titanium nitride, tantalum carbide, as well as combinations and/or composites comprising one or more of those compounds). Additional reinforcement may be included, e.g., titanium bands surrounding the insulators 70 and/or 71.

The elements at the front end of the barrel 12 may include a propellant recovery manifold 75 and the front shutter assembly 25. The recovery manifold 75 may include a port 76 through which expanding propellant may flow to a propellant recovery and supply system 90, as described below. A valve 77 may be openable to allow flow of propellant out of the manifold 75 through the port 76 and closable to prevent flow in or out of the manifold 75 through the port 76. The front shutter assembly 25 may be located forward of the recovery manifold 75 and may include a front shutter 80. The front shutter 80 may have a closed position, shown in FIG. 2, that prevents flow of gas between the bore 62 and the environment external to the gun 10. As shown in subsequent figures, the front shutter 80 may further have an open position that allows a projectile to exit the barrel 12. A hydraulic actuator, not shown, or other type of actuator may be used to open and close the front shutter 80.

Internal surfaces of the combustion chamber 31, the compression chamber 32, the breach 33, and the bore 62 may be circular in planes perpendicular to the longitudinal axis L of the gun 10 and to the view of FIG. 2. Similarly, the internal surfaces of rear shutter assembly 59, the insulator 70, the bore 62, the insulator 71, the manifold 75, and the front shutter assembly 25 may be circular in planes perpendicular to the longitudinal axis L of the gun 10 and to the view of FIG. 2. The rear shutter assembly 59 and/or the front shutter assembly 25 may also include insulation and/or may be formed from titanium and/or other material that may have relatively poor thermal conductivity but which may be able to withstand pressures and temperatures at the ends of the barrel 12.

The gun 10 may also include a propellant recovery and supply system 90. The propellant may be a light gas. The system 90 may include one or more storage tanks 91 to hold a supply of propellant. The propellant in the tank(s) 91 may be pressurized. As shown with broken lines, an outlet of the tank(s) 91 may be connected by high pressure gas lines to the valve 51. The system 90 may also include a propellant pumping/processing subsystem 92. An inlet of the subsystem 92 may be connected to the valve 77 and may recover propellant after firing of the gun 10. As shown with broken lines, the valve 77 may be connected to the subsystem 92 by high pressure gas lines. The subsystem 92 may include one or more filters to remove particles (e.g., pieces of a shear plate and/or other by-products of firing) from recovered propellant. The subsystem 92 may also or alternatively include one or more gas separators to remove other gases from recovered propellant. The gases removed from recovered propellant could include, e.g., remnants of purge gas and/or air drawn in through the muzzle of the barrel 12 as a projectile exits. One or more high pressure pumps of the subsystem 92 may then transfer the recovered and processed propellant to the tank(s) 91.

Figure 3A:
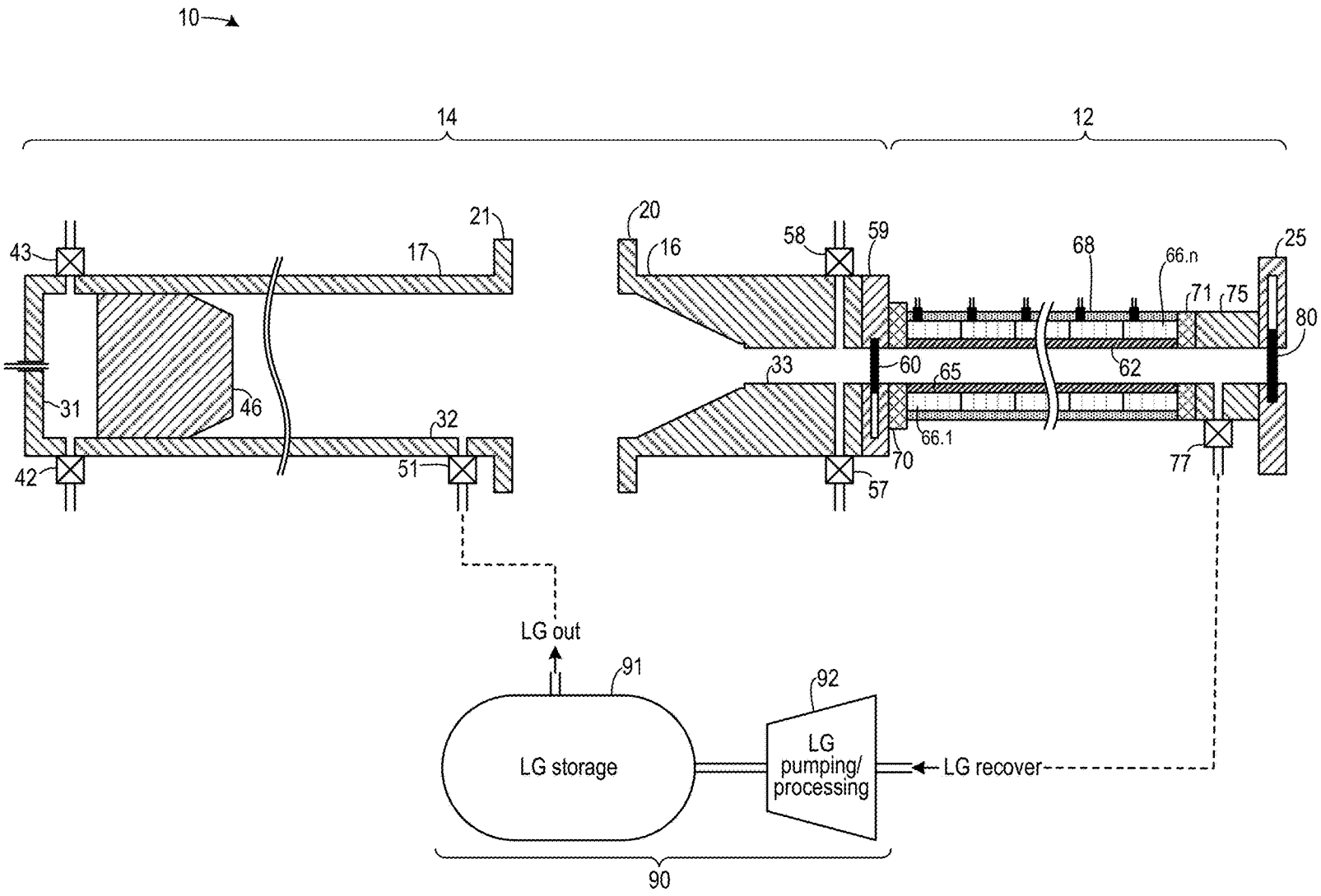
FIGS. 3A, 3B, 3C, 3D, 3E, 3F, and 3G are partially schematic area cross-sectional views showing operations in a firing sequence of the gun of FIG. 1.

FIGS. 3A through 3G show operations in a firing sequence of the gun 10. Each of FIGS. 3A through 3G is a partially schematic area cross-sectional view from the same sectioning plane used to obtain FIG. 2. FIG. 3A shows the gun 10 at a time T0 after the launcher 14 has been opened by separating the flanges 20 and 21. The valves 42, 43, 51, 57, 58, and 77, as well as the rear shutter 60 and the front shutter 80, are closed. The heaters 66 may be activated and the inner sleeve 65 of the barrel 12 may be heated to, or near, a desired temperature for firing.

Figure 3B:
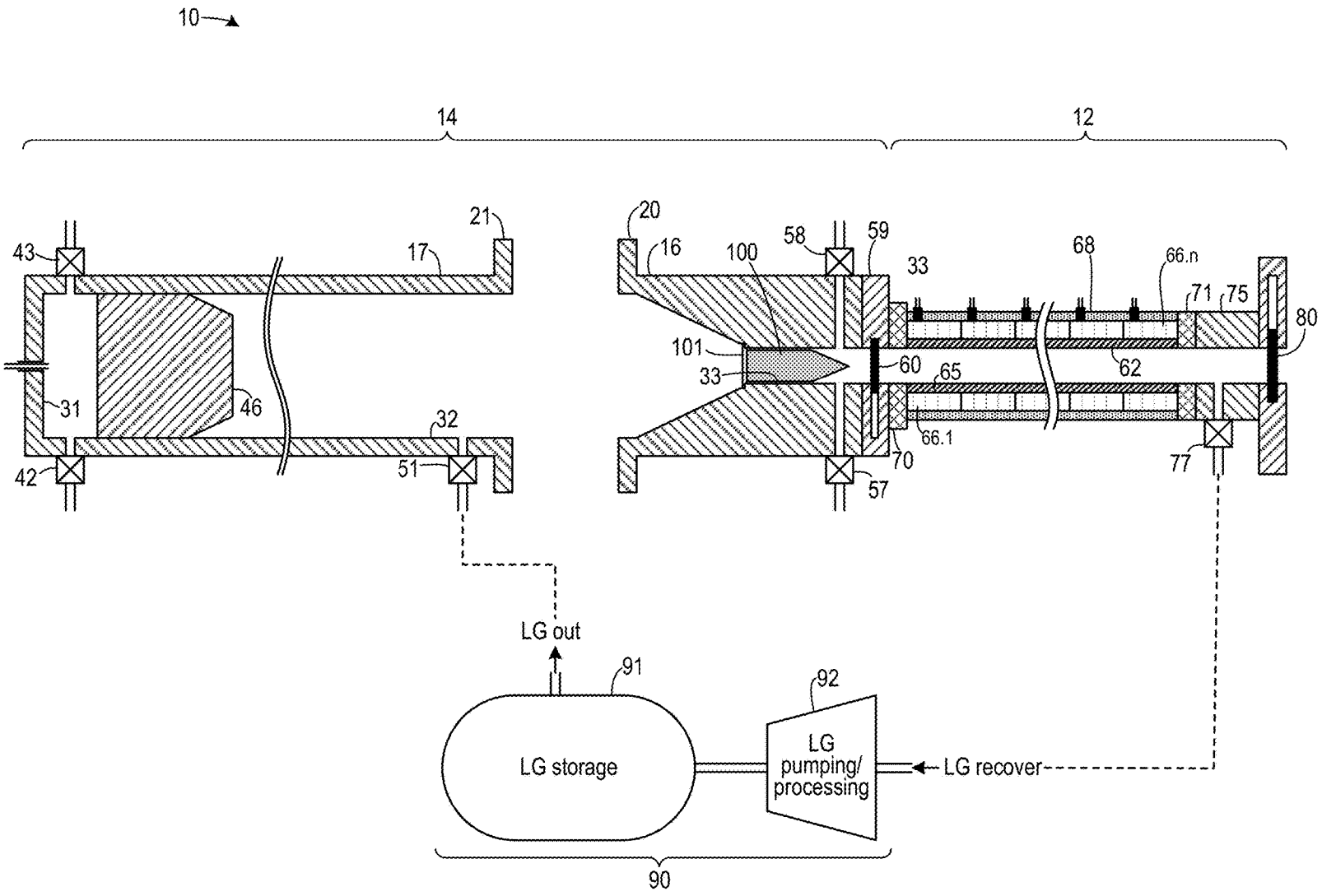

FIG. 3B shows the gun 10 at a time T1 after time T0. A projectile 100 has been placed into the breach 33. After placing the projectile 100 in the breach 33, a shear plate 101 is placed onto the rim 52 at the interface between the compression chamber 32 and the breach 33. Once placed as shown in FIG. 3B, the shear plate 101 may form a gas-tight seal between the compression chamber 32 and the breach 33.

Figure 3C:
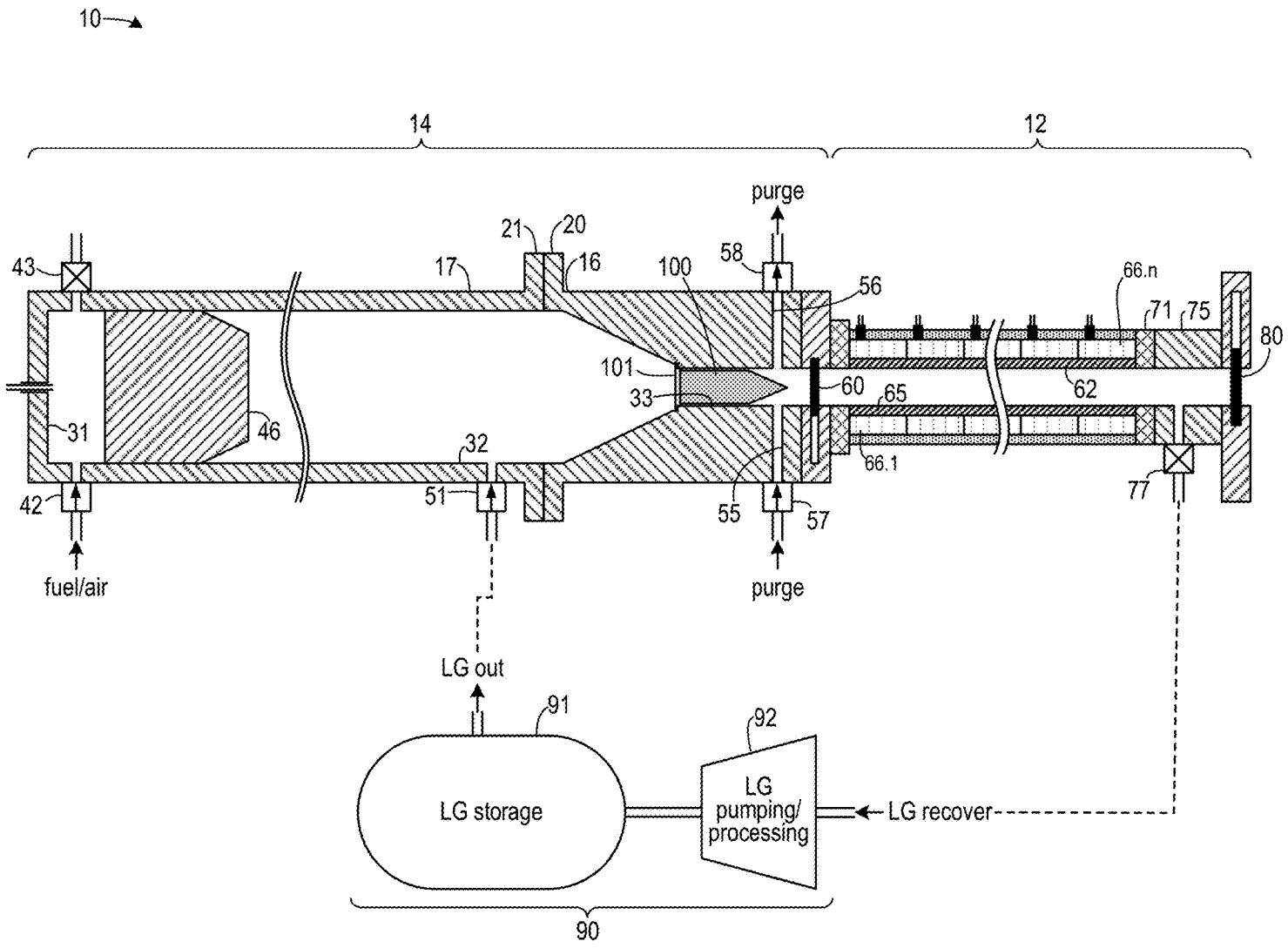

FIG. 3C shows the gun 10 at a time T2 after time T1. The launcher 14 has been closed by pressing together the flanges 20 and 21. The valve 51 is open, and propellant flows into the compression chamber 32, from the tank(s) 91, via the port 49. The valve 42 is open, and a fuel/air mixture flows into the combustion chamber 31, via the port 37. The fuel/air mixture may be supplied to the valve 42 from a source, not shown, external to the gun 10.

As also shown in FIG. 3C, the valves 57 and 58 are also open. A purge gas is supplied to the valve 57 from a source, not shown, external to the gun 10. The purge gas may include one or more inert gases such as helium, neon, and/or argon. When the valves 57 and 58 are open, the purge gas may fill the breach 33 and flush air from the breach 33. Air may be flushed from the breach 33 so that oxygen and/or other reactive gases are prevented from entering the heated bore 62 of the barrel 12.

Figure 3D:
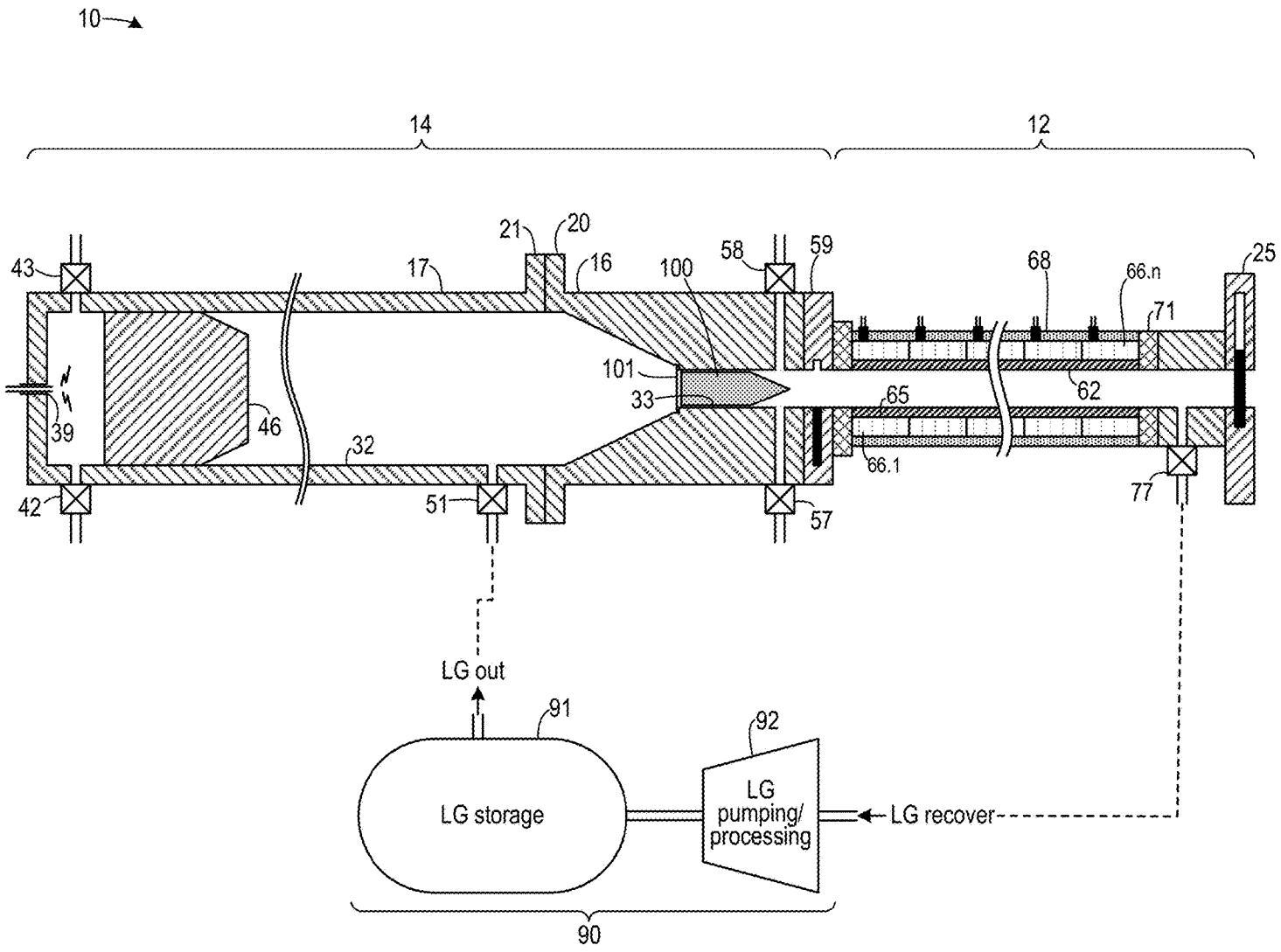

FIG. 3D shows the gun 10 at a time T3 after time T2. Between times T2 and T3, the valves 42, 51, 57, and 58 were closed, and the rear shutter 60 was opened. At time T3, the igniter in the ignition port 39 is activated, creating a spark that ignites the fuel/air mixture in the combustion chamber 31. The burning of the fuel/air mixture in the combustion chamber 31 creates a pressure increase that pushes against the rear side of the piston 46 to drive the piston 46 forward into the compression chamber 32.

Figure 3E:
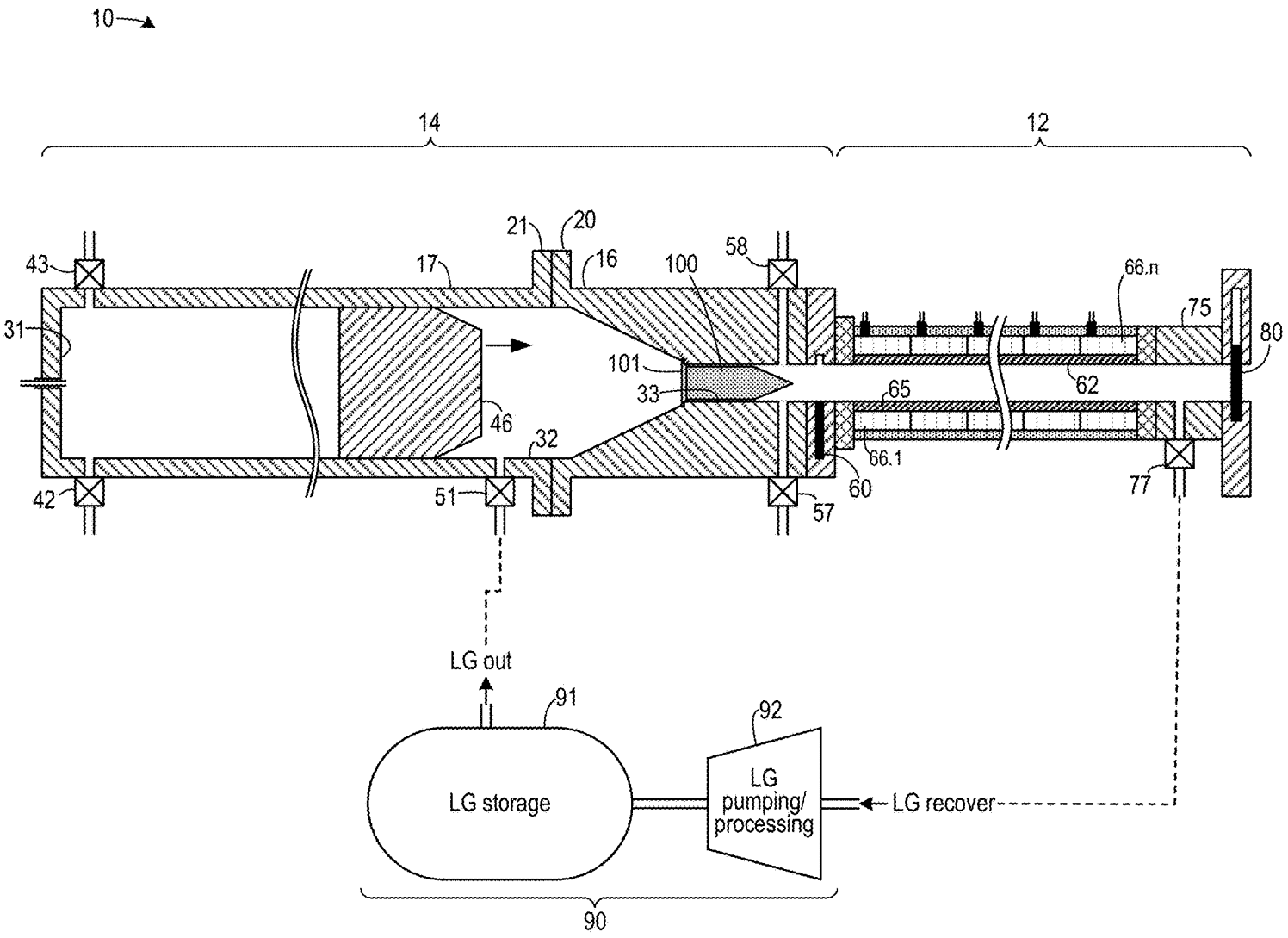
Figure 3F:
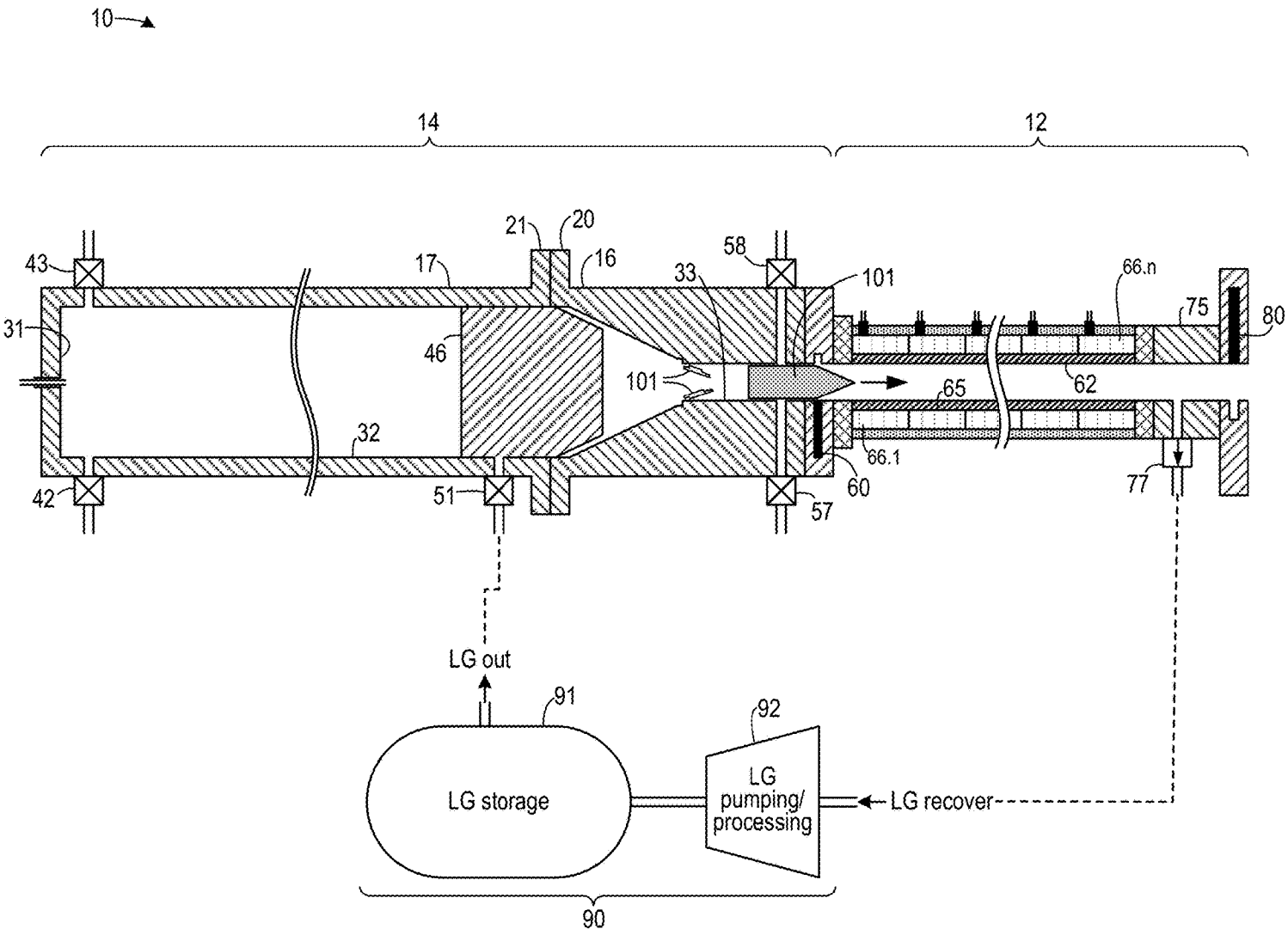

FIG. 3E shows the gun 10 at a time T4 after time T3. The expanding gases in the combustion chamber 31 continue to drive the piston 46 into the compression chamber 32, thereby further compressing the propellant previously placed into the chamber 32. The pressure in compression chamber 32 continues to increase until the yield strength of the shear plate 101 is overcome. The shear plate 101 may be a shearing diaphragm scored so as to break at a precise pressure. Example materials for such a shearing diaphragm may include copper or nylon. FIG. 3F shows the gun 10 at a time T5, after time T4, when the shear plate 101 has shattered or otherwise given way and the compressed propellant in the compression chamber 32 has begun expanding into the breach 33. The front shutter 80 and the valve 77 have been opened. The gun may include one or more sensors, not shown, that detect when the piston 46 reaches a position in the compression chamber 32 that corresponds to a pressure calculated to break the shear plate 101. The sensors, upon detecting the piston 46 has reached that position, may output signals that cause actuators to open the shutter 80 and the valve 77.

As the compressed propellant in the compression chamber 32 expands into the breach 33, the projectile 100 is pushed forward through the breach 33, and into and through the heated bore 62 of the barrel 12. As the projectile 100 moves through the bore 62, heat from the bore 62 is transferred to the expanding propellant behind the projectile 100. This transfer of heat into the propellant may reduce the loss in pressure that would otherwise result from the increasing volume behind the projectile 100 as it travels along the bore 62. This reduction in propellant pressure loss results in the force pushing the projectile 100 being maintained for a longer period of time and/or at a higher level, thereby increasing the acceleration of the projectile 100.

Figure 3G:
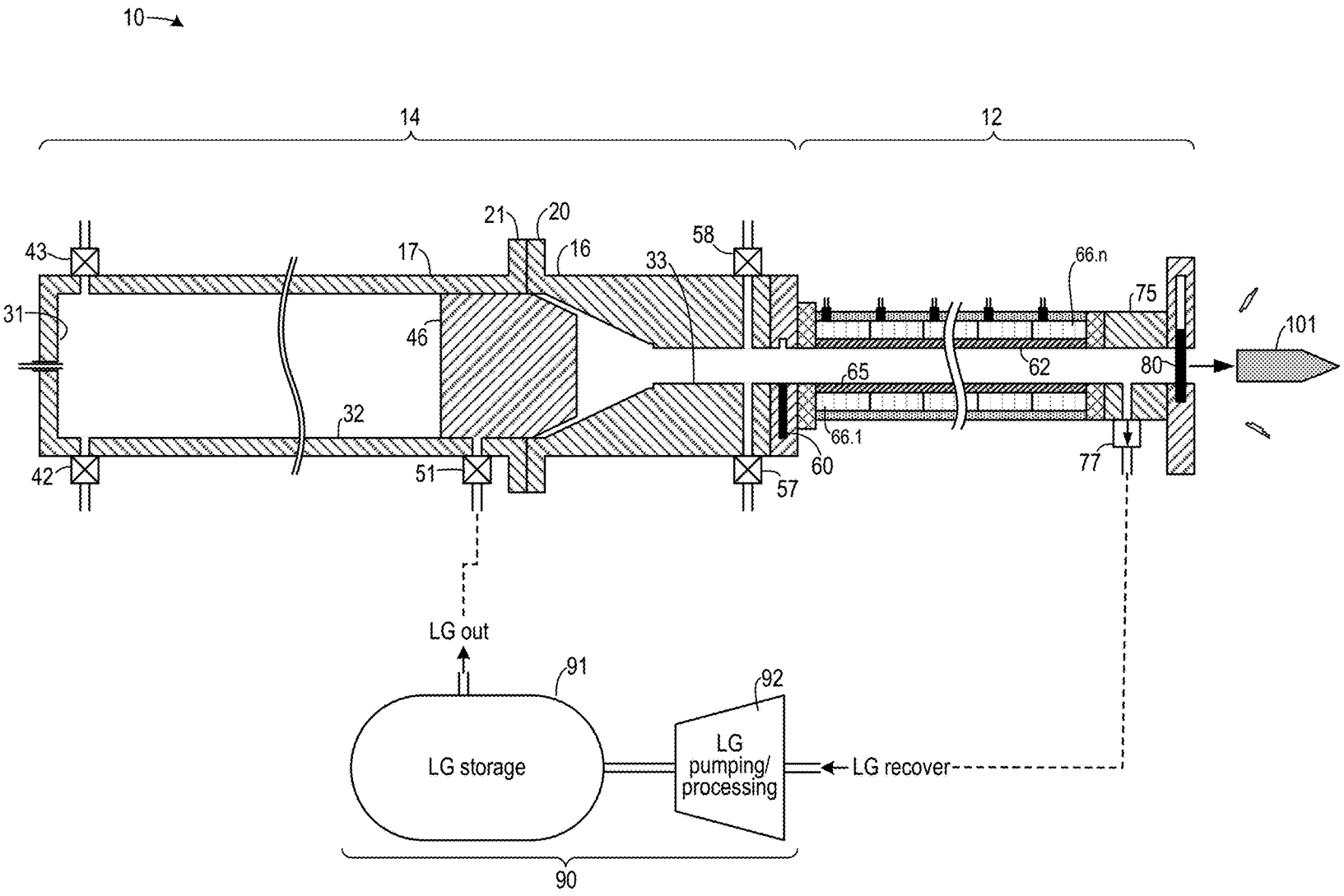

FIG. 3G shows the gun 10 at a time T6 after time T5. At time T6, which is very soon after the projectile 100 and the remnants of the shear plate 101 have left the gun 10, the front shutter 80 is closed to prevent ambient air from entering the heated bore 62 of the barrel 12. In this way, erosion of the bore 62 from reaction with oxygen can be slowed, and loss of propellant reduced. One or more sensors, not shown, may be positioned to detect the exit of the projectile 100 from the barrel 12 and to signal an actuator to close the front shutter 80. The valve 77 may be left open for a short period of time after the closing of the shutter 80, thereby allowing propellant to exit the barrel 12 via the port 76 and be recovered at the input to the subsystem 92. The valve 77 and the rear shutter 60 may subsequently be closed. The piston 46 may be returned to the position shown in FIGS. 2 and 3A. While returning the piston 46 to that position, the valve 43 may be opened so that exhaust gases can exit the combustion chamber 31 via the port 38.

Figure 4:
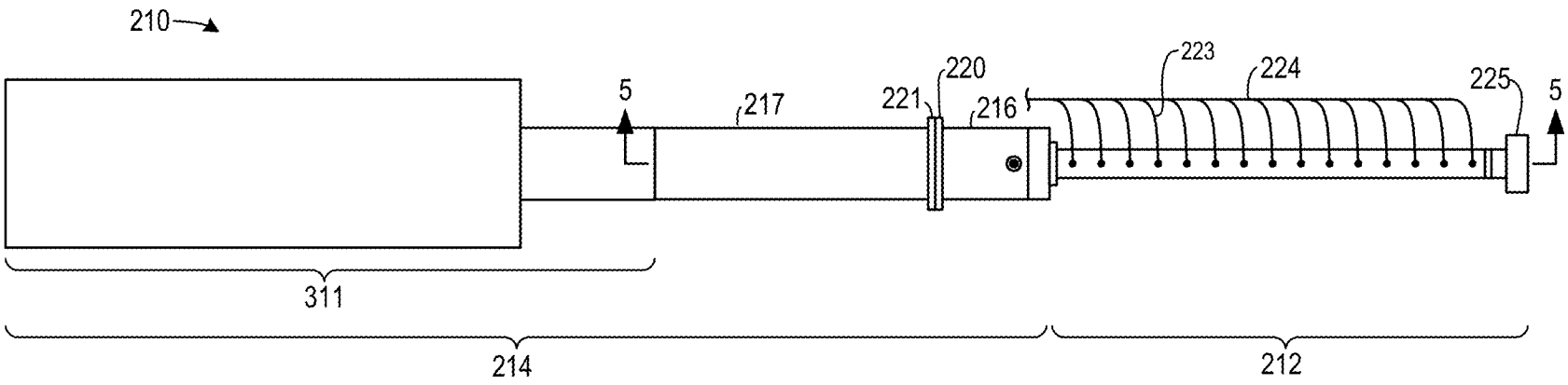
FIG. 4 is a top view of an example gun comprising a heatable barrel.

FIG. 4 is a partially schematic top view of another example gun 210 that may comprise a heatable barrel. As with the gun 10 in FIG. 1, structures similar to those found in conventional guns have been omitted from FIG. 4 and from other drawing figures. Except in connection with how propellant is compressed, the gun 210 is similar to the gun 10. Unlike the launcher 14, however, a launcher 214 of the gun 210 includes a railgun 311 that is used instead of a combustion chamber to force a piston into a compression chamber. The railgun 311 may be connected to a power source via cables, not shown. The railgun 311 may also include a cooling system and/or other components, also not shown, found in railguns used for other purposes.

The gun 210 may include a barrel 212 that is similar to the barrel 12, and a launcher 214 that includes a forward section 216 and a rear section 217. The sections 216 and 217 may be similar to the sections 16 and 17 described in connection with the gun 10, except that the rear of the rear section 217 may be modified to accommodate the railgun 311. Flanges 220 and 221 may be pushed together to seal a compression chamber and separated to permit access to a breach. Hydraulic rams, not shown, may be positioned around the circumferences of the flanges 220 and 221 to open and close the launcher 214.

Figure 5:
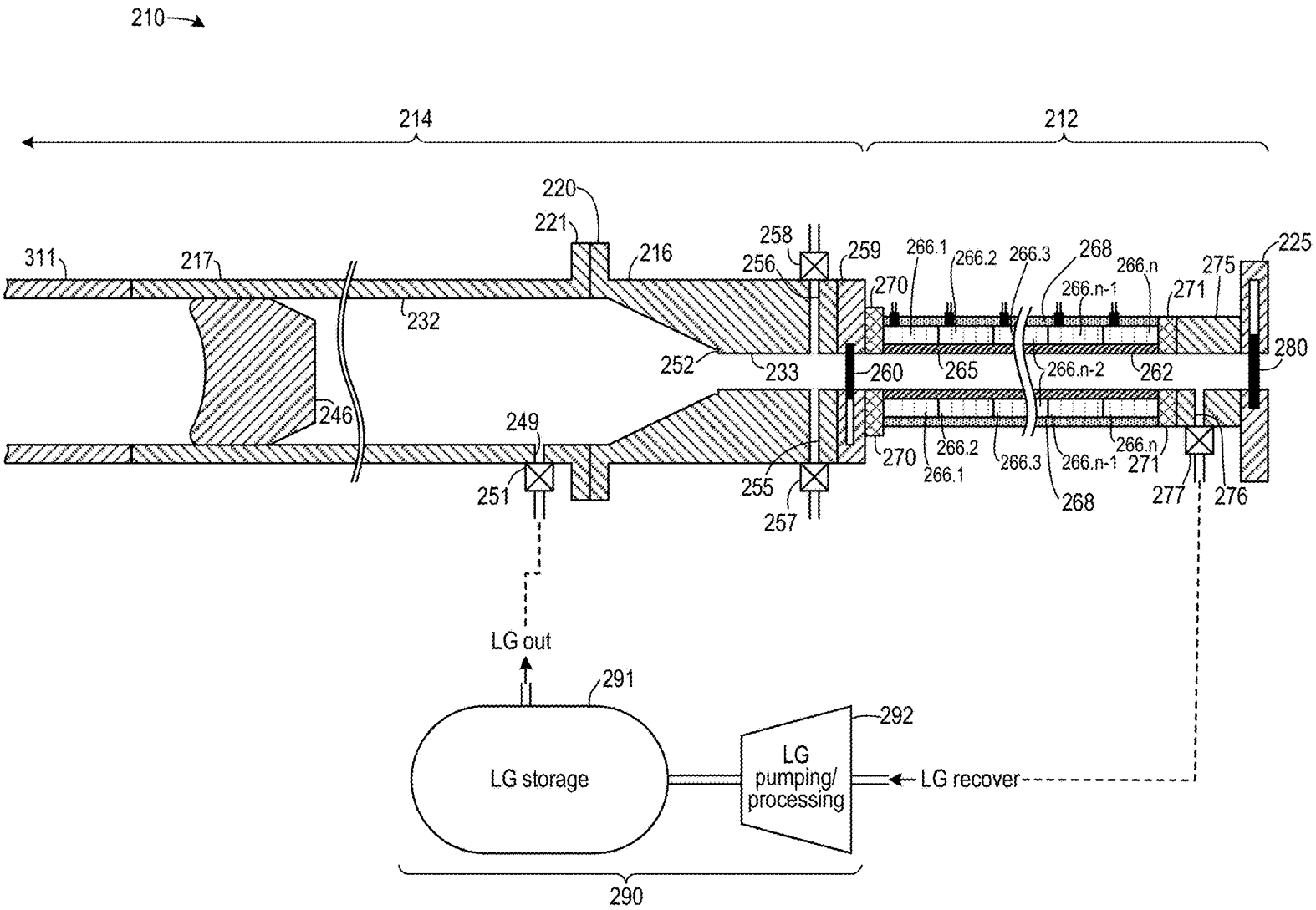
FIG. 5 is a partially schematic area cross-sectional view of the gun of FIG. 4.

FIG. 5 is a partially schematic area cross-sectional view of the gun 210 from the sectioning plane indicated in FIG. 4. The gun 210 includes a piston 246 that, except as discussed below, is similar to the piston 46 of the gun 10. Forward of the piston 246, the gun 210 is substantially similar to the gun 10. Each row of Table 1 indicates one or more elements of the gun 10 that may be structurally similar to, and that may operate in a similar manner as, one or more corresponding elements of the gun 210.

TABLE 1

| Gun 10 Element(s) | Gun 210 Element(s) |
|---|---|
| barrel 12 | barrel 212 |
| forward section 16 | forward section 216 |
| rear section 17 | rear section 217 |
| flanges 20 and 21 | flanges 220 and 221 |
| cables 23 | cables 223 |
| wiring harness 24 | wiring harness 224 |
| front shutter assembly 25 | front shutter assembly 225 |

TABLE 1-continued

| Gun 10 Element(s) | Gun 210 Element(s) |
|---|---|
| compression chamber 32 | compression chamber 232 |
| breach 33 | breach 233 |
| piston 46 | piston 246 |
| port 49 | port 249 |
| valve 51 | valve 251 |
| lip 52 | lip 252 |
| valve 53 | valve 253 |
| ports 55 and 56 | ports 255 and 256 |
| valve 56 | valve 256 |
| rear shutter assembly 59 | rear shutter assembly 259 |
| rear shutter 60 | rear shutter 260 |
| bore 62 | bore 262 |
| inner sleeve 65 | inner sleeve 265 |
| heaters 66.1 through 66.n | heaters 266.1 through 266.n |
| insulation 68 | insulation 268 |
| insulator 70 | insulator 270 |
| insulator 71 | insulator 271 |
| propellant recovery manifold 75 | propellant recovery manifold 275 |
| port 76 | port 276 |
| valve 77 | valve 277 |
| front shutter 80 | front shutter 280 |
| propellant recovery and supply system 90 | propellant recovery and supply system 290 |
| storage tank(s) 91 | storage tank(s) 291 |
| propellant pumping/processing subsystem 92 | propellant pumping/processing subsystem 292 |
| projectile 100 | projectile 300 |
| shear plate 101 | shear plate 301 |

Figure 6A:
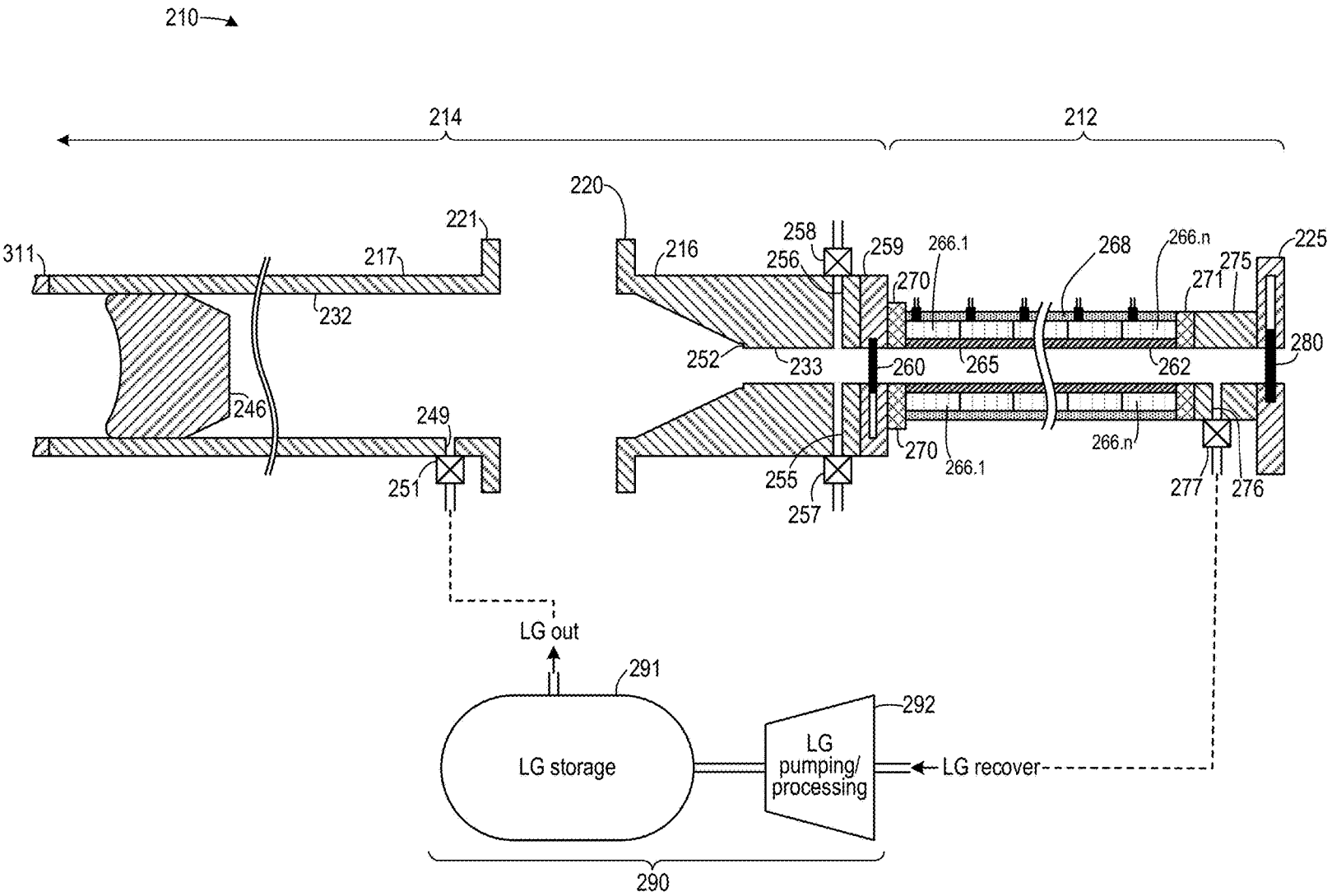
FIGS. 6A, 6B, 6C, 6D, 6E, 6F, and 6G are partially schematic area cross-sectional views showing operations in a firing sequence of the gun of FIG. 4.
Figure 6B:
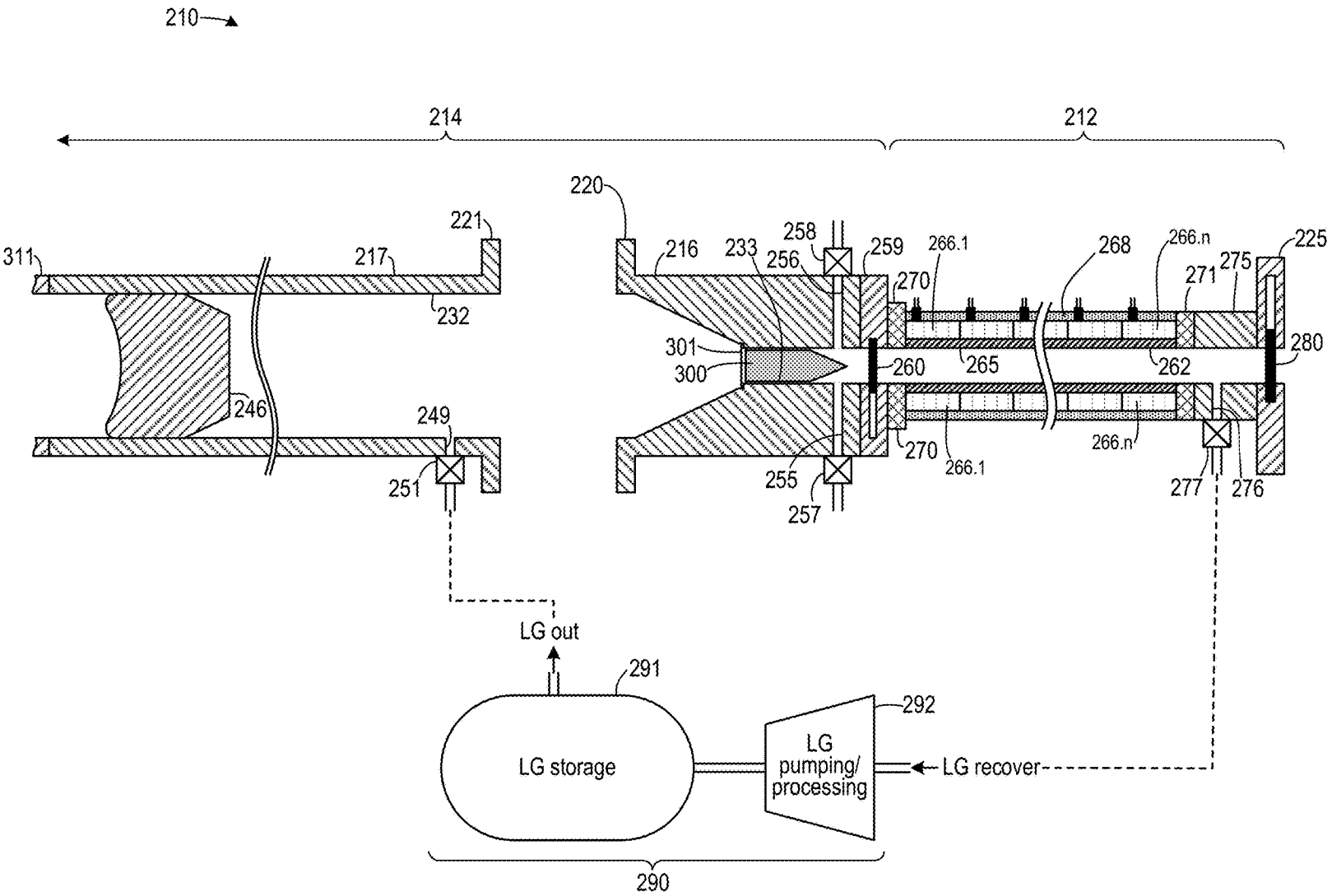
Figure 6C:
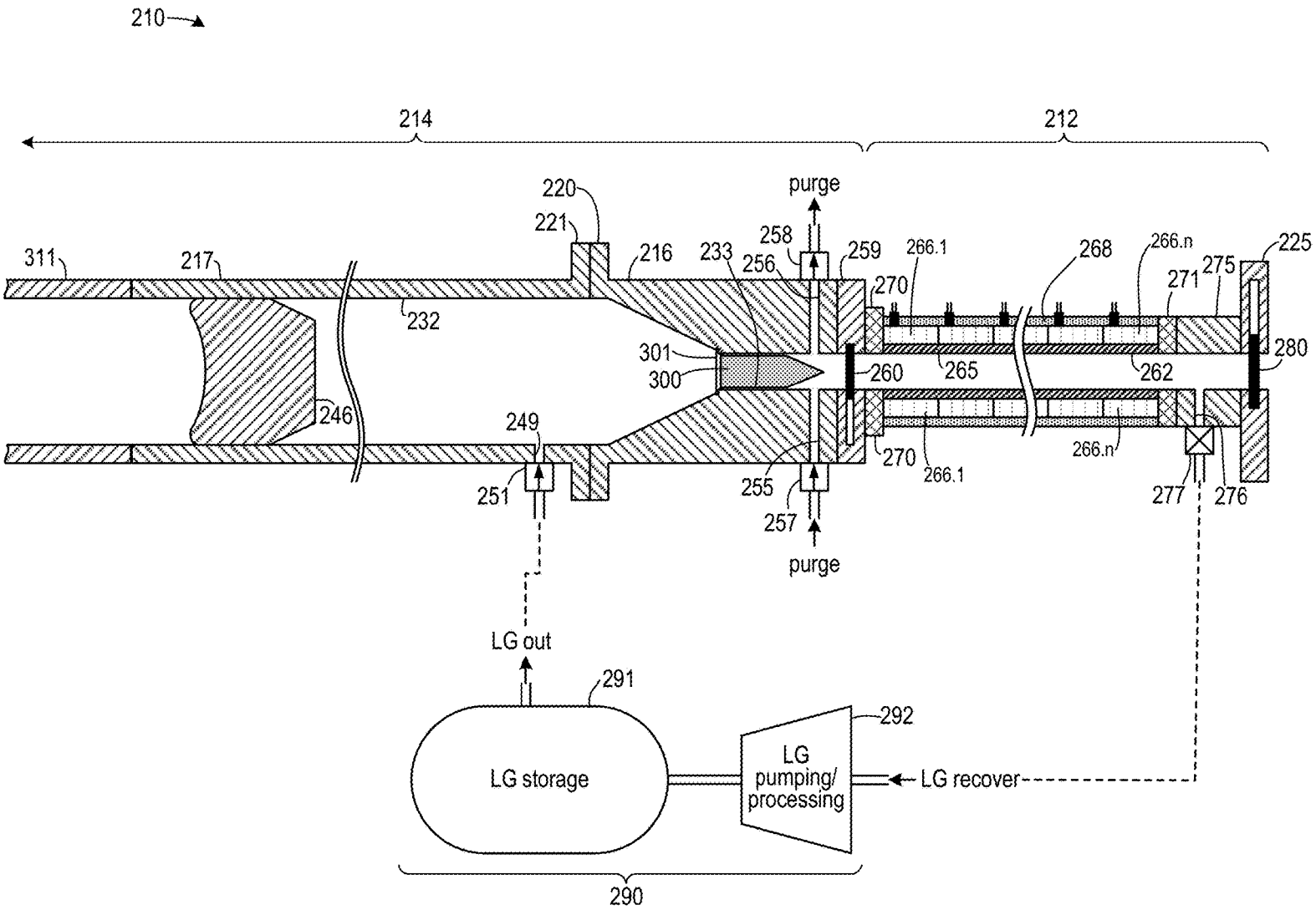
Figure 6D:
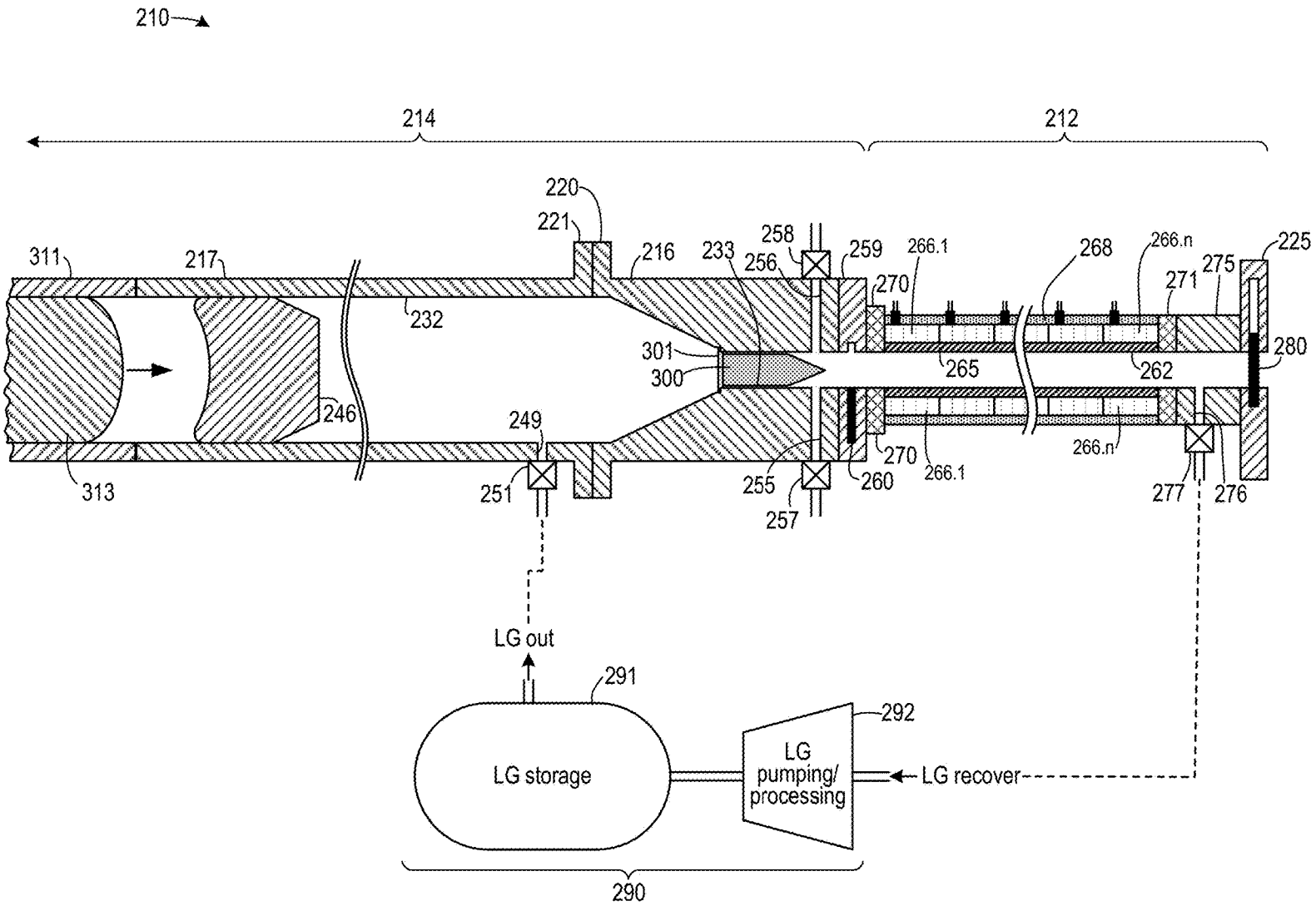

FIGS. 6A through 6G show operations in a firing sequence of the gun 210. Each of FIGS. 6A through 6G is a partially schematic area cross-sectional view from the same sectioning plane used to obtain FIG. 5. FIG. 6A shows the gun 210 at a time T20 after the launcher 214 has opened by separating the flanges 220 and 221. The valves 251, 257, 258, and 277, as well as the rear shutter 260 and the front shutter 280, are closed. The heaters 266 may be activated and the inner sleeve 265 of the barrel 212 may be heated to, or near, a desired temperature for firing. FIG. 6B shows the gun 210 at a time T21 after time T20. A projectile 300 has been placed into the breach 233 and a shear plate 301 placed onto the rim 252. FIG. 6C shows the gun 210 at a time T22 after time T21. The launcher 214 has been closed by pressing together the flanges 220 and 221. The valve 251 is open, and propellant flows into the compression chamber 232, from the tank(s) 291, via the port 249. The valves 257 and 258 are also open, allowing purge gas to fill the breach 233 and flush air from the breach 233. FIG. 6D shows the gun 210 at a time T23 after time T22. Between times T22 and T23, the valves 251, 257, and 258 were closed, and the rear shutter 260 was opened. At time T23, the railgun 311 is fired, driving an armature 313 toward a rear side of the piston 246. Only the front end of the armature 313 is shown. The rear side of the piston 246 and the front end of the armature 313 may have complementary shapes to keep the piston 246 and the armature 313 aligned and/or to reduce stresses on those components when they contact one another.

In a railgun, drive current is applied to a pair of rails. A conductive armature spans the rails and is driven along those rails by the resulting magnetic fields. Conventional rail guns use the armature to directly accelerate a projectile being fired from the railgun. In the railgun 311, however, the armature 313 is not used to directly push a projectile. Instead, the armature is used to push the piston 246 in order to compress the propellant in the compression chamber 232. The railgun 311 may thus be operated at less extreme power levels than may be needed to directly accelerate a projectile, thereby allowing the rails, the armature 313, and other components of the railgun 311 to have a longer service life than components used in conventional railguns.

Figure 6E:
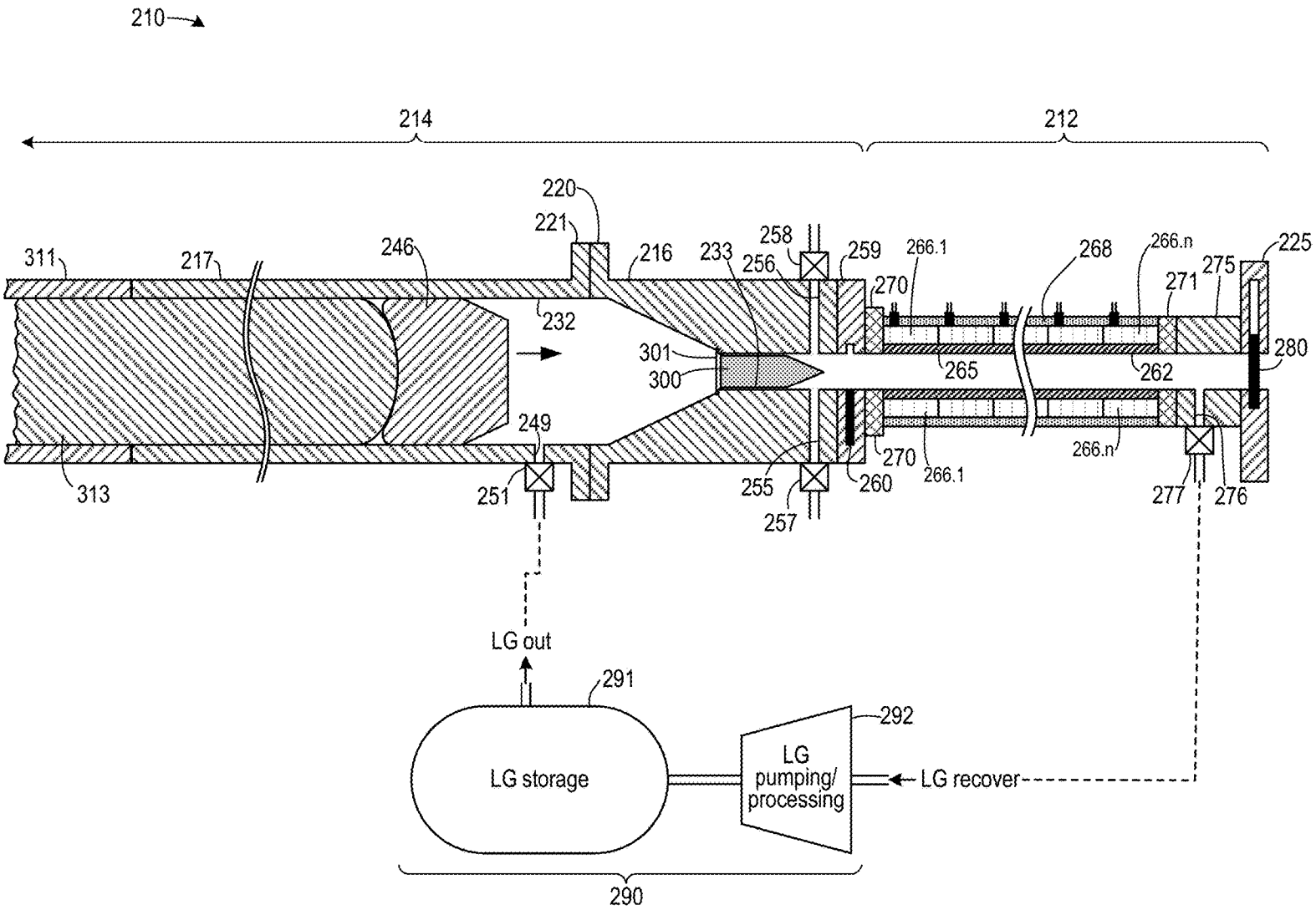
Figure 6F:
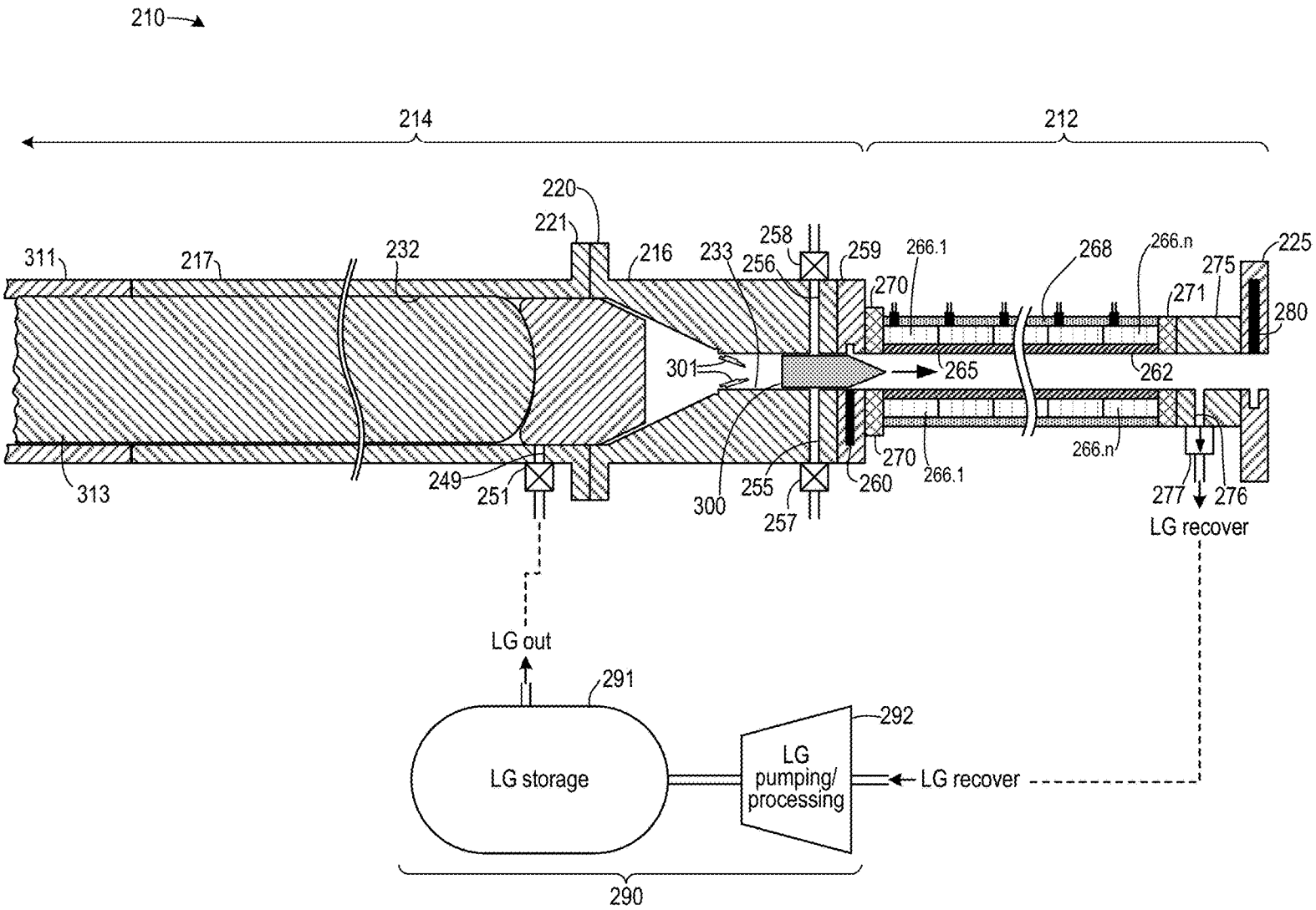
Figure 6G:
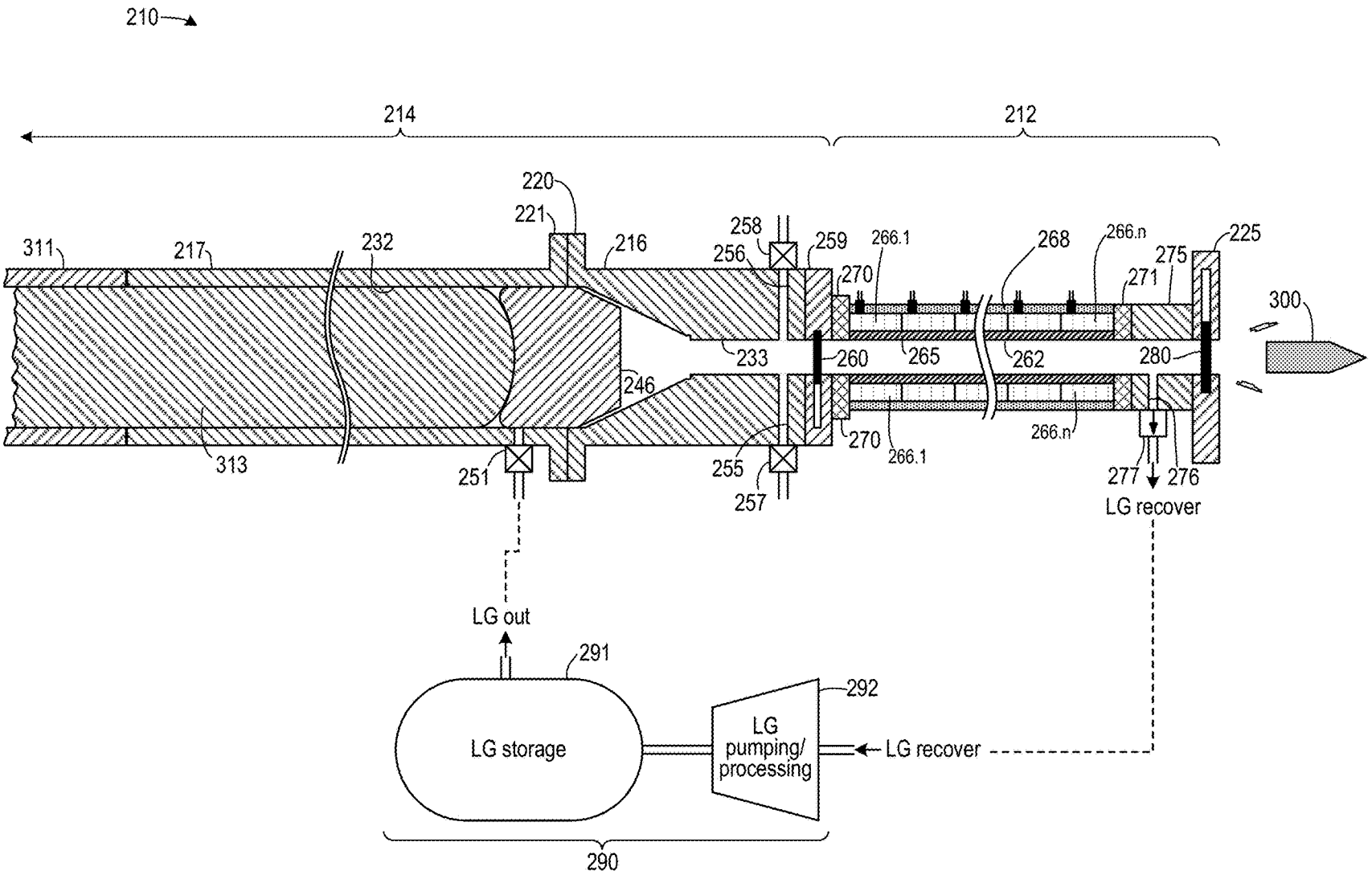
Figure 6H:
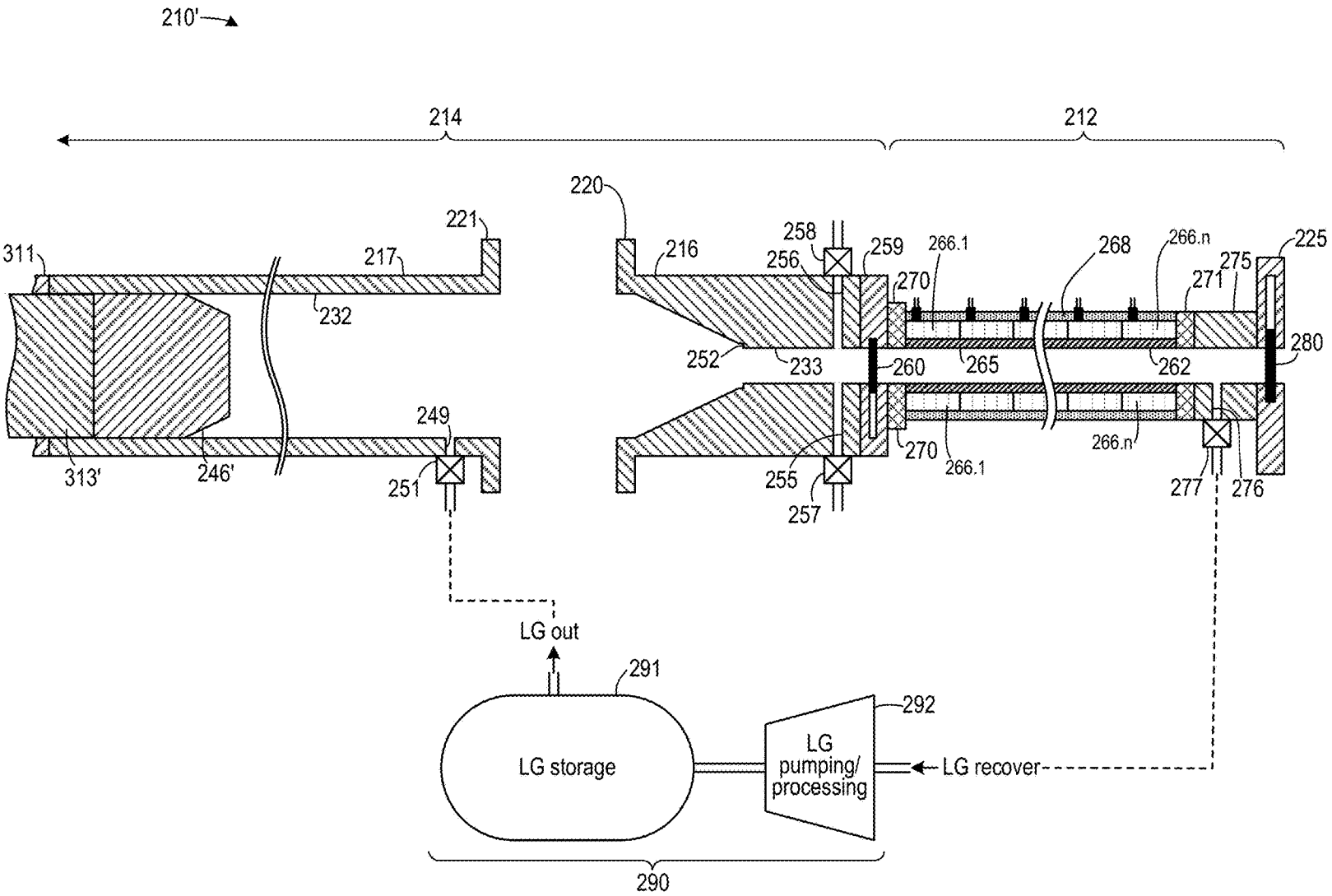
FIGS. 6H, 6I, 6J, 6K, 6L, 6M, and 6N are partially schematic area cross-sectional views showing operations in a firing sequence of a gun similar to the gun of FIG. 4.
Figure 6I:
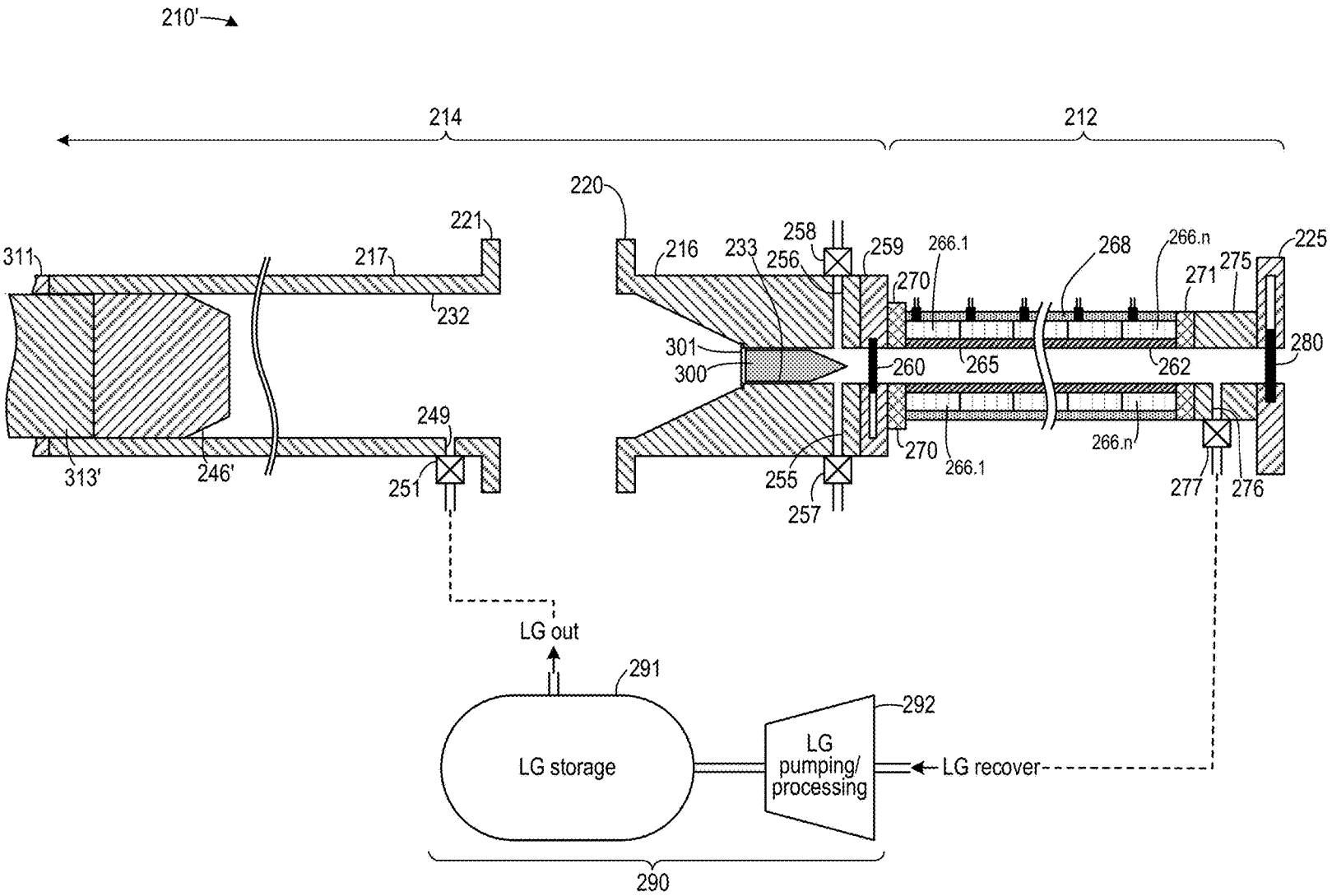
Figure 6J:
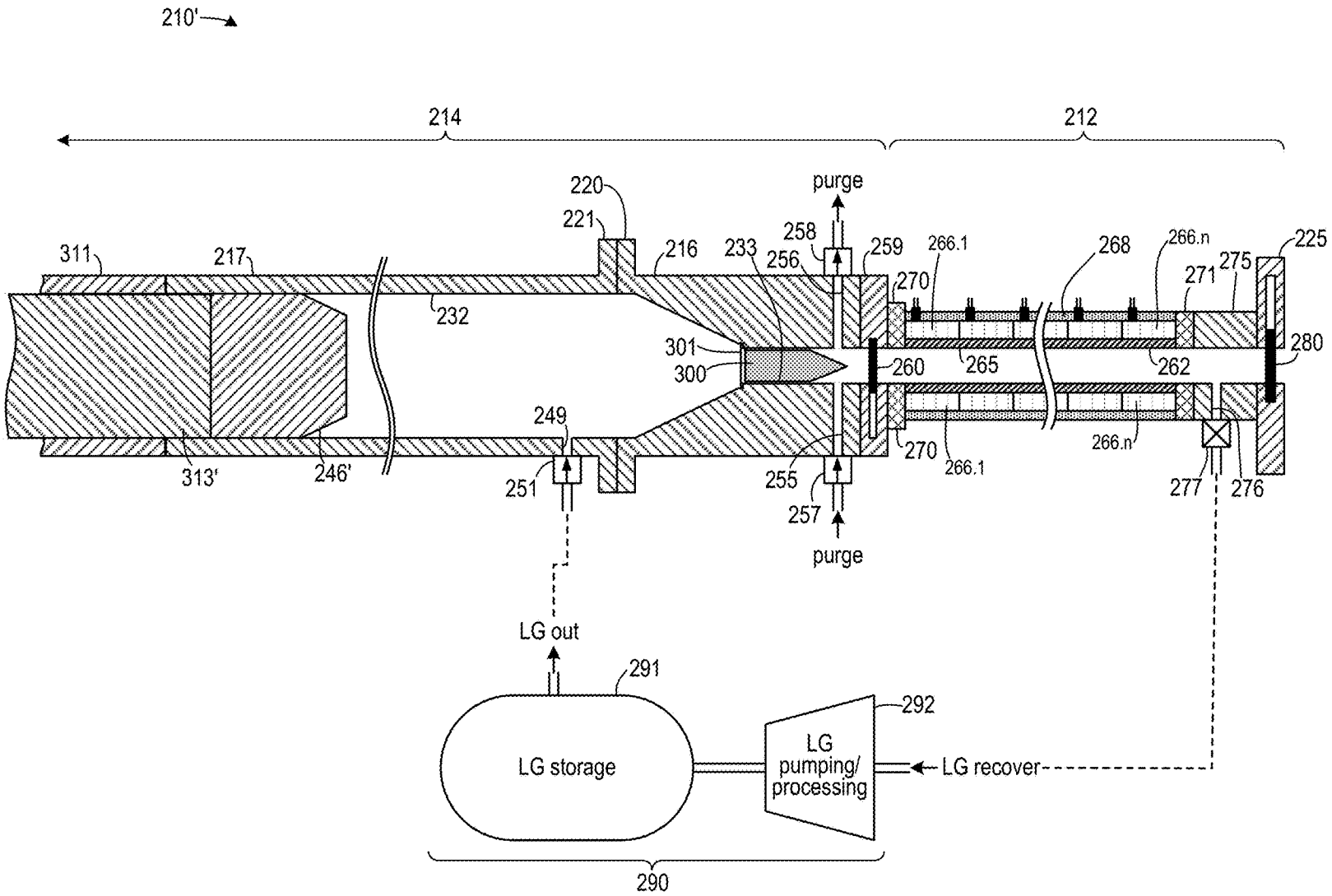

FIG. 6E shows the gun 210 at a time T24 after time T23. The armature 313 drives the piston 246 into the compression chamber 232, thereby compressing the propellant previously placed into the chamber 232. The pressure in compression chamber 232 continues to increase as the piston 246 moves forward. FIG. 6F shows the gun 210 at a time T25, after time T24, when the shear plate 301 has given way and the compressed propellant in the compression chamber 232 has begun expanding into the breach 233. The front shutter 280 and the valve 277 have been opened. FIG. 6G shows the gun 210 at a time T26 after time T25. At time T26, which is very soon after the projectile 300 and the remnants of the shear plate 301 have left the gun 210, the front shutter 280 is closed. The valve 277 may be left open for a short period of time after the closing of the shutter 280, thereby allowing propellant to exit the barrel 212 via the port 276 and be recovered at the input to the subsystem 292. The valve 277 and the rear shutter 260 may subsequently be closed. The piston 246 may be returned to the position shown in FIG. 3A and the armature 313 returned to its starting position in the railgun 311.

Figure 6K:
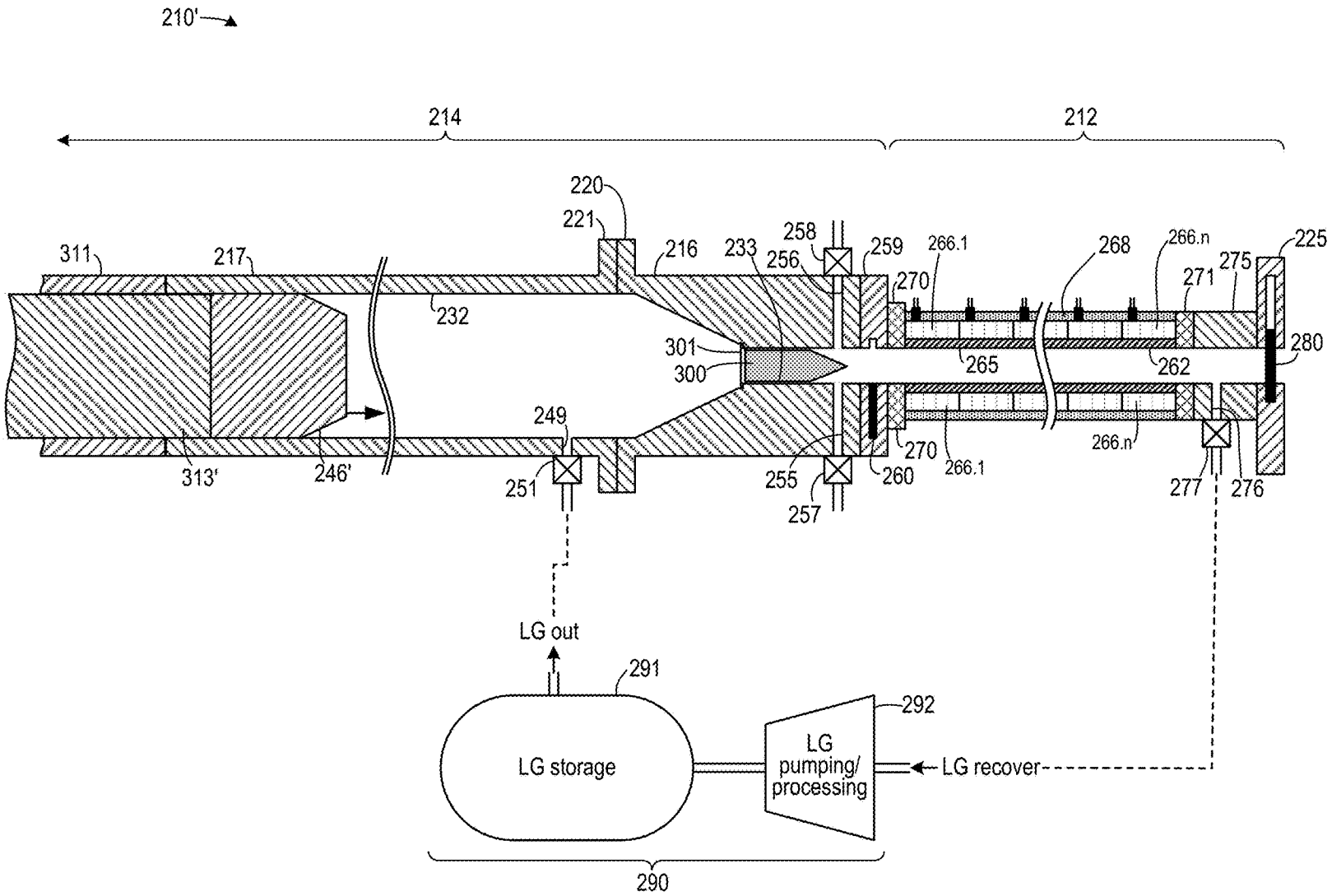
Figure 6L:
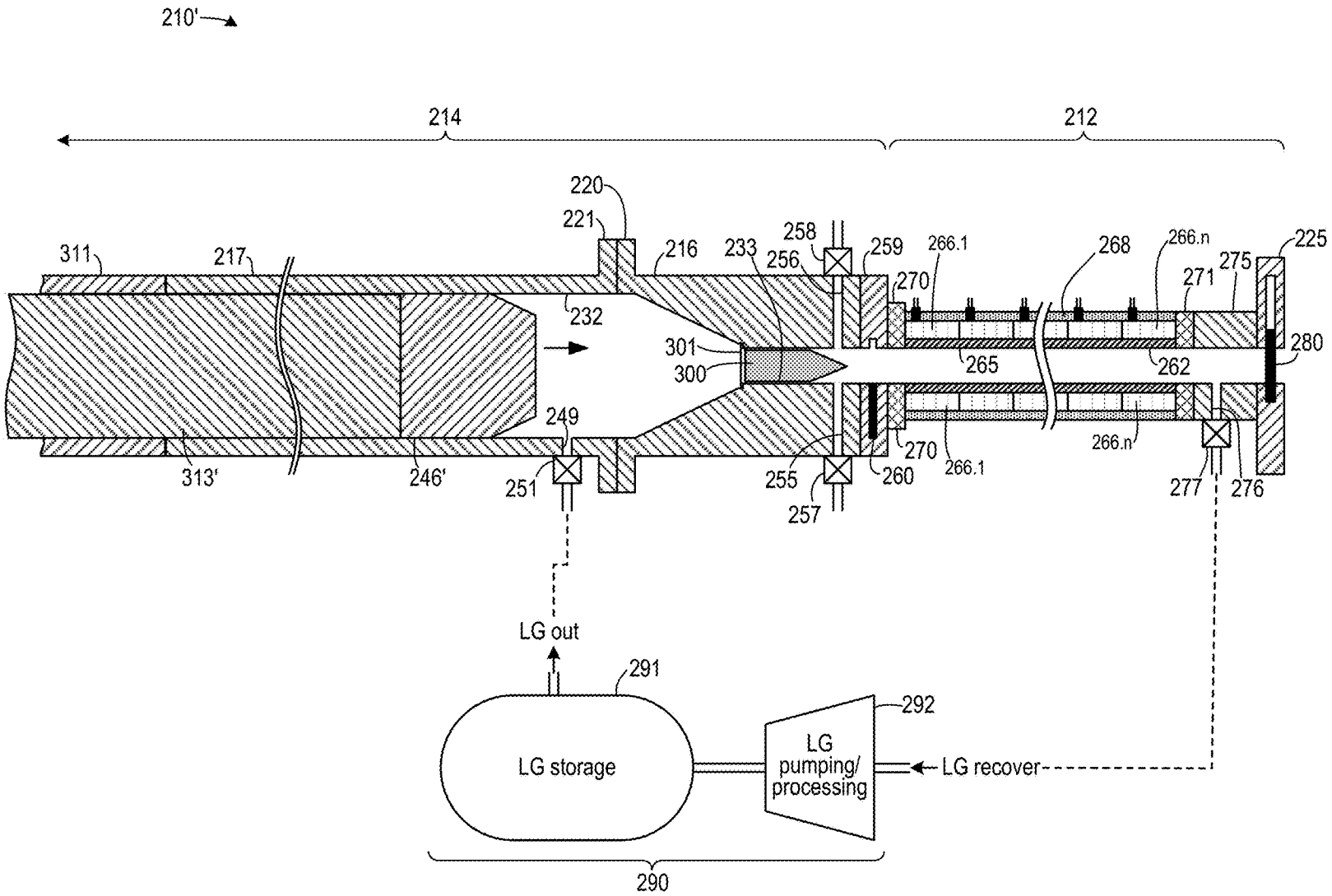
Figure 6M:
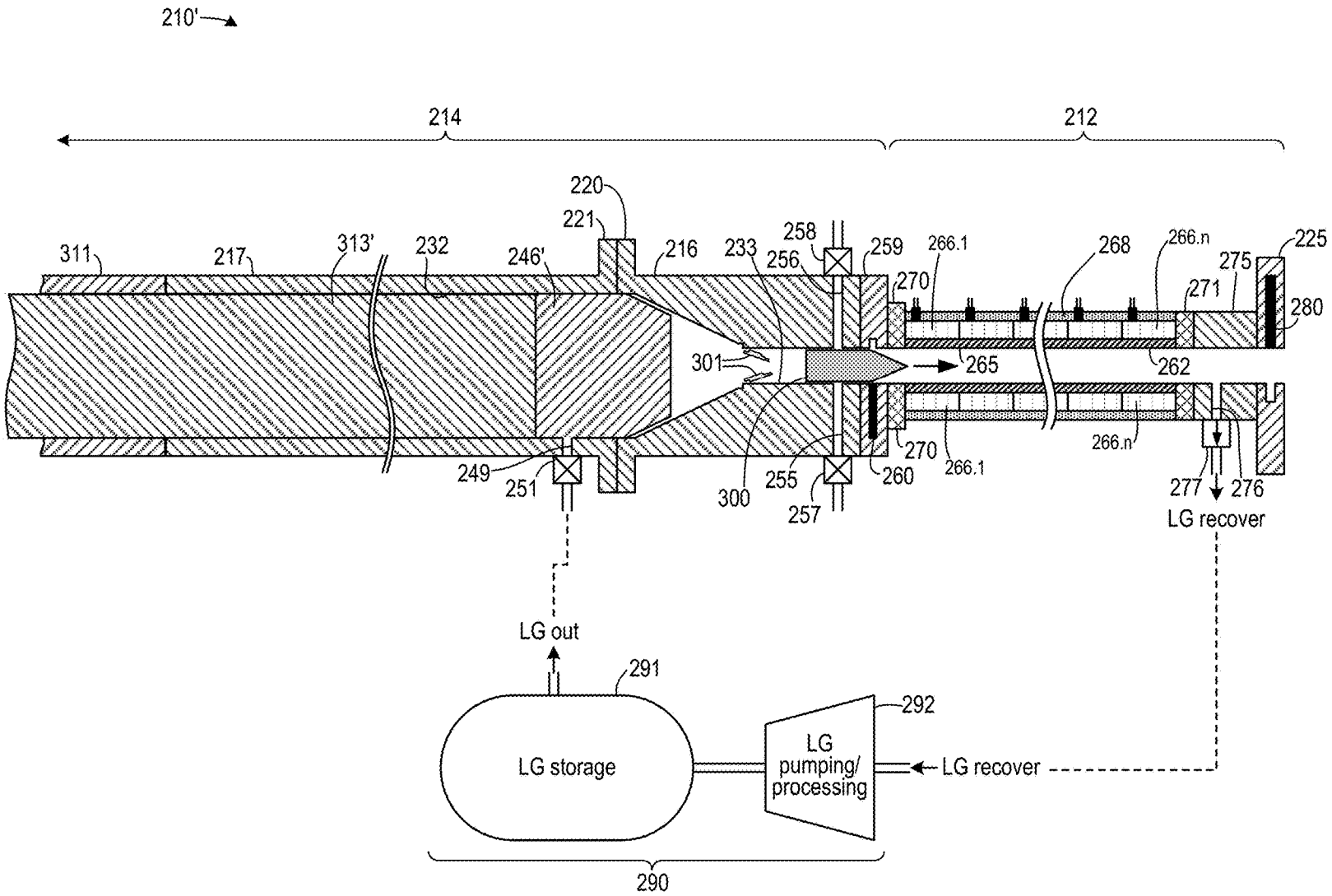
Figure 6N:
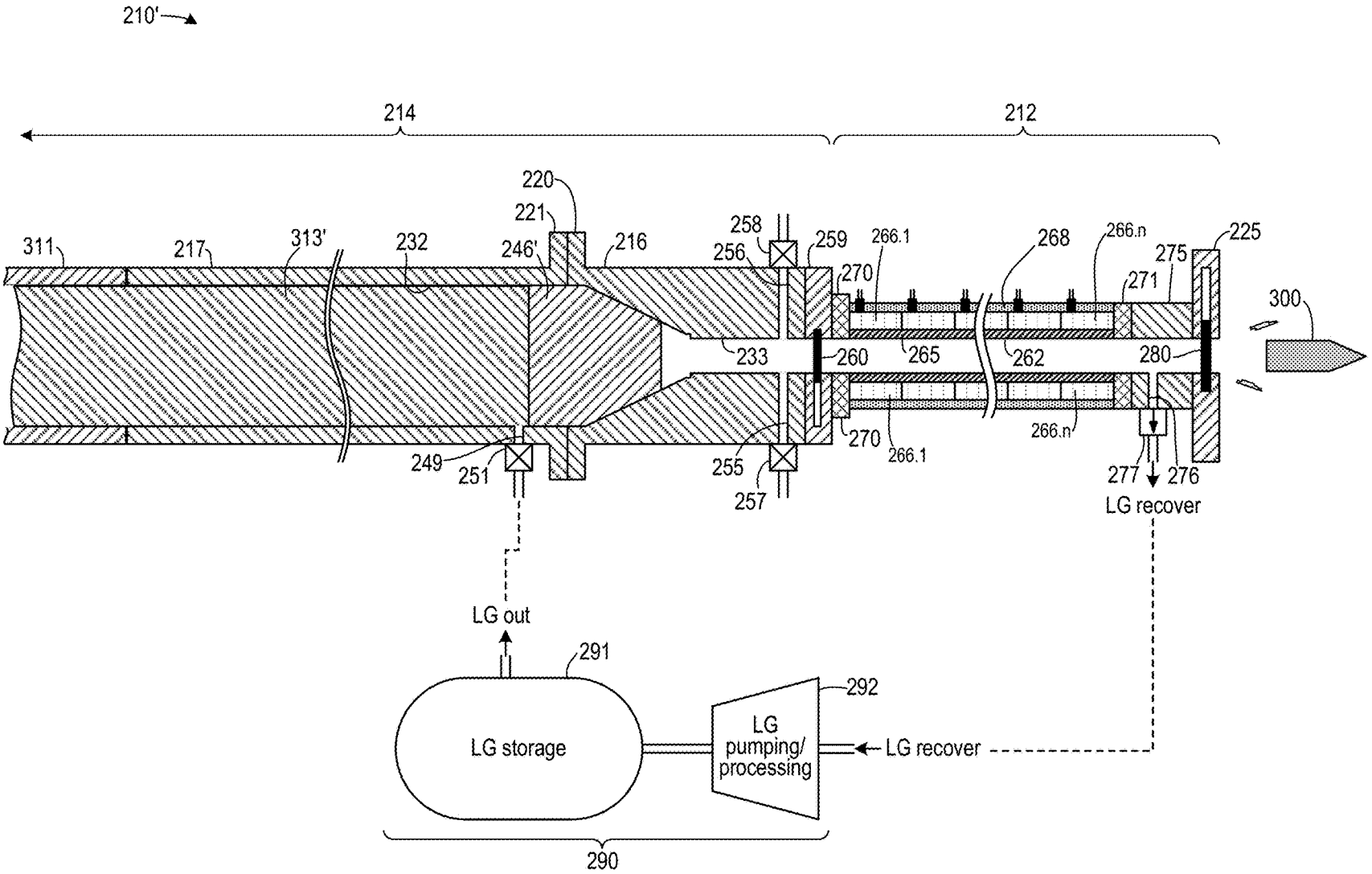

Although the armature 313 and the piston 246 move relative to one another in the gun 210, this need not be the case. For example, the railgun 311 may be configured so that the piston is attached to the end of the armature. The attached piston may be removable from the armature so that it can be replaced and/or so that the piston and armature may be made of different materials. FIGS. 6H through 6N show a firing sequence of a gun 210' that is similar to the gun 210, except that the piston 246 and the armature 313 of the gun 210 have been replaced with a piston 246' and an armature 313' in the gun 210', with the piston 246' being fixed to the end of the armature 313'. The operations shown in FIGS. 6H through 6N are respectively the same as in FIGS. 6A through 6G, except with regard to FIGS. 6D and 6K. In FIG. 6K, the piston 246' begins moving when the armature 313' begins moving and does not wait for the front of an armature to strike the rear of a piston.

Other types of electrically-powered linear actuators may be used instead of, or in conjunction with, the railgun 311. For example, a linear induction motor may be used.

Figure 7:
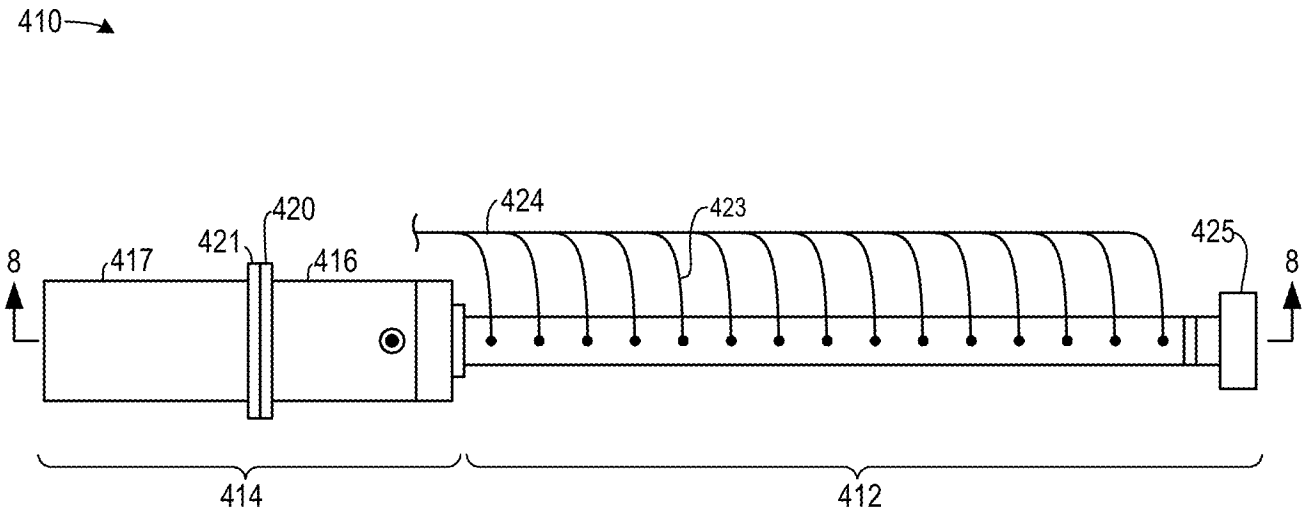
FIG. 7 is a top view of another example gun comprising a heatable barrel.

FIG. 7 is a partially schematic top view of a further example gun 410 that may comprise a heatable barrel. As with the gun 10 in FIG. 1, structures similar to those found in conventional guns have been omitted from FIG. 7 and from other drawing figures. Except in connection with how propellant is compressed, the gun 410 is similar to the gun 10. A launcher 414 of the gun 410 includes a compression chamber in which propellant is heated by an electrical arc to raise the temperature and pressure of the propellant. The gun 410 may include a barrel 412 that is similar to the barrel 12, and a launcher 414 that includes a forward section 416 and a rear section 417. The forward section 416 may be similar to the forward section 16 described in connection with the gun 10. Flanges 420 and 421 may be pushed together to seal the compression chamber and separated to permit access to a breach. Hydraulic rams, not shown, may be positioned around the circumferences of the flanges 220 and 221 to open and close the launcher 214.

Figure 8:
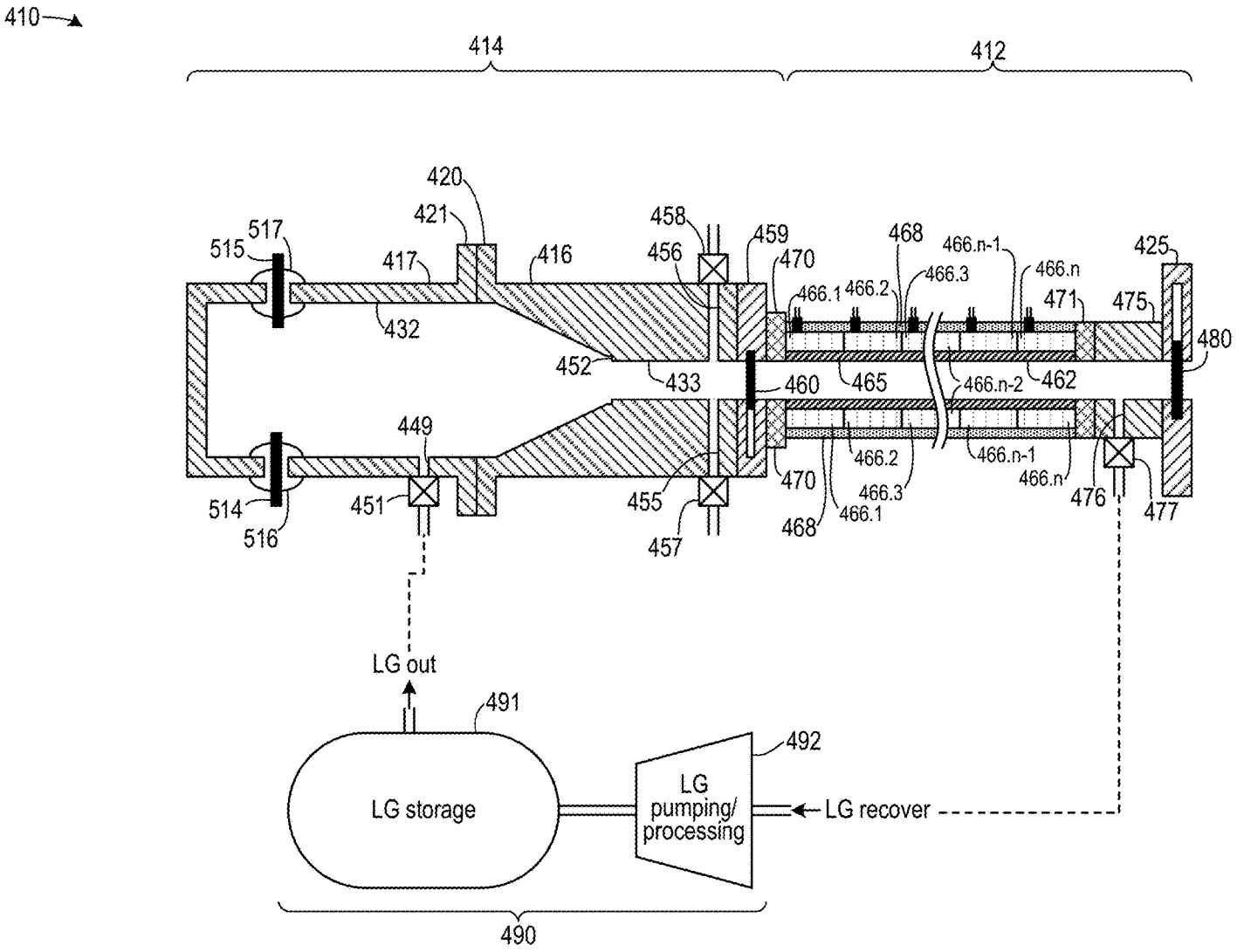
FIG. 8 is a partially schematic area cross-sectional view of the gun of FIG. 7.

FIG. 8 is a partially schematic area cross-sectional view of the gun 410 from the sectioning plane indicated in FIG. 7. The rear section 417 of the launcher 414 may be simpler than the rear section 16 of the launcher 14 (FIG. 2) or the rear section 216 of the launcher 214 (FIG. 5). In particular, the rear section 417 lacks a piston. Electrodes 514 and 515 protrude into the portion of the compression chamber 432 formed by the rear section 417. The electrodes 514 and 515 may be electrically isolated from the wall of the rear section 417 by insulators 516 and 517. The openings in the rear section 417 through which the insulators 516 and 517 penetrate, as well as the openings in the insulators 516 and 517 through which the electrodes 514 and 515 penetrate, may be sealed to prevent escape of gas. Forward of the rear section 416, the gun 410 may be substantially similar to the gun 10. Each row of Table 2 indicates one or more elements of the gun 10 that may be structurally similar to, and that may operate in a similar manner as, one or more corresponding elements of the gun 410.

TABLE 2

| Gun 10 Element(s) | Gun 410 Element(s) |
|---|---|
| barrel 12 | barrel 412 |
| forward section 16 | forward section 416 |
| flanges 20 and 21 | flanges 420 and 421 |
| cables 23 | cables 423 |
| wiring harness 24 | wiring harness 424 |
| front shutter assembly 25 | front shutter assembly 425 |
| compression chamber 32 | compression chamber 432 |
| breach 33 | breach 433 |
| port 49 | port 449 |
| valve 51 | valve 451 |
| lip 52 | lip 452 |
| valve 53 | valve 453 |
| ports 55 and 56 | ports 455 and 456 |
| valve 56 | valve 456 |
| rear shutter assembly 59 | rear shutter assembly 459 |
| rear shutter 60 | rear shutter 460 |
| bore 62 | bore 462 |
| inner sleeve 65 | inner sleeve 465 |
| heaters 66.1 through 66.n | heaters 466.1 through 466.n |
| insulation 68 | insulation 468 |
| insulator 70 | insulator 470 |
| insulator 71 | insulator 471 |
| propellant recovery manifold 75 | propellant recovery manifold 475 |
| port 76 | port 476 |
| valve 77 | valve 477 |
| front shutter 80 | front shutter 480 |
| propellant recovery and supply system 90 | propellant recovery and supply system 490 |
| storage tank(s) 91 | storage tank(s) 491 |
| propellant pumping/processing subsystem 92 | propellant pumping/processing subsystem 492 |
| projectile 100 | projectile 500 |
| shear plate 101 | shear plate 501 |

Figure 9A:
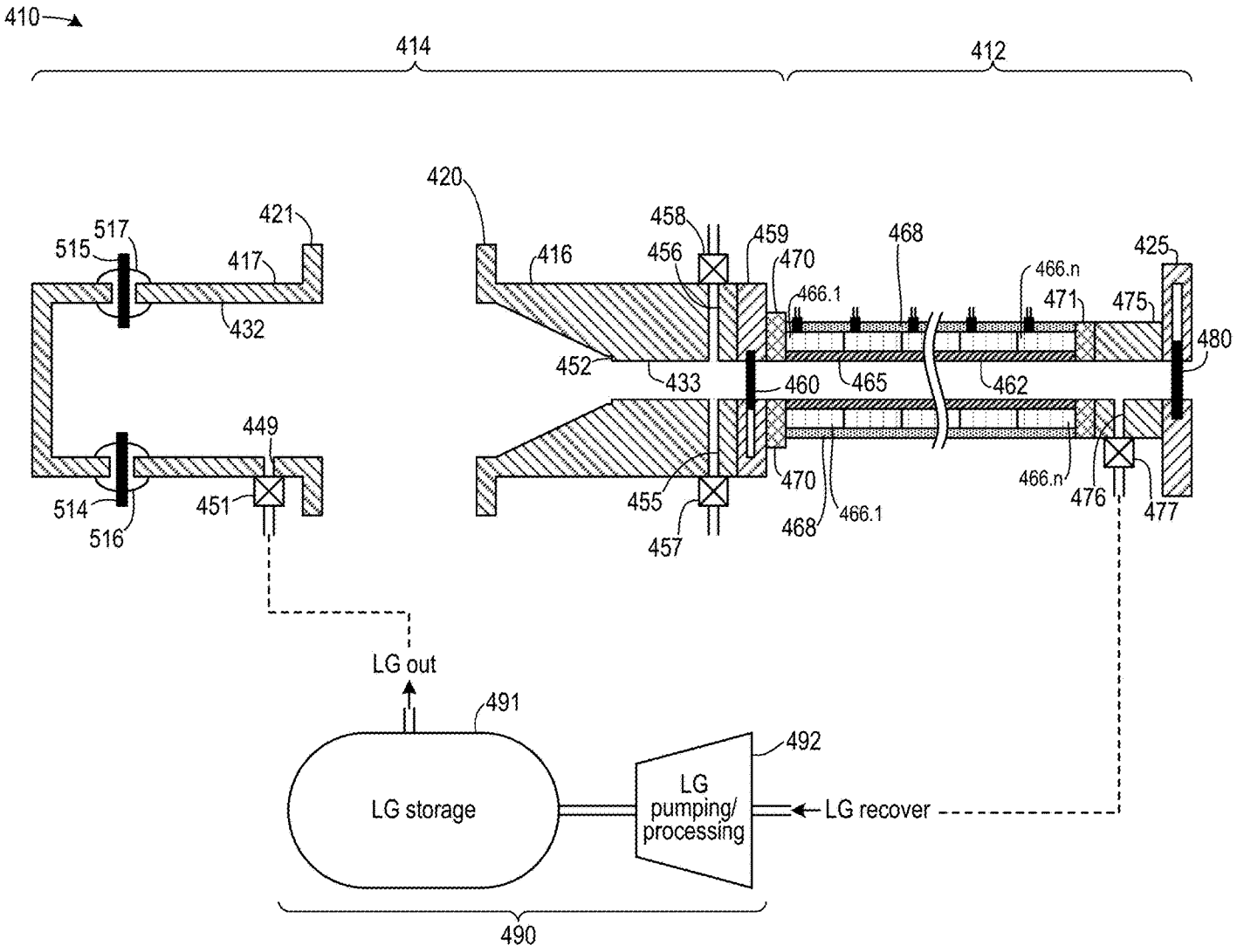
FIGS. 9A, 9B, 9C, 9D, 9E, and 9F are partially schematic area cross-sectional views showing operations in a firing sequence of the gun of FIG. 7.
Figure 9B:
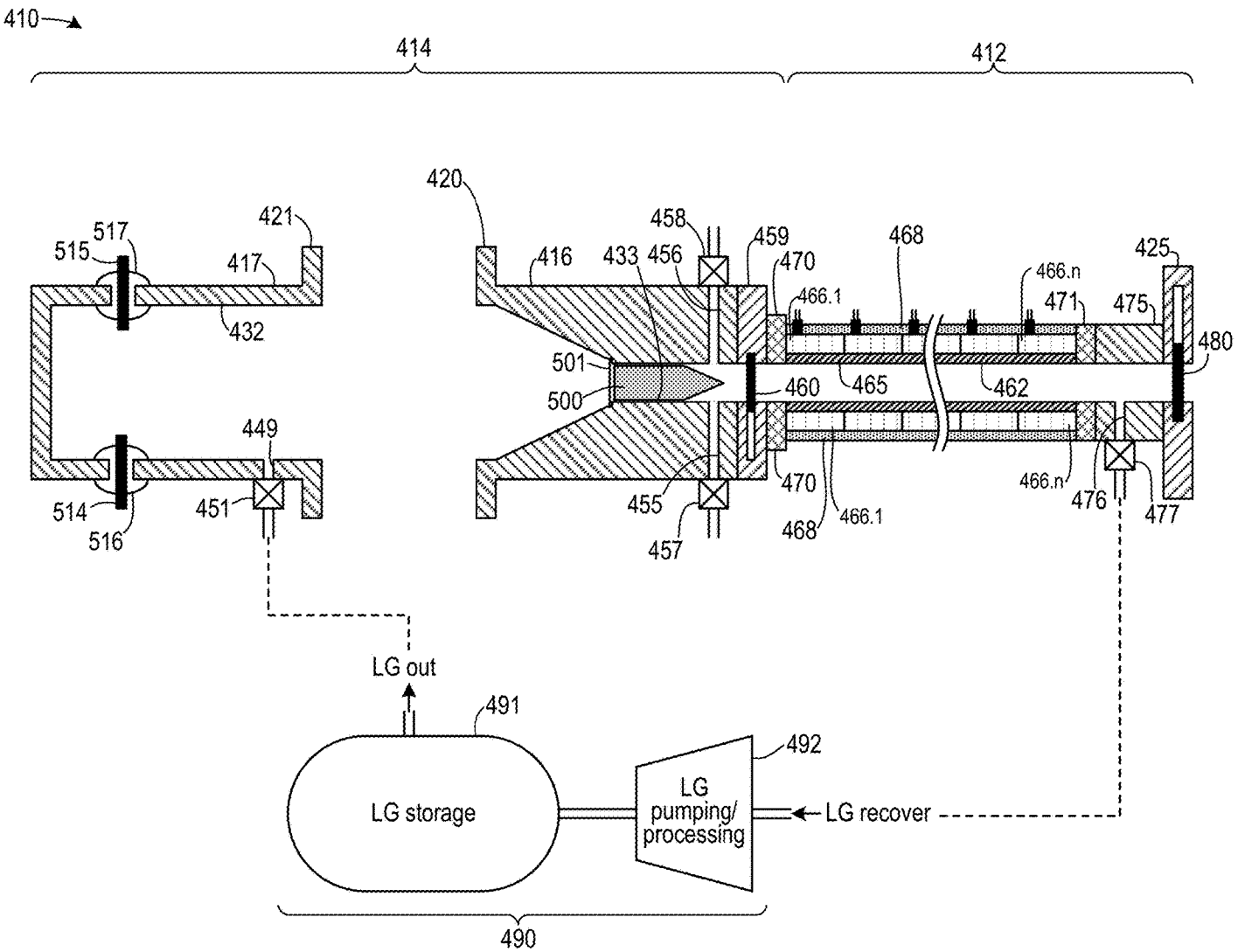
Figure 9C:
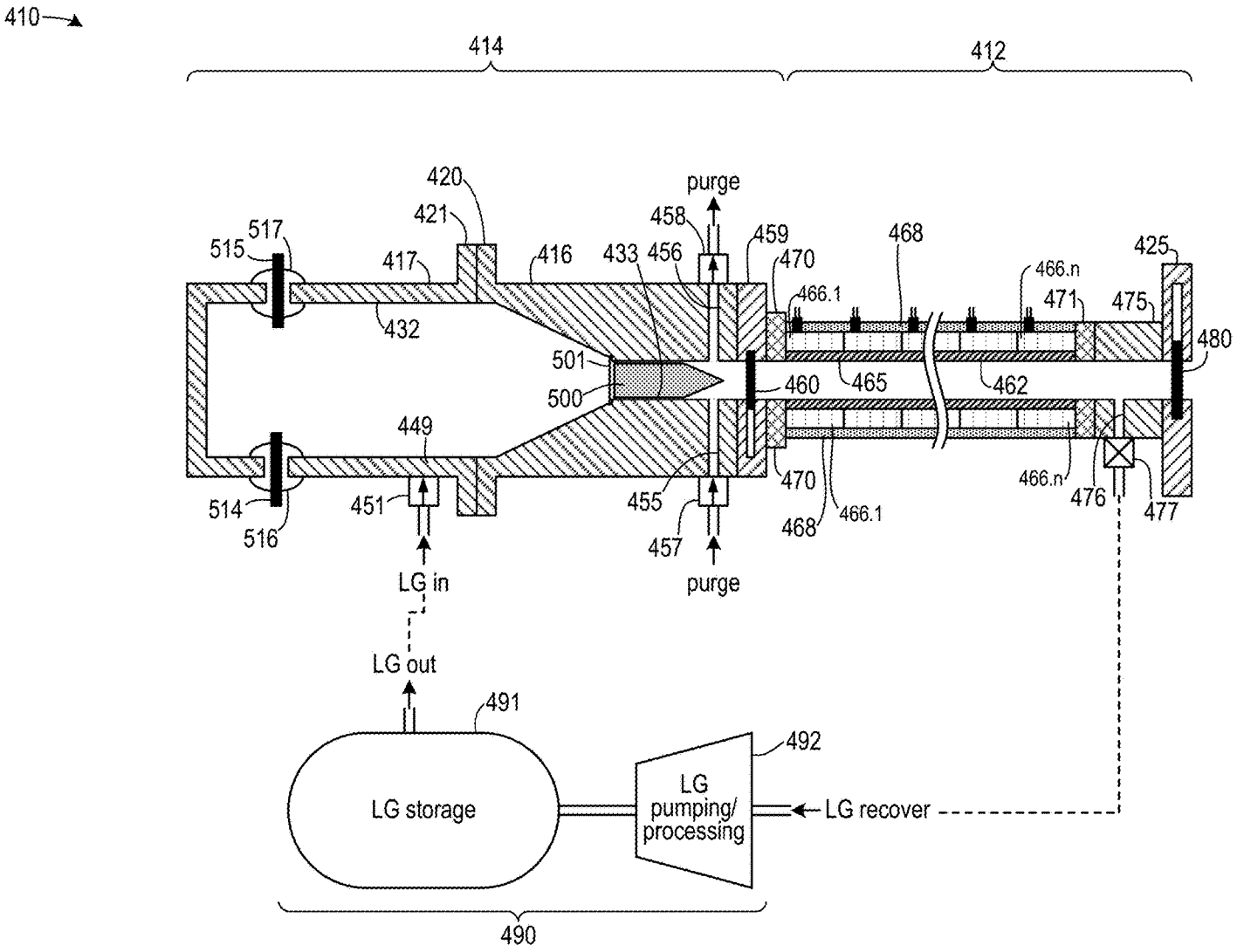
Figure 9D:
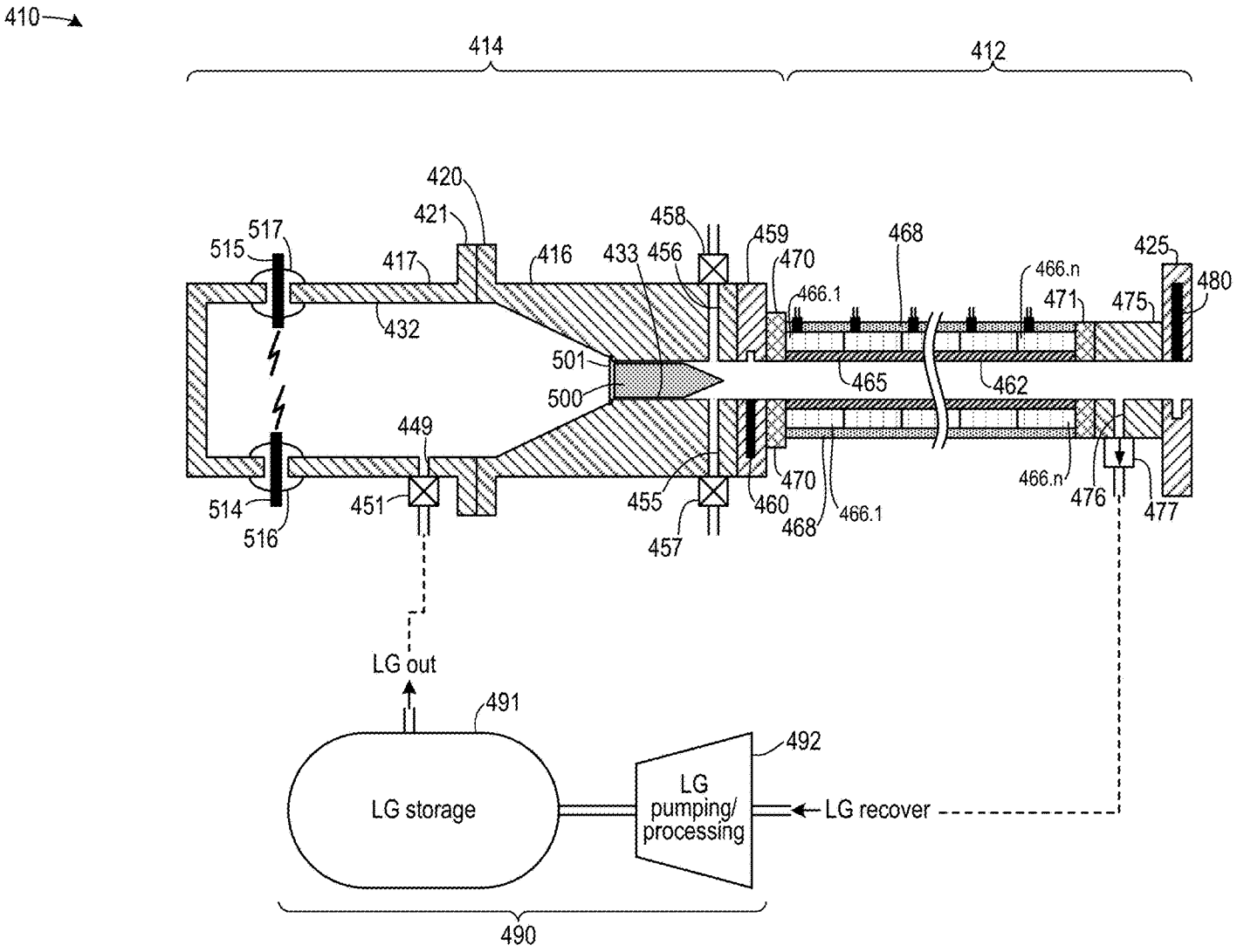

FIGS. 9A through 9F show operations in a firing sequence of the gun 410. Each of FIGS. 9A through 9F is a partially schematic area cross-sectional view from the same sectioning plane used to obtain FIG. 8. FIG. 9A shows the gun 410 at a time T40 after the launcher 414 has opened by separating the flanges 420 and 421. The valves 451, 457, 458, and 477, as well as the rear shutter 460 and the front shutter 480, are closed. The heaters 466 may be activated and the inner sleeve 465 of the barrel 412 may be heated to, or near, a desired temperature for firing. FIG. 6B shows the gun 410 at a time T41 after time T40. A projectile 500 has been placed into the breach 433 and a shear plate 501 placed onto the rim 452. FIG. 9C shows the gun 410 at a time T42 after time T41. The launcher 414 has been closed by pressing together the flanges 420 and 421. The valve 451 is open, and propellant flows into the compression chamber 432, from the tank(s) 491, via the port 449. The valves 457 and 458 are also open, allowing purge gas to fill the breach 433 and flush air from the breach 433. FIG. 9D shows the gun 410 at a time T43 after time T42. Between times T42 and T43, the valves 451, 457, and 458 were closed, and the rear shutter 460 was opened. At time T43, electrical power is applied to the electrodes 514 and 515 and an arc is created in the compression chamber 432. The arc heats the propellant in the chamber 432 and causes the propellant pressure to rise. At the same time that power is applied to the electrodes 514 and 515, the front shutter 480 and the valve 477 may be opened.

Figure 9E:
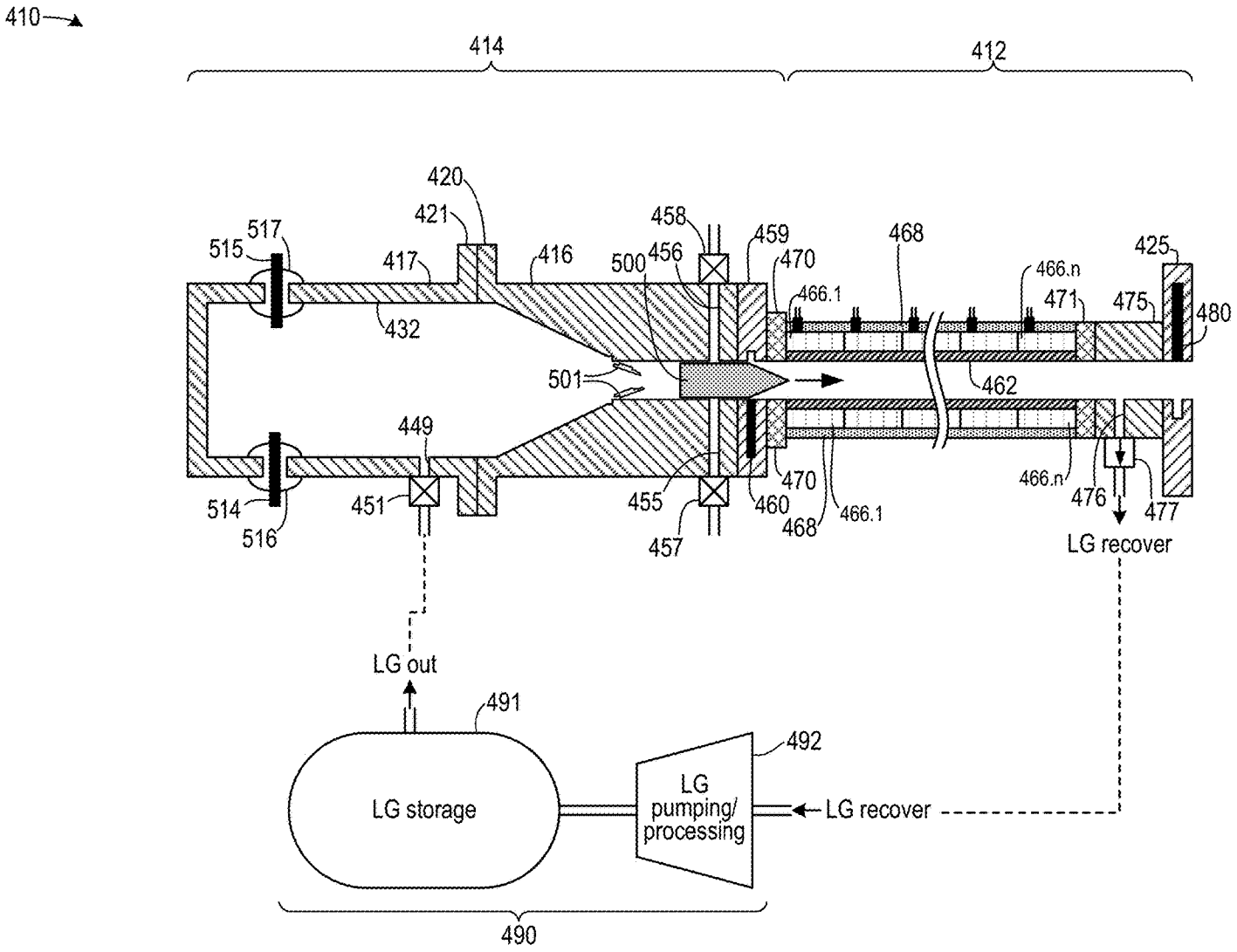

FIG. 9E shows the gun 410 at a time T44 after time T43. The shear plate 501 has given way after the propellant pressure in the chamber 432 reached a sufficiently high value. The electrical arc across the electrodes 514 and 515 may be discontinued when the pressure in the chamber drops as a result of the shear plate 501 giving way. The launcher 414 may include a sensor, not shown, that measures pressure in the compression chamber 432 and that may be used to determine when power to the electrodes 514 and 515 is shut off. As also shown in FIG. 9E, the compressed propellant in the compression chamber 432 has begun expanding into the breach 433 to begin pushing the projectile 500 forward.

Figure 9F:
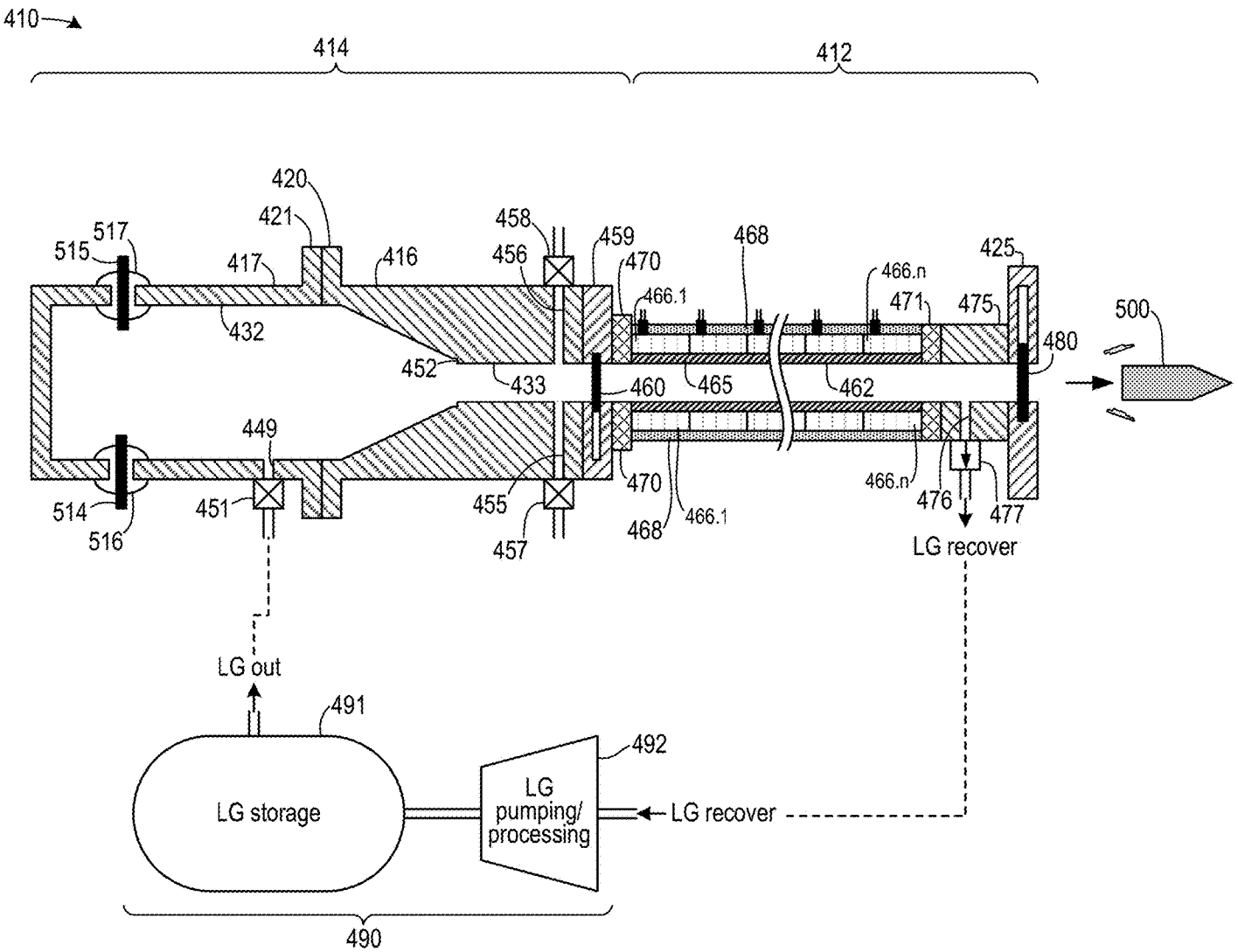

FIG. 9F shows the gun 410 at a time T45 after time T44. At time T45, which is very soon after the projectile 500 and the remnants of the shear plate 501 have left the gun 410, the front shutter 480 is closed. The valve 477 may be left open for a short period of time after the closing of the shutter 480, thereby allowing propellant to exit the barrel 412 via the port 476 and be recovered at the input to the subsystem 492. The valve 477 and the rear shutter 460 may subsequently be closed.

Using a heated gun barrel, e.g., a very hot gun barrel, reheats propellant as it travels in the barrel. This increases the gas pressure in the propellant, and hence acceleration of the projectile in the barrel. In contrast, a room temperature barrel absorbs energy from propellant and reduces pressure on a projectile. Because a hot barrel adds energy into propellant, the propellant's energy at the breach at the time of firing can be reduced. In particular, because gas pressure of the propellant may be maintained (or at least reduced at a slower rate) in a hot barrel, the initial propellant pressure at time of firing can be lower than would be needed if a cold barrel is used. This may reduce the peak propellant pressure and peak projectile acceleration in a gun. This may allow a much smoother pressure profile on the projectile than may be available using a traditional gun.

A cold barrel can absorb approximately 30% of a typical gun propellant's energy. Heating a steel barrel may add energy to the propellant in the barrel, and applied to a state of the art tank gun, may raise muzzle velocity from Mach 5 to about Mach 7. However, the strength of steel is greatly reduced at higher temperatures, thus limiting the degree to which such a barrel could be heated and the amount of velocity gained from heating. A tungsten barrel may address these issues. For example, the sleeves 65, 265, and 465 in the guns 10, 210/210', and 410 could be formed from one or more tungsten alloys. Tungsten has high strength and ductility at high temperatures. Indeed, many tungsten alloys are so hard that they may be brittle at room temperature. Tungsten also has good thermal conductivity and other properties. A light gas propellant such as hydrogen can absorb energy from a barrel at about ten times the rate of standard propellants, and is relatively non-reactive with tungsten, thereby reducing barrel erosion. The very high rate of the thermal energy absorption of hydrogen indicates that a hot barrel may add 300% to the propellant energy. That may achieve muzzle velocities in excess of Mach 5, and potentially greater than Mach 7.5.

The energy requirement to fire a barrage round (e.g., a 14 Kg projectile plus a 6 Kg sabot) at Mach 7.5 using a gun with a heated barrel is estimated to be about 270 Megajoules (MJ), e.g., approximately 50 MJ into the projectile, 20 MJ into the sabot, and 200 MJ into the propellant. Firing 10 rounds per minute infers a raw 45 Megawatt power requirement into the tungsten barrel to continuously heat and reheat it between and during fires. A tungsten barrel with light gas propellant can handle such an energy requirement. This raw 45 Megawatt estimate can potentially be reduced, however, by recycling heat energy from the propellant. For example, propellant recovered at firing (e.g., from the valves 77, 277, and 477 of the guns 10, 210/210', and 410) would still be heated. The recovered propellant can be passed through a heat exchanger and recovered heat used to preheat propellant in the compression chamber prior to firing.

In the examples described above, a separate shear plate and projectile were shown. A projectile and a shear plate could be integral so that both can be loaded in a single motion. For example, a shear plate could be attached to the rear of a projectile. As another example, a shear plate may take the form of a ring that surrounds the outer circumference of projectile and that fits into a lip such as any of the lips 52, 252, or 452. A shear plate could be configured to remain in place after firing (e.g., a center portion may break away and travel with the projectile and leave a ring in place on the lip), and then be removed when the next projectile and shear plate are loaded.

Figure 16:
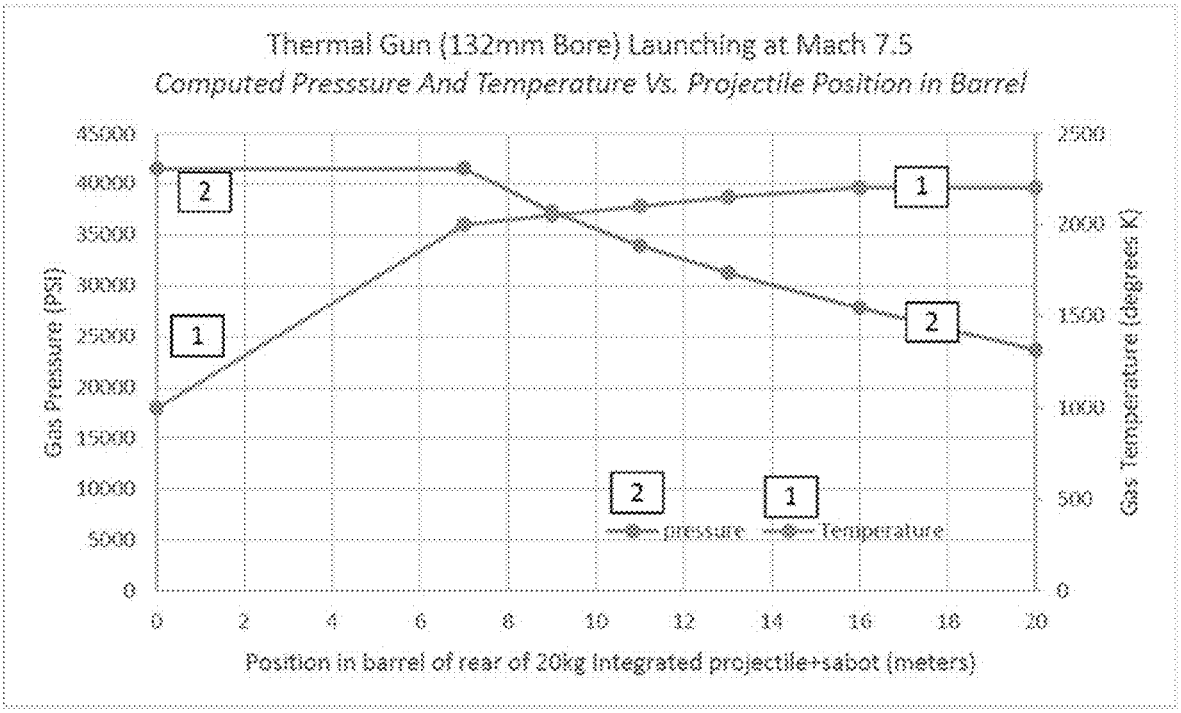
FIG. 16 shows estimated temperature and pressure profiles for a 132 mm bore gun launching a 20 kg projectile and sabot to Mach 7.5.

Tungsten properties may be used to estimate reasonable pressure and temperature curves for a thermal gun to achieve Mach 7.5 muzzle velocity. FIG. 16 shows estimated profiles for a 132 mm bore gun launching a 20 kg projectile and sabot to Mach 7.5. In the estimate, hydrogen enters the barrel at 1000° K. Its temperature then rises to 2000° K over 7 meters. Because the chamber volume is chosen to equal the volume contained in 7 meters of the 132 mm bore barrel, the gas temperature in this part of the barrel doubles at the same rate that its volume doubles. This results in an isobaric expansion in this part of the barrel as depicted on the left of FIG. 16. Beyond 7 meters the temperature rises more slowly; the pressure drops because the gas volume expands faster than its temperature rises. The pressure at the muzzle may still be much better (much higher) than in a standard gun. It may also be much better than for adiabatic expansion and better than for isothermal expansion. This may enable hypervelocity launch without exceeding 20000 g acceleration. For this particular result, it is estimated that less than 100 liters of liquid hydrogen is required per shot and propellant mass is ⅓ the mass of the integrated projectile.

The rate of heat absorption into a pure hydrogen propellant may depend on: (1) the combination of its turbulence in the barrel and other factors that determine the thermal convection, (2) hydrogen's underlying thermal conductivity, (3) geometry factors of the barrel, and (4) the time available as the hydrogen travels through the barrel. Several approaches to estimating these factors have been used. For example, a 10× increase of thermal conductivity of hydrogen relative to propellants used in standard guns is based on a combination of: (1) hydrogen's very high thermal conductivity (more than a factor of 5 higher than standard propellants), and (2) its low viscosity (by more than a factor of 2), which raises the level of turbulence and thus the Nusselt number (the ratio of thermal convection to thermal conductivity) by a factor of 2. The two factors contribute multiplicatively (thermal convection=Nusselt Number×thermal conductivity) resulting in the factor of 10. Comparisons can also be made to tests performed by NASA on hydrogen gas heated by passage through heated tungsten tubes. Table 3 compares data reported from or derived based on) the NASA tests and estimates for a 132 mm thermal gun.

TABLE 3

| Parameter | NASA | 132 mm gun | Ratio |
|---|---|---|---|
| equivalent diameter (m) | 3.20E−03 | 1.32E−01 | 41.3 |
| barrel length (m) | 2.03E−01 | 2.00E+01 | 98.5 |
| chamber "length" (m) | | 7.00E+00 | |
| propellant mass (kg) | | 6.66E+00 | |
| ave velocity (m/s) | 1.00E+02 | 1.40E+03 | 14.0 |
| $H_2$ flow (kg/sec) | 5.49E−04 | 4.66E+02 | 848448.3 |
| start temp (° K.) | 2.94E+02 | 1.00E+03 | 3.4 |
| thermal conductivity (watts/m-K.) | 1.86E−01 | 9.93E−01 | 5.3 |
| viscosity (N-s/$m^2$) | 8.90E−06 | 1.88E−05 | |
| Reynold number | 2.40E+04 | 3.54E+08 | 14765.1 |
| Molar heat capacity at constant pressure (J/kg-° K.) | 1.43E+04 | 1.50E+04 | 1.0 |
| Prandtl number | 6.85E−01 | 2.83E−01 | 0.4 |
| Nusselt number | 6.31E+01 | 9.60E+04 | 1520.8 |
| thermal convection (watts/m-° K.) | 1.17E+01 | 9.54E+04 | 8122.4 |
| heat transfer coefficient (watts/$m^2$-° K.) | 7.34E+03 | 1.45E+06 | 196.9 |
| barrel surface area ($m^2$) | 2.04E−03 | 8.29E+00 | 4064.0 |
| heat transfer rate (watts/sec) | 1.50E+01 | 1.20E+07 | 800238.8 |
| heat transfer (joules/° K.) | 3.04E−02 | 1.71E+05 | 5631518.8 |
| heat transfer (joules/kg-° K.) | 2.73E+04 | 2.57E+04 | 0.9 |
| heating of gas (° K./° K.) | 1.90E+00 | 1.72E+00 | 0.9 |

The bottom row of Table 3 shows that the temperature rise of the hydrogen per degree difference between the gas and wall temperature is similar for the NASA tubes and modeling for a 132 mm thermal gun. The NASA tubes show temperature rises of over 800° K for averaged temperature differences between gas and barrel temperature of about 600° K. A wall temperature of 3000° K in a thermal gun is correspondingly estimated to provide the temperature rise shown in FIG. 16. The third row from the bottom of Table 3 shows heat transfer of 1.71E+05 joules per average degree difference between the wall and the gas. Thus, a 1000° K average difference adds 170 Megajoules to the gas in the barrel. That adds to 100 Megajoules in the gas before it enters the barrel, thus providing the total 270 Megajoules estimated to achieve Mach 7.5. The heat transfer estimates for the modeled 132 mm thermal gun assume a smooth round barrel with 6.66 Kg of hydrogen per shot. Heat transfer estimates can be raised by a factor of 2 to 4, or perhaps more, by used of non-round non-smooth barrels and up to 10 Kg of hydrogen per shot. Non-round barrels may increase the heat transfer by increasing the surface area. Non-smooth barrels may increase the heat transfer by increasing the turbulence, which may increase the Reynold's number, which may increase the Nusselt number, which may increase thermal convection.

For the 132 mm bore barrel, estimated peak gas pressure is about 42,000 psi (FIG. 16), while for a 155 mm bore barrel that pressure is estimated to be about 30,000 psi. Neither of these pressures is high for a large gun. Moreover, tungsten is as strong as or stronger than steel. At room temperature, tungsten and its alloys are so hard as to be brittle. Above 700° K the brittleness disappears and tungsten becomes ductile, yet still harder than steel. Thus, all tungsten parts in a gun may be kept above 700° K when in operation. At very high temperatures, e.g., above about 2200° K (dependent on the tungsten alloy), tungsten's static yield strength drops. However, literature shows yield strengths approaching 40,000 psi for some tungsten alloys at such temperatures, and, further, that they may be several factors of 2 higher for short stresses. If the thermal convection is be enhanced so that the temperature curve of FIG. 16 may be achieved with a wall temperature of about 2200° K or with a varying temperature of about 2000° K at the breach up to 2500° K at the muzzle, then a hot tungsten barrel may contain the pressure directly. If higher barrel temperatures are used, e.g., up to about 3000° K, a cooler outer cover may be used to help contain pressure in a hotter inner barrel.

Depending on the amount of thermal convection and on the ability of a guided projectile to withstand accelerations up to 30,000 g, it is estimated that Mach 7.5 can be achieved with a 14 meter heated gun barrel. However, a longer barrel (e.g., 20 meters) may offer advantages. A longer barrel may allow reduced barrel pressure. A longer barrel may allow lower acceleration forces on electronics of a guided round. A longer barrel may allow higher velocities by increasing the barrel temperature and/or increasing the quantity of propellant.

Figure 10:
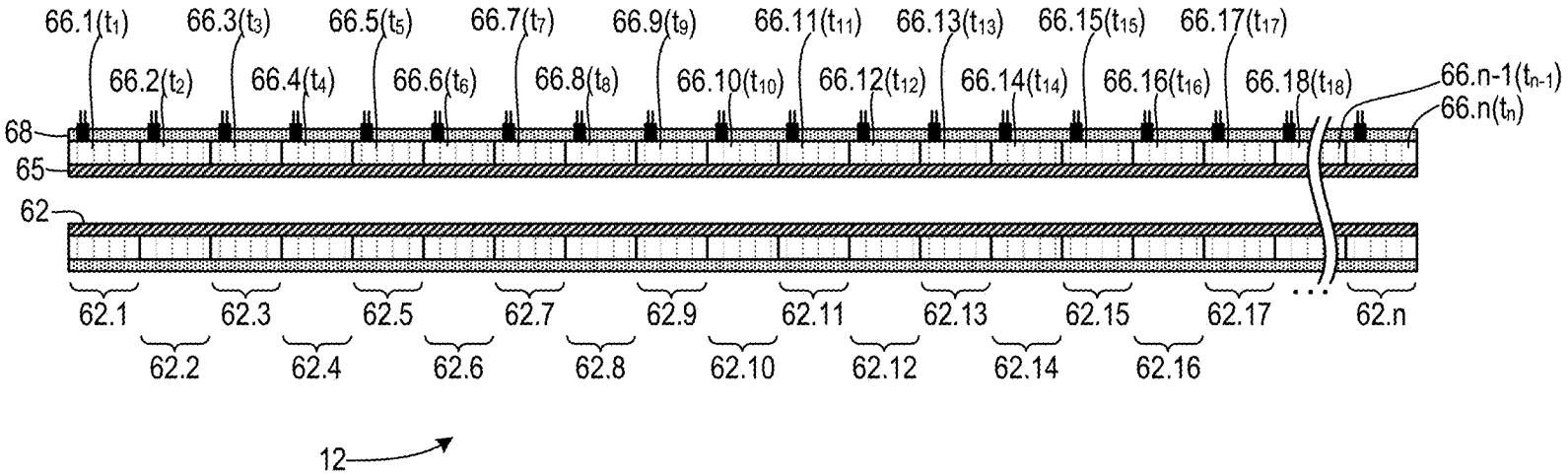
FIG. 10 is a partially schematic area cross-sectional view of a portion of the barrel of the gun of FIG. 1.

As described above, a barrel may have multiple heating elements arranged along its length, and each of those heating elements may be individually controllable (e.g., by varying power inputs to the heating elements). This allows creation of a temperature gradient along the length of a barrel. FIG. 10 is a partially schematic area cross-sectional view, of a portion of the barrel 12 of gun 10, further showing use of individually controllable heating elements. In FIG. 10, n heating elements 66.1 through 66.2 are arranged along the length of the barrel 12. The value of n may be any desired number. Although FIG. 10 shows the heating elements 66 as identical in size and in contact with each other, this is not required. Heating elements in a barrel may be of different sizes and/or separated and/or irregularly spaced. As shown in FIG. 10, heating element 66.1 is powered to a first level to generate a temperature $t_1$ in a first zone 62.1 of the bore 62, heating element 66.2 is powered to a second level to generate a temperature $t_2$ in a second zone 62.2 of the bore 62, etc., with heating element **66.*n* powered to an $n^{th}$ level to generate a temperature $t_n$ in an $n^{th}$ zone 62.*n* of the bore 62. All zones need not be at different temperatures, e.g., some heating elements 66 may be powered at the same level. Various temperature gradients may be created. For example portions of the bore 62** closer to the breach may be at lower temperatures than portions of the bore closer to the muzzle (e.g., $t_1<t_n$) to reduce heat transfer to the breach and other portions of the launcher, and/or to increase heat transfer to propellant as the volume of the propellant increases because of travel of the projectile toward the muzzle. Such a gradient may be continuously increasing (e.g., $t_1>t_2> \ldots >t_n$), may peak and then decrease (e.g., $t_1>t_2> \ldots >t_{n-3}<t_{n-2}<t_{n-1}<t_n$), may have multiple peaks, or may have other profiles.

Figure 11:
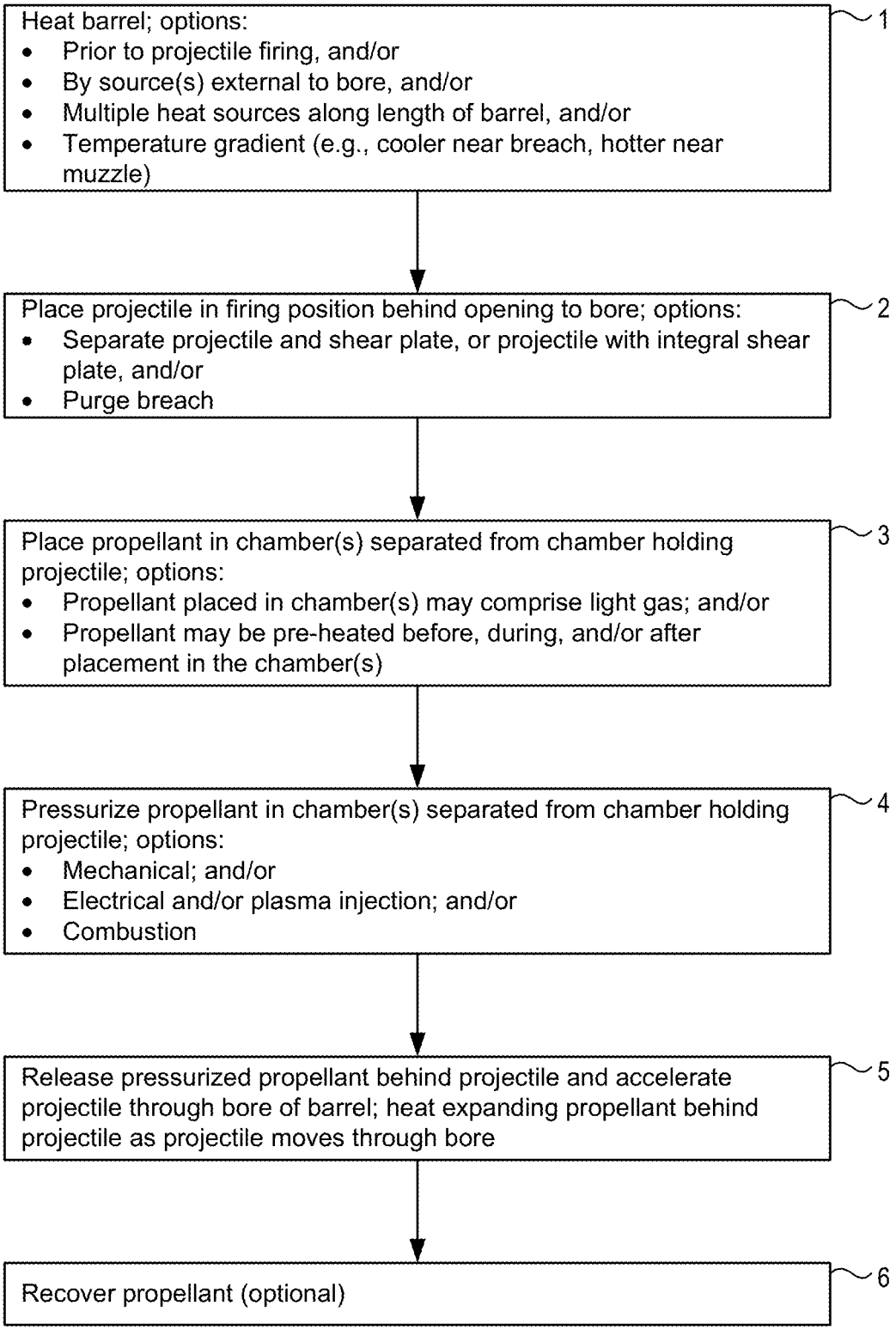
FIG. 11 is a flow chart showing operations associated with example methods for operating a gun with a heated barrel.

FIG. 11 is a flow chart showing operations associated with example methods for operating a gun with a heated barrel (e.g., one of the guns 10, 210, 210', and/or 410). In step 1, the barrel bore may be heated. The barrel may be heated prior to firing a projectile through the barrel. The barrel may be heated using heat sources positioned external to a bore of the barrel. There may be multiple heat sources along a length of the barrel, and a temperature gradient may be generated. In step 2, a projectile may be loaded, e.g., placed into a firing/launching position behind an entrance to the heated barrel. The breach or other region surrounding the loaded projectile may be purged, e.g., with one or more inert gases, to prevent incursion of reactive gases into the heated barrel bore. In step 3, a propellant may be placed into one or more chambers that are separated from a chamber holding the loaded projectile. The propellant may be a light gas. The propellant may be preheated, e.g., by transfer of heat energy from propellant used for previous gun firings. In step 4, the propellant in the chamber(s) may be pressurized. The pressurization may be performed mechanically, e.g., using a piston as in the examples of the guns 10, 210, and 210'. The pressurization may be performed using electrical arcing in the propellant chamber (as in the example of the gun 410), plasma injection, and/or other operations for increasing propellant temperature (and thus, propellant pressure). The pressurization may be performed by direct combustion in the propellant chamber. In step 5, the pressurized propellant may be released behind the projectile, and the projectile accelerated through the heated barrel bore. As the projectile travels through the bore, the volume behind the projectile, which volume holds the propellant, expands. Propellant in that expanding volume may be heated by the heated barrel bore, and pressure drop in the propellant may be reduced and/or slowed. In step 6, propellant may be recovered.

A gun with a heatable barrel (e.g., such as one or more of the guns 10, 210, 210', or 410), may be used as part of a propulsion system, for example, in a spacecraft. In situ dust (hereafter "dust") can be used to create projectiles. Sources of dust may include asteroids, moons, mining tailings, etc. Dust may include, for example, a high percentage (e.g., 40% or more) of silicon dioxide ($SiO_2$). Other compounds present in significant quantities (e.g., approximately 10% or more) may include aluminum oxide ($Al_2O_3$), titanium dioxide ($TiO_2$), ferrous oxide (FeO), magnesium oxide (MgO), and/or calcium oxide (CaO). Dust is relatively easy to process, e.g., by filtering or grinding dust to a 200μ size, and/or by compacting dust into pellet projectiles. Dust is relatively easy to store because of its higher density and non-need for pressurization, and is generally not corrosive. Dust itself may contain little or no chemical energy. However, it has mass, and ejection of dust (using a gun with a heated barrel) at high velocity may generate thrust. Projectiles may be created by compressing and heating dust sufficiently to bind the dust into a pellet that will retain integrity as is travels through most of a barrel. Because many materials of dust melt at temperatures much lower than tungsten, a projectile formed from dust may become fully or partially molten as it travels through the barrel and may exit a gun as smaller particles. Molten particles may quickly solidify after exit. Because particles exiting the barrel may be smaller than the pellet, the risk of damage to other objects in space may be reduced.

A gun may develop very high pressures to accelerate projectiles. The pressure drops as the projectile accelerates, though much more slowly in an isothermal process than in an adiabatic one. A heated barrel can be used to make a process more isothermal. For isothermal expansion, specific impulse (SI) for the projectile's mass can match (or possibly exceed) that of other engine types that use that same propellant without projectiles. In guns with barrel lengths 50 to 100 times greater than the bore diameter, acceleration may continue until the projectile is outpacing much of the propellant. The projectile velocity may exceed the speed of sound in the propellant.

Figure 12:
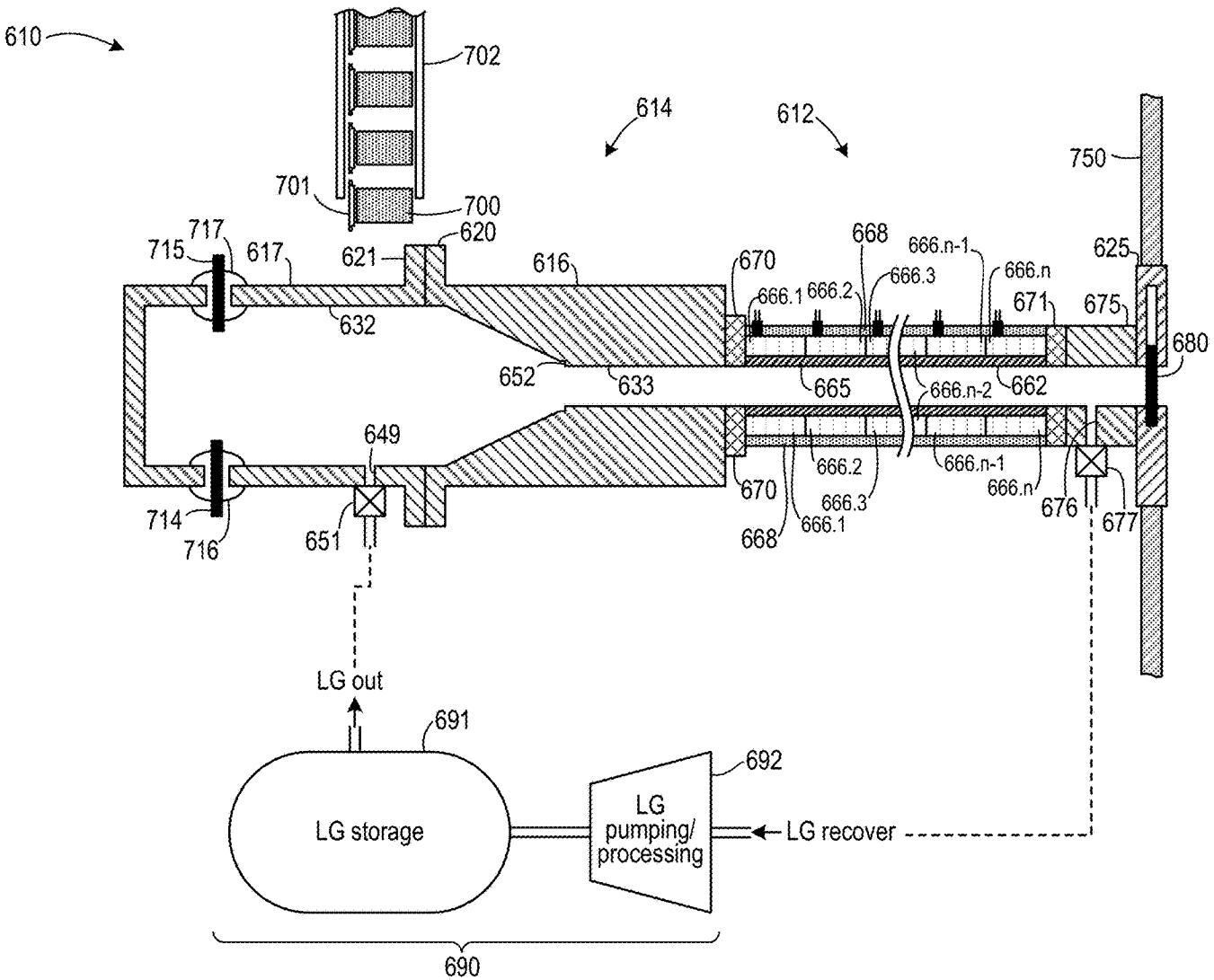
FIG. 12 is a partially schematic area cross-sectional view of an example propulsion system.

FIG. 12 is a partially schematic area cross sectional view of a propulsion system 610. Except as described below, the propulsion system 610 is similar to the gun 410 described above. The cross-sectional view of FIG. 12 is from a sectioning plane similar to that indicated for the gun 410 in FIG. 7. Unlike the gun 410, which may include structures to support and/or move the gun 410 into a desired firing orientation, the propulsion system 610 may be mounted in a spacecraft so that reactive forces from ejecting projectiles from the propulsion system 610 act as thrust on that spacecraft. FIG. 12 shows a portion of the propulsion system 610 incorporated into a bulkhead 750 of a spacecraft. This is but one of many possible arrangements, however.

The propulsion system 610 may lack a rear shutter assembly. A front portion 616 of a launcher 614 may lack ports and valves for purging of a breach 633 and/or may lack a rear shutter assembly, but may otherwise be similar to the front portion 416 of the gun 410. Other components of the propulsion system 610 may the same as, or similar, components of the gun 410. Each row of Table 4 indicates one or more elements of the gun 410 that may be structurally similar to, and that may operate in a similar manner as, one or more corresponding elements of the propulsion system 610.

TABLE 4

| Gun 410 Element(s) | Propulsion System 610 Element(s) |
|---|---|
| barrel 412 | barrel 612 |
| rear portion 417 | rear portion 617 |
| flanges 420 and 421 | flanges 620 and 621 |
| cables 423 | cables 623 |
| wiring harness 424 | wiring harness 624 |
| front shutter assembly 425 | front shutter assembly 625 |
| compression chamber 432 | compression chamber 632 |
| breach 433 | breach 633 |
| port 449 | port 649 |
| valve 451 | valve 651 |
| lip 452 | lip 652 |
| bore 462 | bore 662 |
| inner sleeve 465 | inner sleeve 665 |
| heaters 466.1 through 466.n | heaters 666.1 through 666.n |
| insulation 468 | insulation 668 |
| insulator 470 | insulator 670 |
| insulator 471 | insulator 671 |
| propellant recovery manifold 475 | propellant recovery manifold 675 |
| port 476 | port 676 |
| valve 477 | valve 677 |
| front shutter 480 | front shutter 680 |
| propellant recovery and supply system 490 | propellant recovery and supply system 690 |
| storage tank(s) 491 | storage tank(s) 691 |
| propellant pumping/processing subsystem 492 | propellant pumping/processing subsystem 692 |
| shear plate 501 | shear plate 701 |
| electrodes 514 and 515 | electrodes 714 and 715 |
| insulators 516 and 517 | insulators 716 and 717 |

Projectiles 700 may be formed from compressed dust. A magazine 702 may hold multiple projectiles 700 and corresponding shear plates 701. The magazine 705 may include additional structures, not shown to move the magazine 705 into or out of position for loading of a projectile into the breach 633. The magazine 705 may further include structures, also not shown, to push a single projectile 700/shear plate 701 out of the end of the magazine 705 and into the breach 633/lip 652. The magazine 705 may, for example, include one or more servos to release a projectile 700/shear plate 701 from the bottom of the magazine 705 and push the released projectile 700/shear plate 701 into position. In a zero-g environment of a spacecraft, the forces needed to manipulate a released projectile 700/shear plate 701 into position would be relatively small, and servos and/or other manipulation structures may be relatively lightweight.

Figure 13A:
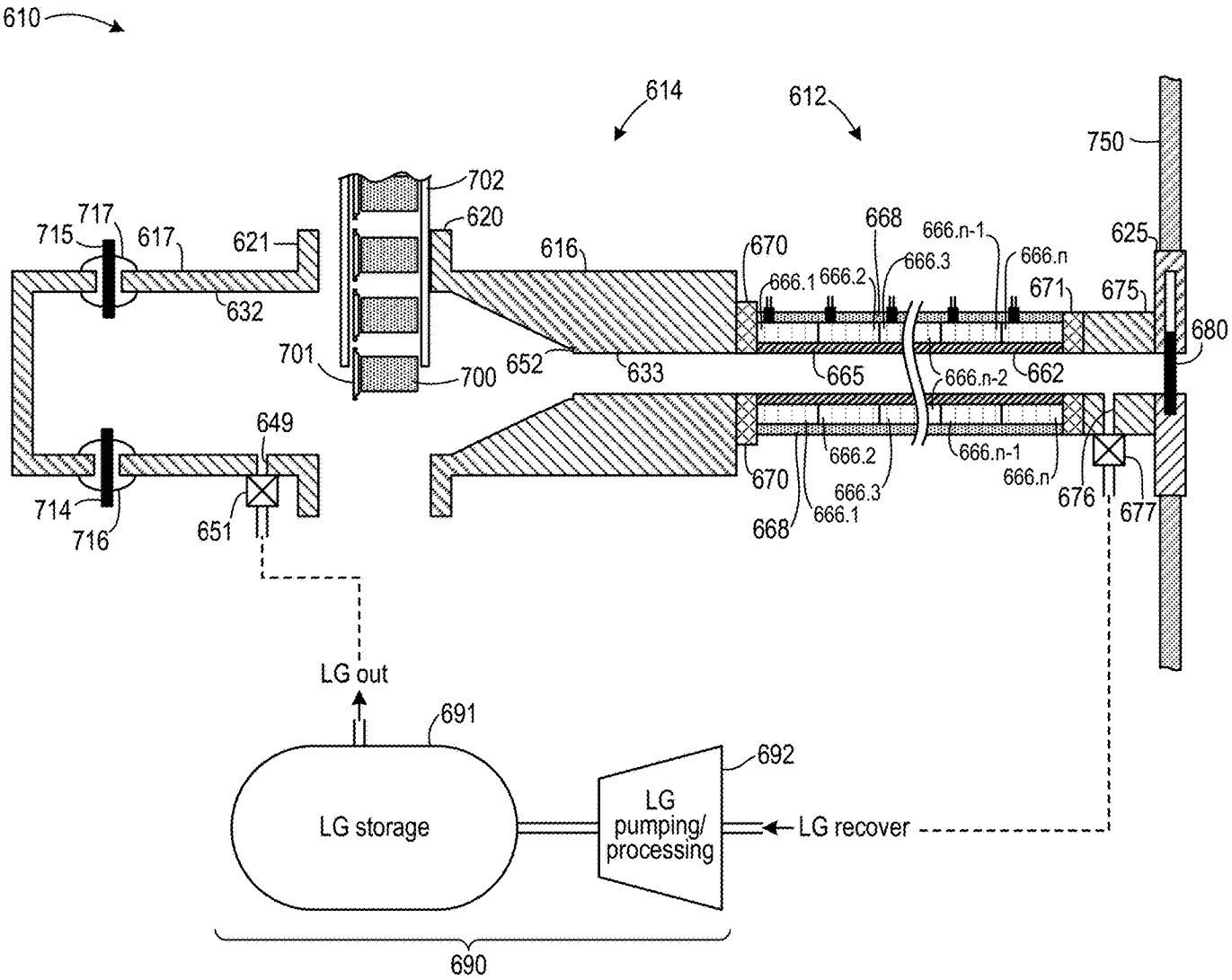
FIGS. 13A, 13B, 13C, 13D, and 13E are partially schematic area cross-sectional views showing operations in a firing sequence of the propulsion system of FIG. 12.

FIGS. 13A through 13E show operations in a firing sequence of the propulsion system 610. Each of FIGS. 13A through 13E is a partially schematic area cross-sectional view from the same sectioning plane used to obtain FIG. 12. FIG. 13A shows the propulsion system 610 at a time T60 after the launcher 614 has opened by separating the flanges 620 and 621. Hydraulic rams, not shown, may be positioned around the circumferences of the flanges 620 and 621 to open and close the launcher 614. The valves 651 and 677, as well as the shutter 680, are closed. The heaters 666 may be activated and the inner sleeve 665 of the barrel 612 may be heated to, or near, a desired temperature for firing. The magazine 705 has been moved into position to release a projectile 700/shear plate 701 for loading.

Figure 13B:
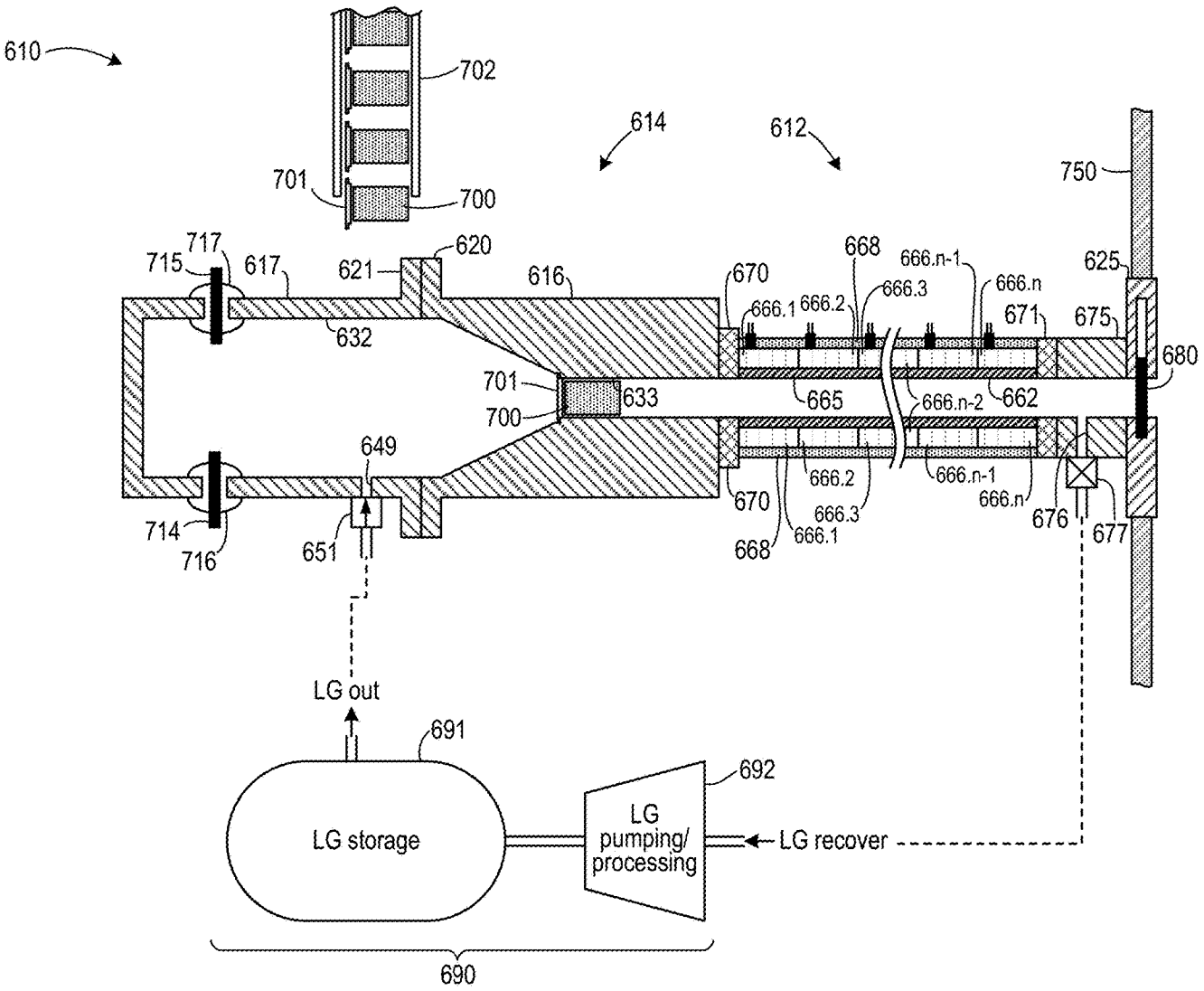

FIG. 13B shows the propulsion system 610 at a time T61 after time T60. A projectile 700 has been placed into the breach 633 and a shear plate 701 placed onto the rim 652. The magazine 705 has been removed and the launcher 614 has been closed by pressing together the flanges 620 and 621. The valve 651 is open, and propellant flows into the compression chamber 632, from the tank(s) 691, via the port 649. Space is a vacuum, and the launcher 614 may be operated in an unpressured portion of a spacecraft. Intrusion of air into the heated bore 662 via the breach 633 may not be a concern, and purging of the breach 633 prior to firing may be unnecessary. Accordingly, ports and valves for purging (such as ports 455 and 456 and valves 457 and 458) and a rear shutter may not be needed.

Figure 13C:
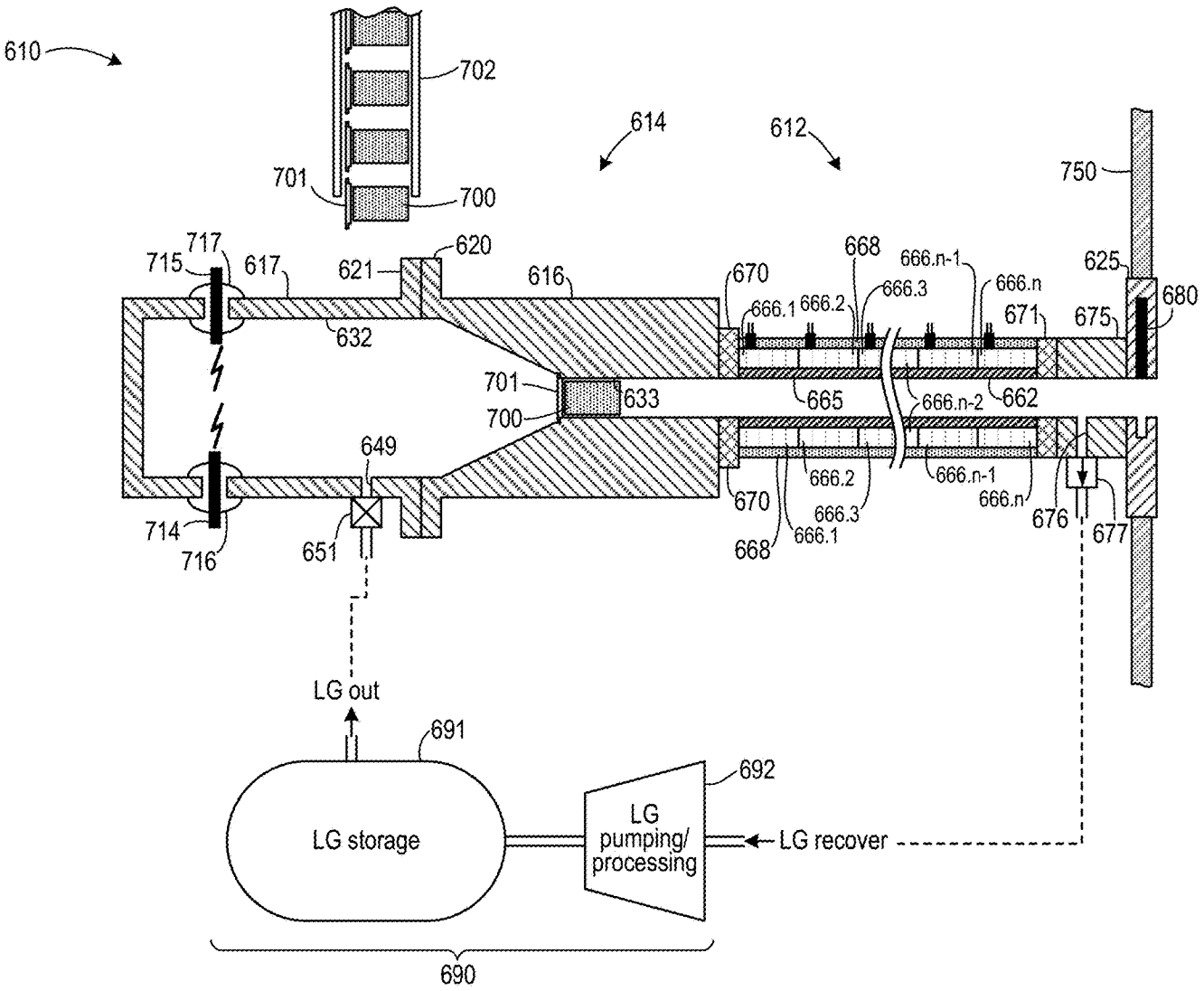

FIG. 13C shows the propulsion system 610 at a time T62 after time T61. Between times T61 and T62, the valve 651 was closed. At time T62, electrical power is applied to the electrodes 714 and 715 and an arc is created in the compression chamber 632. The arc heats the propellant in the chamber 632 and causes the propellant pressure to rise. At the same time that power is applied to the electrodes 714 and 715, the front shutter 680 and the valve 677 may be opened.

Figure 13D:
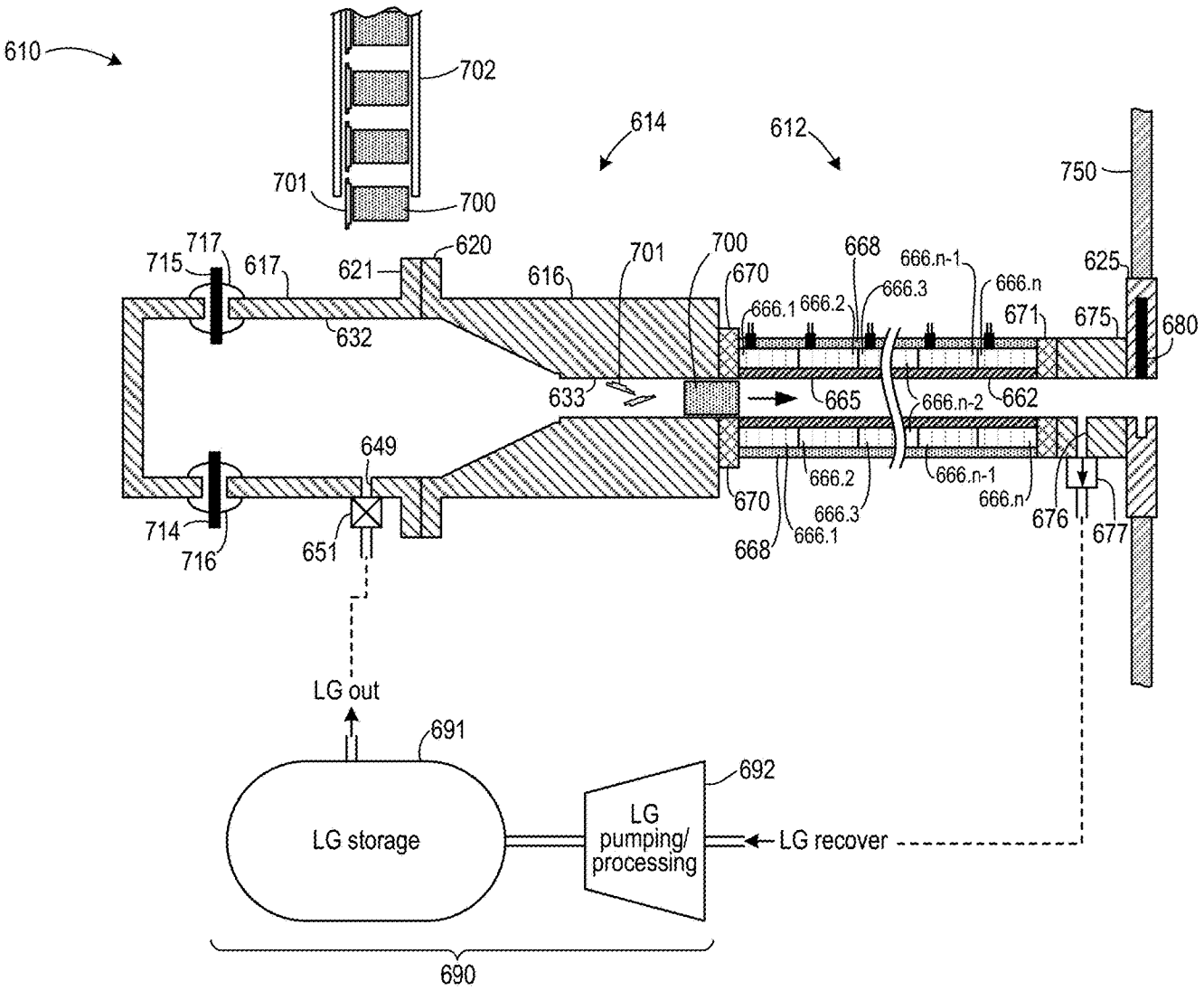

FIG. 13D shows the propulsion system 610 at a time T63 after time T62. The shear plate 701 has given way after the propellant pressure in the chamber 632 reached a sufficiently high value. The electrical arc across the electrodes 714 and 715 may be discontinued when the pressure in the chamber drops as a result of the shear plate 701 giving way. The launcher 614 may include a sensor, not shown, that measures pressure in the compression chamber and that may be used to determine when power to the electrodes 714 and 715 is shut off. As also shown in FIG. 13D, the compressed propellant in the compression chamber 632 has begun expanding into the breach 633 to begin pushing the projectile 700 forward.

Figure 13E:
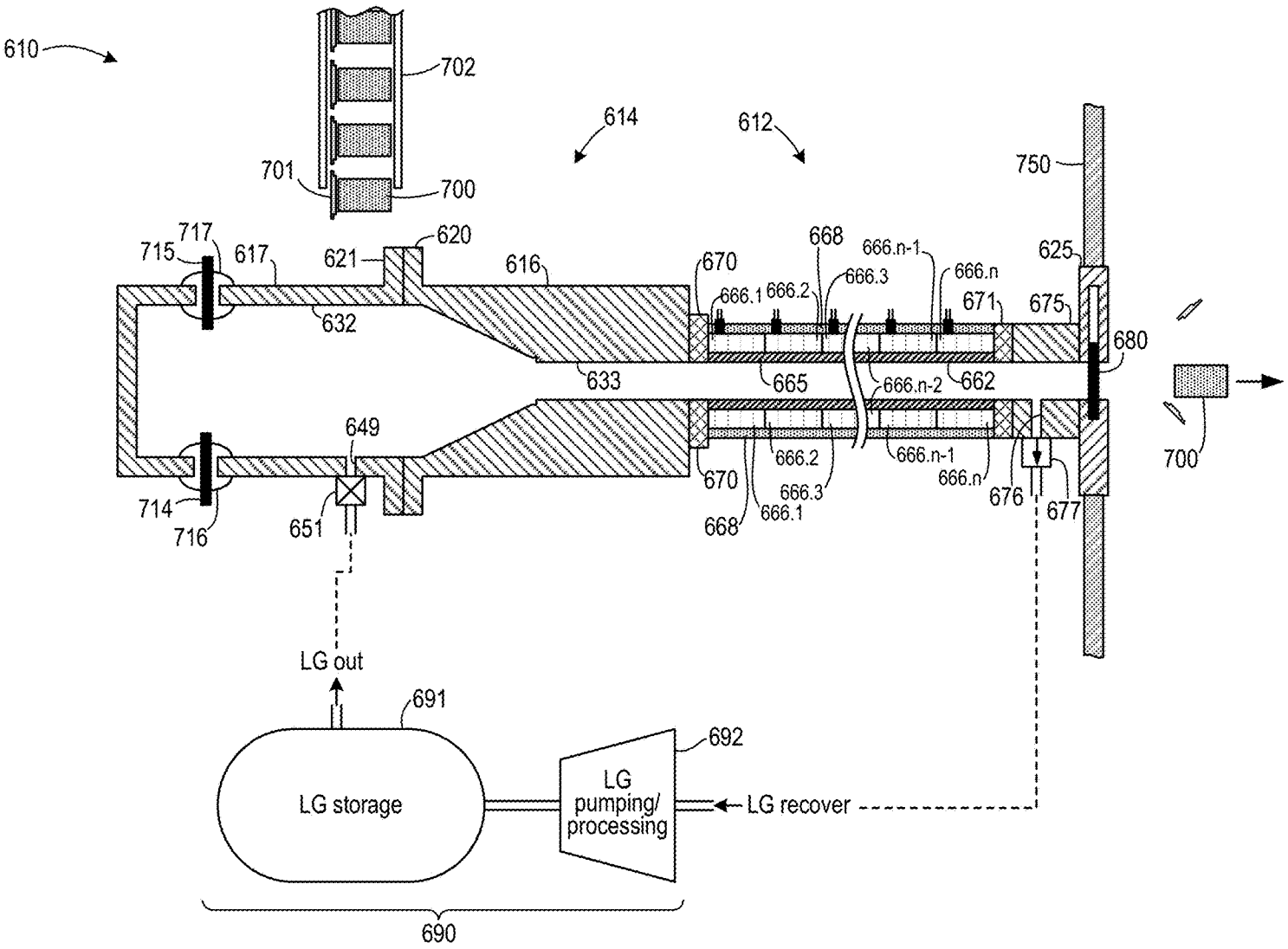

FIG. 13E shows the propulsion system 610 at a time T64 after time T63. At time T64, which is very soon after the projectile 700 and the remnants of the shear plate 701 have left the propulsion system 610, the front shutter 680 may be closed. The valve 677 may be left open for a short period of time after the closing of the shutter 680, thereby allowing propellant to exit the barrel 612 via the port 676 and be recovered at the input to the subsystem 692. The valve 677 may subsequently be closed.

Figure 14:
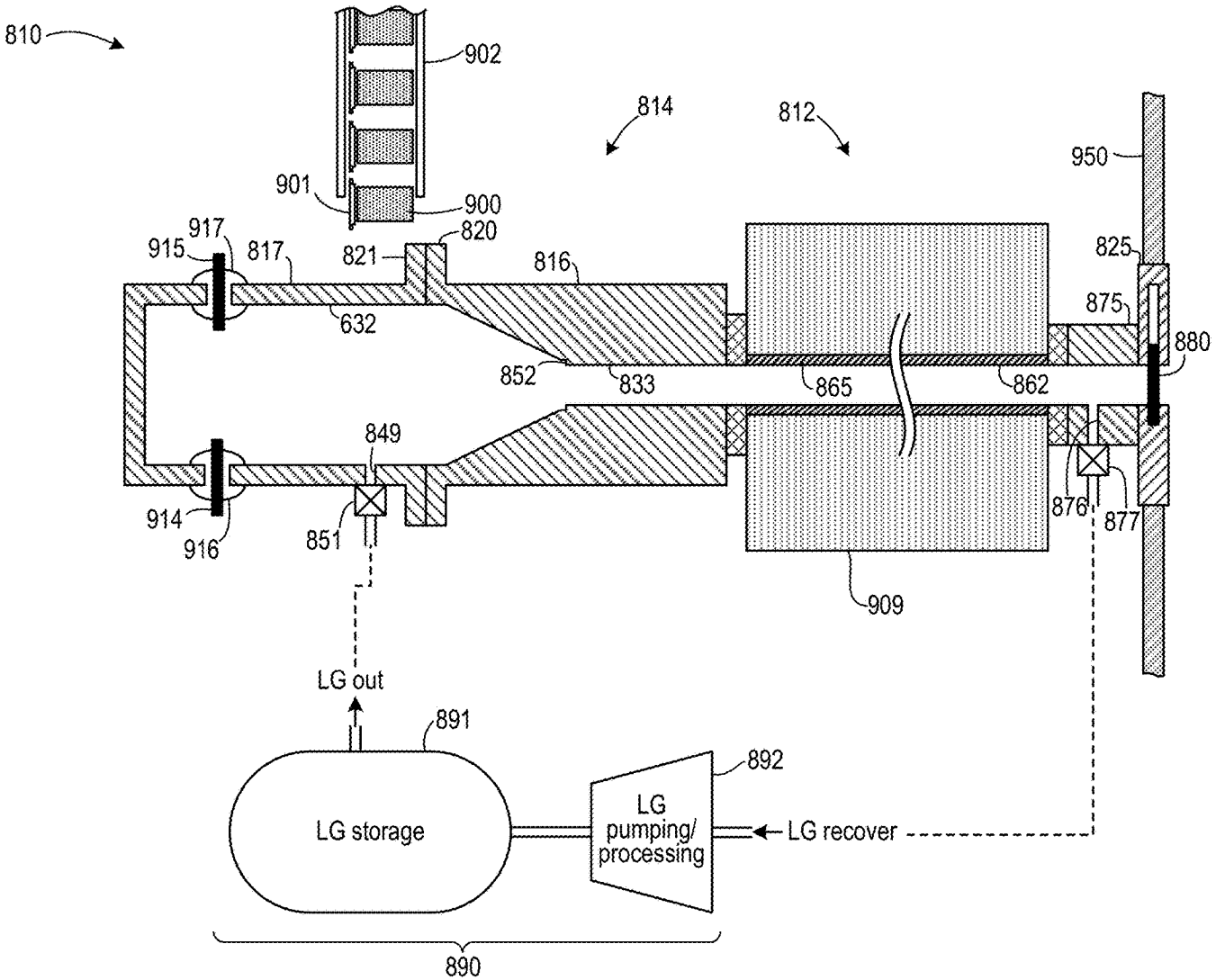
FIG. 14 is a partially schematic area cross-sectional view of another example propulsion system.

Although the propulsion system 610 is similar to the gun 410, propulsion systems similar to the guns 10, 210, and/or 210' could also or alternatively be used. Additional modifications may also be made to propulsion systems and/or guns. For example, FIG. 14 is a partially schematic area cross-sectional view of a propulsion system 810 that is similar to the propulsion system 610. Each row of Table 5 indicates one or more elements of the propulsion system 610 that may be structurally similar to, and that may operate in a similar manner as, one or more corresponding elements of the propulsion system 810.

TABLE 5

| Propulsion System 610 Element(s) | Propulsion System 810 Element(s) |
|---|---|
| barrel 612 | barrel 812 |
| launcher 614 | launcher 814 |
| front portion 616 | front portion 816 |
| rear portion 617 | rear portion 817 |
| flanges 620 and 621 | flanges 820 and 821 |
| cables 623 | cables 823 |
| wiring harness 624 | wiring harness 824 |
| front shutter assembly 625 | front shutter assembly 825 |
| compression chamber 632 | compression chamber 832 |
| breach 633 | breach 833 |
| port 649 | port 849 |
| valve 651 | valve 851 |
| lip 652 | lip 852 |
| bore 662 | bore 862 |
| inner sleeve 665 | inner sleeve 865 |
| insulator 670 | insulator 870 |
| insulator 671 | insulator 871 |
| propellant recovery manifold 675 | propellant recovery manifold 875 |
| port 676 | port 876 |
| valve 677 | valve 877 |
| front shutter 680 | front shutter 880 |
| propellant recovery and supply system 690 | propellant recovery and supply system 890 |
| storage tank(s) 691 | storage tank(s) 891 |
| propellant pumping/processing subsystem 692 | propellant pumping/processing subsystem 892 |
| projectile 700 | projectile 900 |
| shear plate 701 | shear plate 901 |
| magazine 705 | magazine 905 |
| electrodes 714 and 715 | electrodes 914 and 915 |
| insulators 716 and 717 | insulators 916 and 917 |

Unlike the propulsion system 610, the propulsion system 810 may use a low enrichment uranium (LEU) nuclear pile 909 to heat the barrel 812. Although the pile 909 is shown as a single element for simplicity, multiple piles could be used. An LEU nuclear pile could also be combined with ohmic or other electrically powered heating elements, e.g., to control temperature in different zones of the barrel 812.

The thrust of a propulsion system may be increased by increasing a firing rate. FIGS. 15A through 15F show operations in a firing sequence of a gun 1010 that is similar to the gun 610, but that includes a circular magazine 1103 that operates similar to a cylinder of a revolver handgun. The magazine 1103, a portion of which is shown in FIGS. 15A through 15F, may include multiple chambers 1131 that may each hold a projectile and shear plate and that may be moved into firing position by rotating the magazine about an axis parallel to the longitudinal axis L' of the propulsion system 1010. When in a firing position, each of the magazine chambers 1131 forms part of the breach 1033. The magazine 1103 may move through a slot formed in the launcher 1014. Sliding seals could be present between a face 1083 of the slot and the rear side of the magazine 1103 and between a face 1082 of the slot and the front side of the magazine 1103. The launcher 1014 of the propulsion system 1010 may be, rearward the face 1083, a generally cylindrical pressure chamber. Forward of the face 1082, the launcher 1014 may be block that includes a passage forming a portion of the breach 1033. Each row of Table 6 indicates one or more elements of the propulsion system 1010 that may be structurally similar to, and that may operate in a similar manner as, one or more corresponding elements of the propulsion system 610.

TABLE 6

| Propulsion System 610 Element(s) | Propulsion System 1010 Element(s) |
|---|---|
| barrel 612 | barrel 1012 |
| cables 623 | cables 1023 |
| wiring harness 624 | wiring harness 1024 |
| front shutter assembly 625 | front shutter assembly 1025 |
| compression chamber 632 | compression chamber 1032 |
| breach 633 | breach 1033 |
| port 649 | port 1049 |
| valve 651 | valve 1051 |
| bore 662 | bore 1062 |
| inner sleeve 665 | inner sleeve 1065 |
| insulator 670 | insulator 1070 |
| insulator 671 | insulator 1071 |
| propellant recovery manifold 675 | propellant recovery manifold 1075 |
| port 676 | port 1076 |
| valve 677 | valve 1077 |
| front shutter 680 | front shutter 1080 |
| propellant recovery and supply system 690 | propellant recovery and supply system 1090 |
| storage tank(s) 691 | storage tank(s) 1091 |
| propellant pumping/processing subsystem 692 | propellant pumping/processing subsystem 1092 |
| projectile 700 | projectile 1100 |
| shear plate 701 | shear plate 1101 |
| electrodes 714 and 715 | electrodes 1114 and 1115 |
| insulators 716 and 717 | insulators 1116 and 1117 |
| bulkhead 750 | bulkhead 1150 |

Figure 15A:
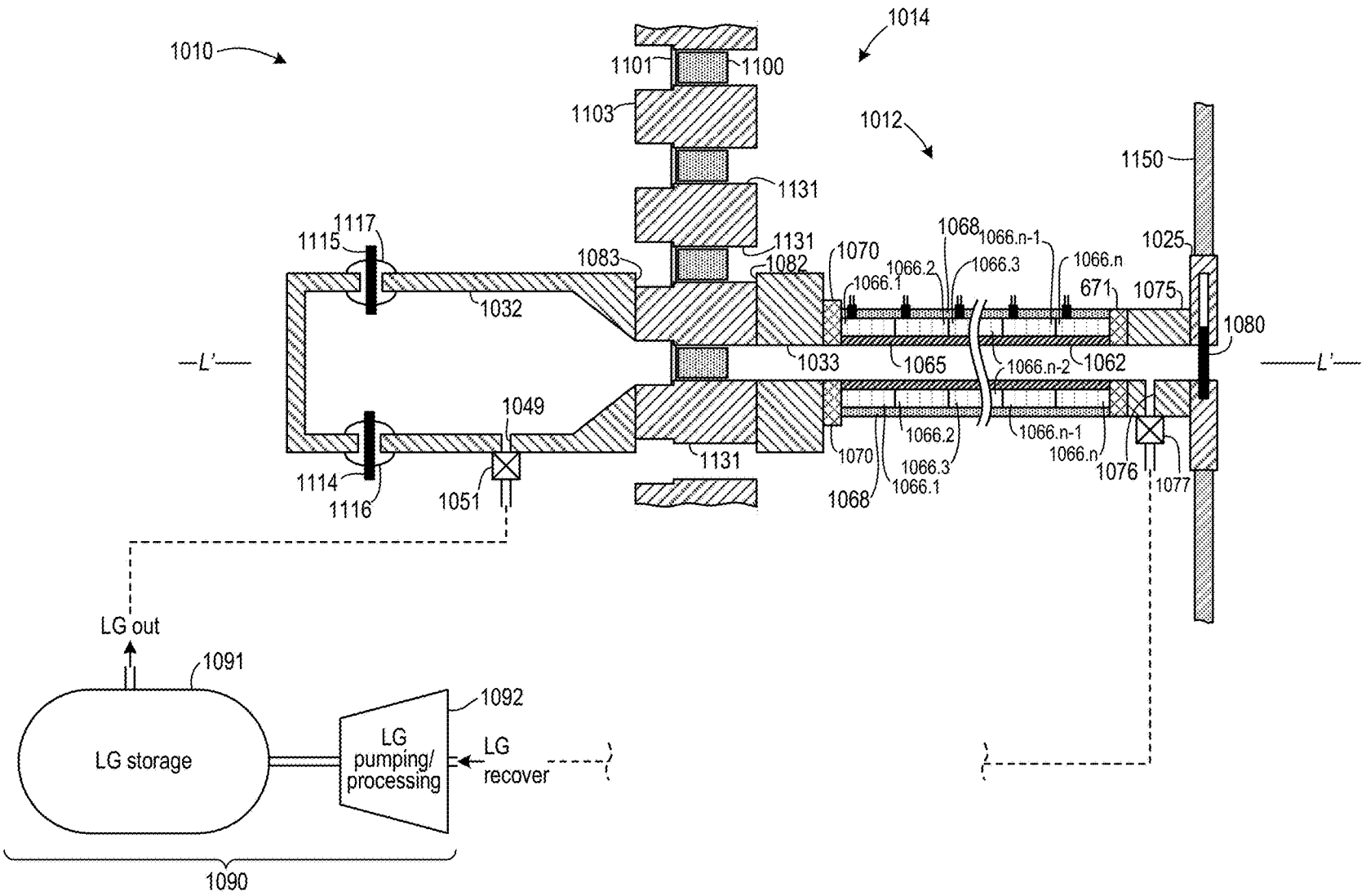
FIGS. 15A, 15B, 15C, 15D, 15E, and 15F are partially schematic area cross-sectional views showing operations in a firing sequence of a propulsion system similar to the propulsion system of FIG. 12.
Figure 15B:
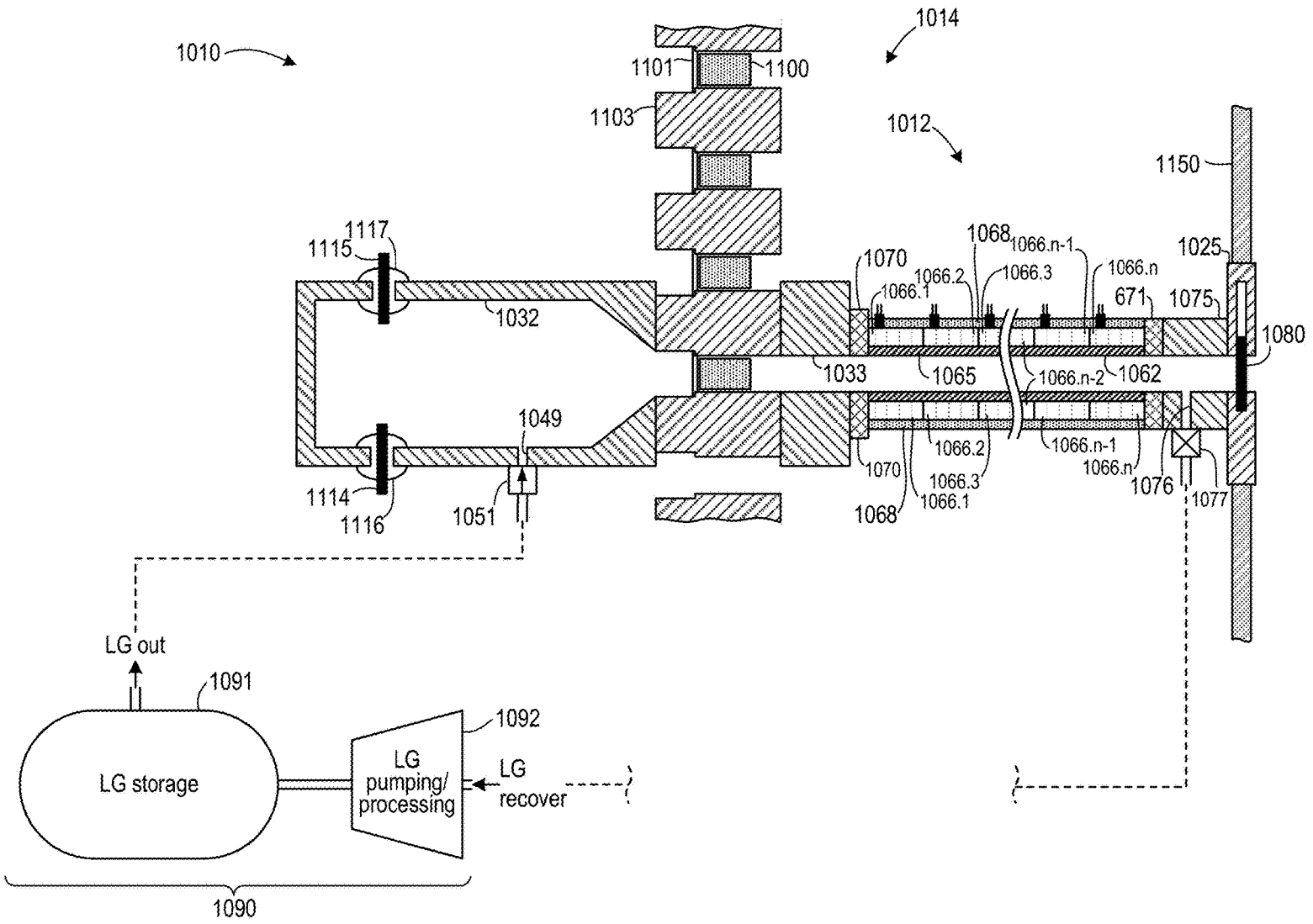
Figure 15C:
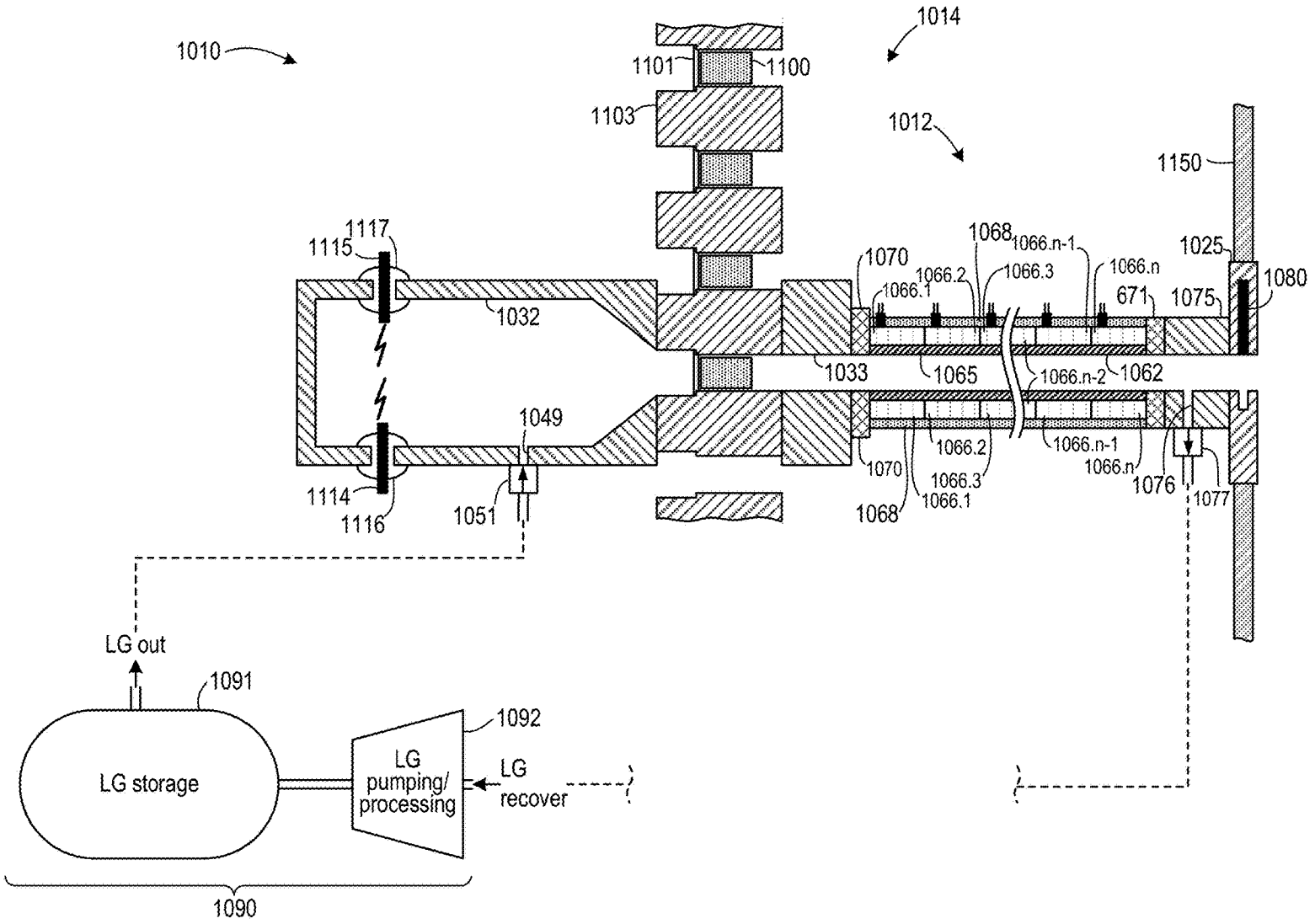

FIG. 15A shows the propulsion system 1010 at a time T80. The valves 1051 and 1077, as well as the shutter 1080, are closed. The heaters 1066 may be activated and the inner sleeve 1065 of the barrel 1012 may be heated to, or near, a desired temperature for firing. The magazine 1103 has been rotated to place a projectile 900/shear plate 901 in a firing position. FIG. 15B shows the propulsion system 1010 at a time T81 after time T80. The valve 1051 is open, and propellant flows into the compression chamber 1032, from the tank(s) 1091, via the port 1049. FIG. 15C shows the propulsion system 1010 at a time T82 after time T81. Between times T81 and T82, the valve 1051 was closed. At time T82, electrical power is applied to the electrodes 1114 and 1115 and an arc is created in the compression chamber 1032. The arc heats the propellant in the chamber 1032 and causes the propellant pressure to rise. At the same time that power is applied to the electrodes 1114 and 1115, the front shutter 1080 and the valve 1077 may be opened.

Figure 15D:
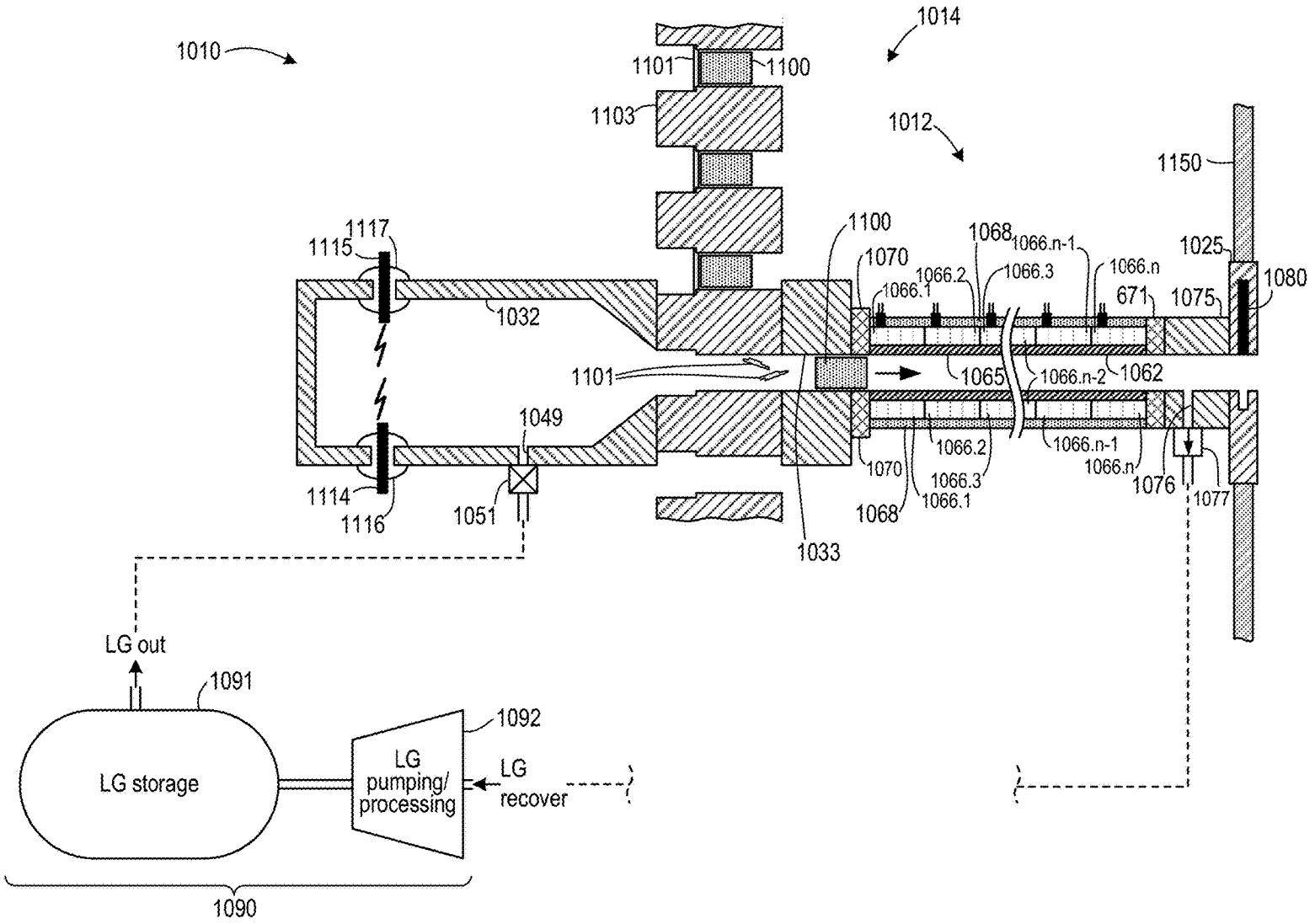

FIG. 15D shows the propulsion system 1010 at a time T83 after time T82. The shear plate 1101 has given way after the propellant pressure in the chamber 1032 reached a sufficiently high value. The electrical arc across the electrodes 1114 and 1115 may be discontinued when the pressure in the chamber drops as a result of the shear plate 1101 giving way. The launcher 1014 may include a sensor, not shown, that measures pressure in the compression chamber and that may be used to determine when power to the electrodes 1114 and 1115 is shut off. As also shown in FIG. 15D, the compressed propellant in the compression chamber 1032 has begun expanding into the breach 1033 to begin pushing the projectile 1100 forward.

Figure 15E:
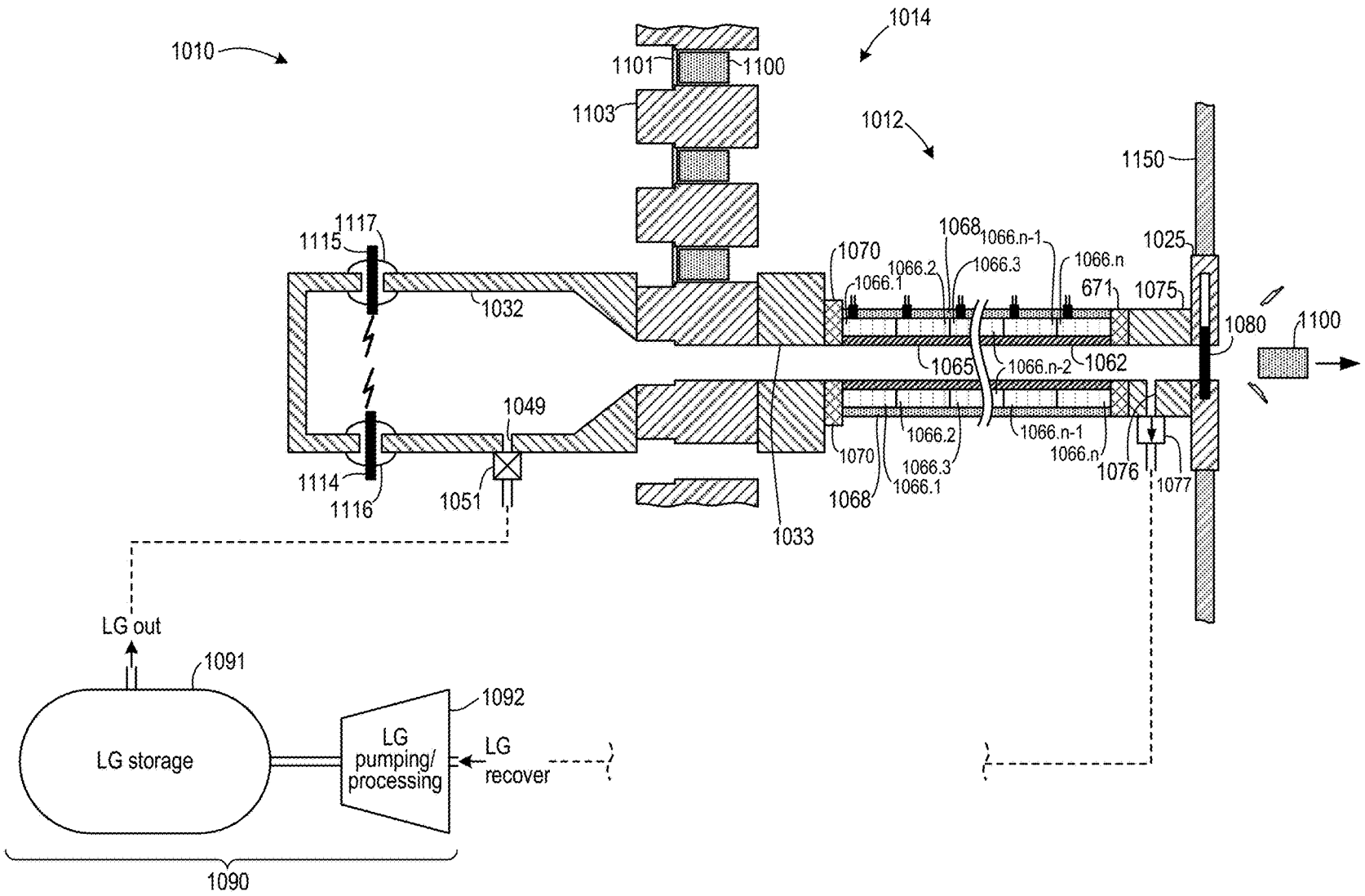
Figure 15F:
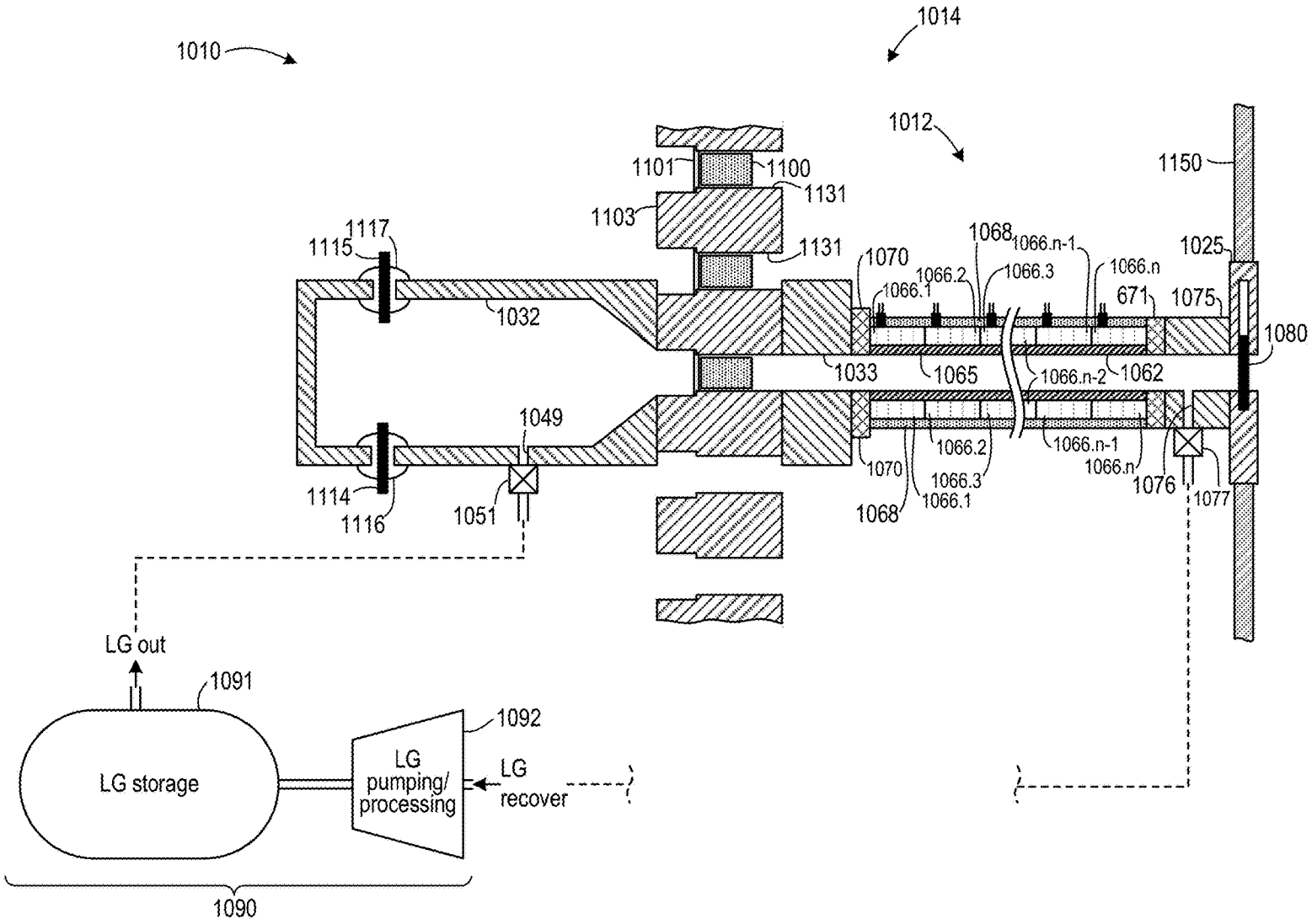

FIG. 15E shows the propulsion system 1010 at a time T84 after time T83. At time T84, which is very soon after the projectile 1100 and the remnants of the shear plate 1101 have left the propulsion system 1010, the front shutter 1080 may be closed. The valve 1077 may be left open for a short period of time after the closing of the shutter 1080, thereby allowing propellant to exit the barrel 1012 via the port 1076 and be recovered at the input to the subsystem 1092. The valve 1077 may subsequently be closed. FIG. 15F shows the magazine 1103 rotated to place another projectile 1100 and shear plate 1101 into firing position. Empty chambers 1131 may be reloaded during the firing cycles of other chambers.

The propulsion system 1010 may include a nuclear pile, similar to the nuclear pile 909, instead of or in addition to the heaters 1066. Any of the guns 10, 210, 210', or 410 could be modified to include a magazine similar to the magazine 1103.

Although the examples of FIGS. 13E and 15E show a projectile formed from dust leaving as a solid slug, this need not be the case. A propulsion system barrel may be operated at a temperature sufficiently high to melt a dust-based projectile. The barrel bore diameter may be reduced and/or the barrel length may be increased so as to increase melting of a projectile. A melted projectile may have less friction as it travels through a barrel, thereby allowing increased projectile velocity. Upon exit from the propulsion system, a melted projectile may advantageously disperse into small drops and/or fragments.

Barrels may be of different lengths. Longer barrels may be used to achieve higher projectile velocities. Non-limiting examples of barrel lengths include 14 m, 20 m, and 30 m. Barrel temperature may be used to control velocity, and thus range, of a projectile fired from a heated barrel. Temperatures to which a barrel bore may be heated may depend on material choice. Barrel sleeves formed from tungsten may be heated, e.g., to 2000° K or more, to 2200° K or more, to 2500° K or more, or to 3000° K or more. Barrel sleeves formed from steel and/or other materials may be used, but may be limited to lower temperatures. Barrels may include sleeves formed from multiple materials. For example, portions of a barrel sleeve adjacent a breach and extending toward a center of a barrel's length may be formed from steel, with remaining portions of the sleeve formed from tungsten.

Multiple propulsion systems using heatable barrels may be used in a single spacecraft. The multiple propulsion systems may be of the same type (e.g., with electrical or nuclear heating, with mechanical and/or electrical propellant compression, etc.) or of different types. Multiple propulsion systems in a single spacecraft may be fired in sequence to provide smoother thrust.

The foregoing has been presented for purposes of example. The foregoing is not intended to be exhaustive or to limit features to the precise form disclosed. The examples discussed herein were chosen and described in order to explain principles and the nature of various examples and their practical application to enable one skilled in the art to use these and other implementations with various modifications as are suited to the particular use contemplated. The scope of this disclosure encompasses, but is not limited to, any and all combinations, subcombinations, and permutations of structure, operations, and/or other features described herein and in the accompanying drawing figures.

The invention claimed is:

1. An apparatus comprising:

a barrel comprising a bore and one or more controllable heaters configured to heat a surface of the bore;

a first chamber configured to position a projectile relative to the barrel;

a second chamber configured to direct a pressurized light gas behind the projectile for movement from the first chamber and acceleration through the bore; and a magazine moveable to place individual projectiles, of a plurality of projectiles held in the magazine, in position for acceleration through the bore, wherein each projectile, of the plurality of projectiles, is formed from compressed dust comprising at least 40% silicon dioxide.

2. The apparatus of claim 1, further comprising a gas supply, coupled to the second chamber via a valve, containing a supply of the light gas, and wherein the light gas comprises one or more of hydrogen or helium.

3. The apparatus of claim 2, further comprising a recovery manifold coupled to the bore and to the gas supply.

4. The apparatus of claim 1, wherein at least a portion of the first chamber is comprised by a portion of the magazine holding a projectile of the plurality of projectiles.

5. The apparatus of claim 1, wherein the one or more controllable heaters comprise a plurality of heaters positioned along a length of the barrel.

6. The apparatus of claim 5, wherein each heater, of the plurality of heaters, is individually controllable.

7. The apparatus of claim 5, wherein the plurality of heaters are configured to create a temperature gradient in which portions of the bore surface nearer an exit of the barrel than an entrance of the barrel are heated to temperatures that are higher than temperatures to which portions of the bore surface, nearer the entrance of the barrel than the exit of the barrel, are heated.

8. The apparatus of claim 1, further comprising a shutter, positioned closer to an exit of the barrel than an entrance of the barrel, having an open configuration exposing the bore and a closed configuration preventing passage of gas into or out of the bore.

9. The apparatus of claim 1, wherein the one or more controllable heaters comprise a plurality of heaters positioned along a length of the barrel and configured to maintain the surface of the bore at a temperature above 700° K.

10. An apparatus comprising:

a barrel comprising:

a bore formed in a tungsten sleeve and one or more controllable heaters configured to heat a surface of the bore;

a launcher positioned adjacent an entrance of the barrel and configured to:

position a projectile, formed from compressed dust comprising at least 40% silicon dioxide, relative to the barrel, and direct a pressurized light gas behind the projectile for acceleration of the projectile through the bore; and a gas supply, coupled to the launcher via a valve, containing a supply of the light gas, and wherein the light gas comprises one or more of hydrogen or helium.

11. The apparatus of claim 10, further comprising a recovery manifold coupled to the bore and to the gas supply.

12. The apparatus of claim 10, wherein the one or more controllable heaters comprise a plurality of heaters positioned along a length of the barrel and configured to maintain the tungsten sleeve at a temperature above 700° K.

13. The apparatus of claim 10, further comprising a shutter, positioned closer to an exit of the barrel than an entrance of the barrel, having an open configuration exposing the bore and a closed configuration preventing passage of gas into or out of the bore.

14. The apparatus of claim 10, wherein the launcher is further configured to compress the light gas.

15. The apparatus of claim 10, wherein the launcher comprises a magazine moveable to place individual projectiles, of a plurality of projectiles held in the magazine, in position for acceleration through the bore.

16. The apparatus of claim 10, further comprising an insulator separating a portion of the barrel comprising the one or more controllable heaters from the launcher, wherein the insulator comprises an ultra-high temperature ceramic comprising one or more of: hafnium diboride, zirconium diboride, hafnium nitride, zirconium nitride, titanium carbide, titanium nitride, or tantalum carbide.

17. A method comprising:

heating, using one or more heaters positioned external to a bore of a barrel, a surface of the bore;

positioning a projectile, formed from compressed dust comprising at least 40% silicon dioxide, relative to the barrel; and accelerating, by release of a pressurized light gas behind the projectile, the projectile through the bore.

18. The method of claim 17, wherein the heating comprises:

heating portions of the bore surface nearer an exit of the barrel than an entrance of the barrel to one of more first temperatures; and heating portions of the bore surface nearer the entrance of the barrel than the exit of the barrel to one of more second temperatures lower than the one or more first temperatures.

19. The method of claim 17, wherein the light gas comprises one or more of hydrogen or helium.

20. The method of claim 17, further comprising:

closing, after exit of the projectile from the bore, a shutter positioned proximate to an exit of the barrel, wherein the closed shutter prevents passage of gas into or out of the bore.

21. The method of claim 17, further comprising:

recovering, after passage of the projectile through the bore, the light gas.

22. The method of claim 17, wherein the one or more heaters comprise a plurality of heaters positioned along a length of the barrel and configured to maintain the surface of the bore at a temperature above 700° K.

* * * * *